US011143450B2

(12) United States Patent
Sumihiro et al.

(10) Patent No.: US 11,143,450 B2
(45) Date of Patent: Oct. 12, 2021

(54) REFRIGERATOR AND CAMERA DEVICE

(71) Applicant: TOSHIBA LIFESTYLE PRODUCTS & SERVICES CORPORATION, Ome (JP)

(72) Inventors: Katsushi Sumihiro, Tokyo (JP); Yuuki Marutani, Tokyo (JP); Kazuhiro Furuta, Tokyo (JP); Hirokazu Izawa, Tokyo (JP); Kota Watanabe, Tokyo (JP); Ryo Kawada, Tokyo (JP)

(73) Assignee: TOSHIBA LIFESTYLE PRODUCTS & SERVICES CORPORATION, Tokyo (JP)

( * ) Notice: Subject to any disclaimer, the term of this patent is extended or adjusted under 35 U.S.C. 154(b) by 0 days.

(21) Appl. No.: 15/974,952

(22) Filed: May 9, 2018

(65) Prior Publication Data

US 2018/0259242 A1 Sep. 13, 2018

Related U.S. Application Data

(63) Continuation of application No. 14/776,729, filed as application No. PCT/JP2014/056326 on Mar. 11, 2014, now Pat. No. 10,018,402.

(30) Foreign Application Priority Data

Mar. 12, 2013 (JP) ..... 2013-049073
Jul. 16, 2013 (JP) ..... 2013-147562
(Continued)

(51) Int. Cl.
*F25D 23/02* (2006.01)
*F25D 23/12* (2006.01)
(Continued)

(52) U.S. Cl.
CPC ..... *F25D 23/028* (2013.01); *F25D 11/00* (2013.01); *F25D 23/04* (2013.01); *F25D 23/12* (2013.01); *F25D 27/00* (2013.01)

(58) Field of Classification Search
USPC ..... 396/155
See application file for complete search history.

(56) References Cited

U.S. PATENT DOCUMENTS 3,982,801 A * 9/1976 Heidorn ..... A47B 57/06 312/306
5,913,584 A * 6/1999 Swindell ..... A47B 57/06 108/108
(Continued)

FOREIGN PATENT DOCUMENTS

CN 1209153 A 2/1999
CN 2619441 6/2004
(Continued)

OTHER PUBLICATIONS

U.S. Appl. No. 14/776,728, US 2016-0047587, filed Feb. 18, 2016, Pending.
(Continued)

*Primary Examiner* — Rodney E Fuller
(74) *Attorney, Agent, or Firm* — DLA Piper LLP (US)

(57) ABSTRACT

A refrigerator (1) is provided with an image capturing camera 18 (image capturing unit) configured to capture an image of an interior of a storage chamber (such as a refrigeration chamber 3); a communication portion (52) (communication unit) configured to transmit image of the interior of the storage chamber captured by the image capturing camera (18) to an exterior device; wherein the image capturing unit is stored in a recess provided in the interior of the storage chamber.

8 Claims, 59 Drawing Sheets

(30) Foreign Application Priority Data

Oct. 30, 2013 (JP) ..... 2013-225439
Feb. 28, 2014 (JP) ..... 2014-038460

(51) Int. Cl.
*F25D 27/00* (2006.01)
*F25D 23/04* (2006.01)
*F25D 11/00* (2006.01)

(56) References Cited

U.S. PATENT DOCUMENTS

| | | | | |
|---|---|---|---|---|
| 6,919,795 | B2 | 7/2005 | Roseen | |
| 7,853,142 | B2 | 12/2010 | Meyers | |
| 8,756,942 | B2 | 6/2014 | Min et al. | |
| 10,018,402 | B2 * | 7/2018 | Sumihiro | F25D 23/04 |
| 2002/0066279 | A1 | 6/2002 | Kiyomatsu | |
| 2002/0167589 | A1 | 11/2002 | Schofield et al. | |
| 2003/0164754 | A1 | 9/2003 | Roseen | |
| 2006/0096303 | A1 * | 5/2006 | Kavounas | F25D 29/00 62/125 |
| 2006/0174641 | A1 | 8/2006 | Liu | |
| 2007/0152076 | A1 * | 7/2007 | Chiang | F25D 29/00 236/94 |
| 2008/0307818 | A1 | 12/2008 | Min | |
| 2010/0024462 | A1 | 2/2010 | Kamisako | |
| 2010/0170278 | A1 * | 7/2010 | Min | F25D 17/042 62/264 |
| 2010/0170289 | A1 * | 7/2010 | Graziano | H04N 7/181 62/449 |
| 2010/0283573 | A1 | 11/2010 | Yum et al. | |
| 2011/0233289 | A1 | 9/2011 | Bortoletto et al. | |
| 2012/0023971 | A1 | 2/2012 | Min | |
| 2012/0260683 | A1 | 10/2012 | Cheon et al. | |
| 2012/0265348 | A1 | 10/2012 | Kim et al. | |
| 2013/0015753 | A1 | 1/2013 | Son et al. | |
| 2014/0042886 | A1 * | 2/2014 | Baldo | F25D 23/028 312/405.1 |
| 2014/0137587 | A1 * | 5/2014 | Hitzelberger | F25D 17/042 62/228.1 |
| 2014/0139710 | A1 | 5/2014 | Chen | |
| 2014/0252091 | A1 | 9/2014 | Morse | |
| 2014/0293060 | A1 * | 10/2014 | Ryu | H04N 5/2252 348/159 |
| 2014/0300265 | A1 * | 10/2014 | Lee | F25D 29/00 312/405.1 |
| 2014/0320647 | A1 | 10/2014 | Seo et al. | |
| 2015/0023000 | A1 * | 1/2015 | Kendall | F25D 25/02 362/92 |
| 2015/0059374 | A1 * | 3/2015 | Hebei | F25D 29/00 62/125 |
| 2015/0211783 | A1 | 7/2015 | Marutani | |
| 2015/0260449 | A1 | 9/2015 | Furuta | |
| 2015/0260450 | A1 | 9/2015 | Marutani | |
| 2016/0047587 | A1 | 2/2016 | Sasaki | |
| 2018/0087829 | A1 * | 3/2018 | Kim | F25D 29/00 |

FOREIGN PATENT DOCUMENTS

| | | |
|---|---|---|
| CN | 1175285 | 11/2004 |
| CN | 2811883 | 8/2006 |
| CN | 101995141 | 3/2011 |
| CN | 102003864 | 4/2011 |
| CN | 102032740 | 4/2011 |
| CN | 102150079 | 8/2011 |
| CN | 102183120 | 9/2011 |
| CN | 102741633 A | 10/2012 |
| CN | 2478043 Y | 2/2020 |
| EP | 1 662 218 | 5/2006 |
| EP | EP 0816466 | 5/2006 |
| JP | 2-44327 | 2/1990 |
| JP | H08-49958 | 2/1996 |
| JP | H09-0222538 | 8/1997 |
| JP | H11-177858 | 7/1999 |
| JP | H-11337252 | 12/1999 |
| JP | 2000-131747 | 5/2000 |
| JP | 2001-133119 | 5/2001 |
| JP | 2001-317858 | 11/2001 |
| JP | 2002-81818 | 3/2002 |
| JP | 2002-243335 | 8/2002 |
| JP | 2002-267337 | 9/2002 |
| JP | 2002-295962 | 10/2002 |
| JP | 2002-340471 | 11/2002 |
| JP | 2003-004366 | 1/2003 |
| JP | 2002-042626 | 2/2003 |
| JP | 200342626 | 2/2003 |
| JP | 2003-207258 | 7/2003 |
| JP | 2004-183987 | 7/2004 |
| JP | 2005-030607 | 2/2005 |
| JP | 2005-156107 | 6/2005 |
| JP | 2005-265243 | 9/2005 |
| JP | 2005-315479 | 11/2005 |
| JP | 2006-046771 | 2/2006 |
| JP | 2006-084132 | 3/2006 |
| JP | 2007-046833 | 2/2007 |
| JP | 2007-046834 | 2/2007 |
| JP | 2007-113818 | 5/2007 |
| JP | 2007-132543 | 5/2007 |
| JP | 2008-075925 | 4/2008 |
| JP | 2008-104077 | 5/2008 |
| JP | 2009-147704 | 7/2009 |
| JP | 2009-250602 | 10/2009 |
| JP | 2010121784 | 6/2010 |
| JP | 2011-021865 | 2/2011 |
| JP | 2011-069499 | 4/2011 |
| JP | 2011-226760 | 11/2011 |
| JP | 2012-032009 | 2/2012 |
| JP | 2012-078086 | 4/2012 |
| JP | 2012-107770 | 6/2012 |
| JP | 2012-193873 A | 10/2012 |
| JP | 2012-220186 | 11/2012 |
| JP | 2012-220942 | 11/2012 |
| JP | 2012-226748 | 11/2012 |
| JP | 2012-251722 | 12/2012 |
| JP | 2012-251724 | 12/2012 |
| JP | 2013-024506 | 2/2013 |
| JP | 2014-196845 | 10/2014 |
| JP | 2014-209047 | 11/2014 |
| KR | 2000-0009521 | 6/2000 |
| KR | 10-2004-0083784 | 10/2004 |
| KR | 2006-0095419 | 8/2006 |
| KR | 10-2012-0075825 | 7/2012 |
| TW | 233858 | 11/1994 |
| TW | 313630 | 8/1997 |
| TW | 587149 | 5/2004 |
| TW | M287928 | 2/2006 |
| TW | 200617334 | 6/2006 |
| TW | 201217731 | 5/2012 |
| WO | WO 2005/015510 | 2/2005 |
| WO | WO 2012/091256 | 7/2012 |
| WO | WO 2012/153515 | 11/2012 |

OTHER PUBLICATIONS

U.S. Appl. No. 14,776,733, US 2016-0057394, filed Sep. 14, 2015, Pending.
International Search Report issued in PCT/JP2014/056326 dated Jun. 17, 2014 with English Language translation.
English Language Abstract and Translation for JP 2002-340471 published Nov. 27, 2002.
English Language Abstract and Translation for JP 2008-104077 published May 1, 2008.
English Language Abstract and Translation for JP 2003-207258 published Jul. 25, 2003.
English Language Abstract and Translation for JP 2012-078086 published Apr. 19, 2012.
English Language Abstract and Translation for JP 2012-032009 published Feb. 16, 2012.
English Language Abstract and Translation for JP 2003-004366 published Jan. 1, 2003.
English Language Abstract and Translation for JP H09-222538 published Aug. 26, 1997.

(56) References Cited

OTHER PUBLICATIONS

English Language Abstract and Translation for JP 2011-226760 published Nov. 10, 2011.
English Language Abstract and Translation for JP 2012-226748 published Nov. 15, 2012.
English Language Abstract and Translation for JP 2002-243335 published Aug. 28, 2002.
English Language Abstract and Translation for JP 2012-251724 published Dec. 20, 2012.
Taiwanese Office Action issued in 103108282 dated Dec. 2, 2015 with English Language Translation.
International Search Report issued in PCT/JP2014/056325 dated Jun. 17, 2014 with English Language translation.
English Language Abstract and Translation for JP 2007-46834 published Feb. 22, 2007.
English Language Abstract and Translation for JP 2011-69499 published Apr. 7, 2011.
Taiwanese Office Action issued in 103108275 dated Jul. 9, 2015 with English Language Translation.
English Language Abstract and Translation for CN 2011-101995141 published Mar. 30, 2011.
International Search Report issued in PCT/JP2014/056327 dated Jun. 24, 2014 with English Language translation.
English Language Abstract and Translation for JP 2002-267337 published Sep. 18, 2002.
English Language Abstract and Translation for JP 2009-147704 published Jul. 2, 2009.
English Language Abstract and Translation for JP 2011-021865 published Feb. 3, 2011.
English Language Abstract and Translation for JP 2003-042626 published Feb. 13, 2003.
English Language Abstract and Translation for JP 2007-113818 published May 10, 2007.
English Language Abstract and Translation for JP 2007-046833 published Feb. 22, 2007.
English Language Abstract and Translation for JP 2007-132543 published May 31, 2007.
English Language Abstract and Translation for JP 2008-075925 published Apr. 3, 2008.
English Language Abstract and Translation for JP 2012-220186 published Nov. 12, 2012.
English Language Abstract and Translation for JP 2005-265243 published Sep. 29, 2005.
Taiwanese Office Action issued in TW103108277 dated Mar. 7, 2016 with English Language Translation.
Korean Office Action issued in KR 10-2015-7028146 dated Jun. 22, 2016 with English Language Translation.
English Language Abstract and Translation for KR 10-2012-0075825 published Jul. 9, 2012.
English Language Abstract and Translation for JP 2000-131747 published May 12, 2000.
English Language machine translation of TW 200617334 published Jun. 1, 2006.
English language machine translation of TW 233858 published on Nov. 1, 1994.
English language Abstract and machine translation of TW 201217731 published on May 1, 2012.
Korean Office Action issued in KR 10-2015-7028150 dated Jun. 20, 2016 with English Language Translation.
Chinese Office Action issued in CN 201480014441.5 dated Jun. 2, 2016 with English Language Translation.
Chinese Office Action issued in CN 201480014042.9 dated Jul. 4, 2016 with English Language Translation.
Chinese Office Action issued in CN 201480014316.4 dated Jul. 5, 2016 with English Language Translation.
Korean Office Action issued in KR 10-2015-7028146 dated Feb. 2, 2017.
European Office Action issued in EP 14765282.0 dated Nov. 22, 2016.
European Office Action issued in EP 14764830.7 dated Nov. 24, 2016.
European Office Action issued in EP 14763567.6 dated Nov. 22, 2016.
Japanese Office Action issued in JP 2014-038459 dated Nov. 7, 2017.
Taiwan Office Action issued in TW 10621168720 dated Nov. 16, 2017.
Japanese Office Action issued in JP 2014-038461 dated Feb. 13, 2018.
Taiwan Office Action issued in TW 10720121180 dated Feb. 8, 2018.
English Language Abstract of JP 2002-81818 issued Mar. 22, 2002.
English Language Abstract of JP 2004-183987 issued Jul. 2, 2004.
English Language Abstract of TW 313630 issued Aug. 21, 1997.
English Language Abstract of TW 587149 issued May 11, 2004.
U.S. Appl. No. 14/776,728 electronically captured on May 8, 2018.
U.S. Appl. No. 14/776,733 electronically captured on May 8, 2018.
Office Action in TW Application No. 10820752480 dated Aug. 7, 2019.
Office Action in KR Application No. 10-2017-7011992 dated Sep. 16, 2019.
Office Action in JP Application No. 2018-154013 dated Oct. 1, 2019.
Office Action in JP Application No. 2019-082853 dated Oct. 8, 2019.
Office Action in JP Application No. 2019-040541 dated Jun. 4, 2019.
Office Action in JP Application No. 2019-082853 dated Jun. 4, 2019.
Chinese Office Action CN Application No. 201710140595.4 dated Dec. 27, 2019.
Chinese Office Action in CN Application No. 201710140454.2 dated Dec. 30, 2019.
Chinese Office Action in CN Application No. 201710251444.6 dated Jan. 20, 2020.
Korean Office Action in KR Application No. 10-2018-7027430 dated Jan. 20, 2020.
Korean Office Action in KR Application No. 10-2018-7010793 dated Jan. 21, 2020.
Japanese Office Action in JP Application No. 2019-106095 dated Apr. 21, 2020.
Chinese Office Action in CN Application No. 201710251398.X dated Jun. 3, 2020.
Chinese Office Action in CN Application No. 201710251444.6 dated Jun. 9, 2020.
Chinese Office Action in CN Application No. 201710251293.4 dated Apr. 9, 2020.
Chinese Office Action in CN Application No. 201710140562.X dated Apr. 16, 2020.
Chinese Office Action In CN Application No. 201710140670.7 dated Apr. 17, 2020.
Chinese Office Action in CN Application No. 201710140595.4 dated Apr. 21, 2020.
Chinese Office Action in CN Application No. 201710140546.0 dated Apr. 21, 2020.
Chinese Office Action in CN Application No. 201710251390.3 dated Apr. 27, 2020.
Taiwan Office Action in TW Application No. 10920399750 dated Apr. 29, 2020.
Korean Office Action in KR Application No. 10-2020-7006879 dated May 19, 2020.
U.S. Appl. No. 14/776,728 electronically captured on Jul. 10, 2020 (filed May 21, 2019 to Jul. 10, 2020).
U.S. Appl. No. 14/776,733 electronically captured on Jul. 10, 2020 (filed May 21, 2019 to Jul. 10, 2020).
Chinese Office Action in CN Application No. 201710140454.2 dated Apr. 21, 2020.
Korean Office Action issued in KR 2020-04842227 dated Jul. 16, 2020.
Chinese Office Action issued in CN 2017-10140670 dated Aug. 7, 2020.

(56) References Cited

OTHER PUBLICATIONS

Chinese Office Action issued in CN 2019-0116056 dated Jul. 2, 2020.
Chinese Office Action issued in CN CN 2019-0116096 dated Jul. 3, 2020.
Chinese Office Action issued in CN 2019-0116080 dated Aug. 31, 2020.
Chinese Office Action issued in CN 2019-0116150 dated Jul. 3, 2020.
Chinese Office Action issued in CN 2019-0116249 dated Jul. 2, 2020.
Japanese Office Action issued in JP 2019-182095 dated Oct. 20, 2020.
Japanese Office Action issued in JP 2020-000273 dated Sep. 8, 2020.
Chinese Office Action issued in CN 2017-10140546 dated Aug. 7, 2020.
Chinese Office Action issued in CN 2017-10251293 dated Nov. 11, 2020.
Chinese Office Action issued in CN 2017-10251390 dated Sep. 27, 2020.
Japanese Office Action issued in JP 2020-000273 dated Dec. 15, 2020.
U.S. Appl. No. 14/776,733 electronically captured on Feb. 9, 2021 (filed Jul. 10, 2020 to Feb. 9, 2021).
Chinese Office Action issued in CN 201910116150.1 dated Feb. 25, 2021.
Taiwan Office Action issued in TW 109103286 dated Mar. 31, 2021.
Chinese Office Action issued in CN 201710251390.3 dated Feb. 2, 2021.

* cited by examiner

FIG.13A
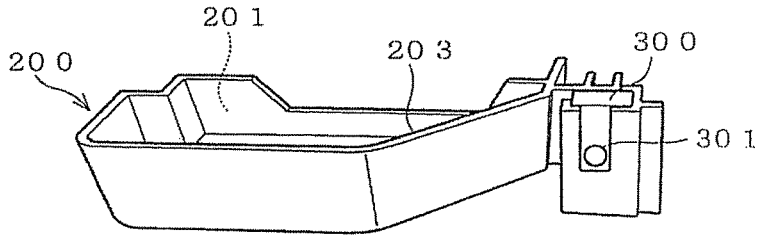
FIG.13B
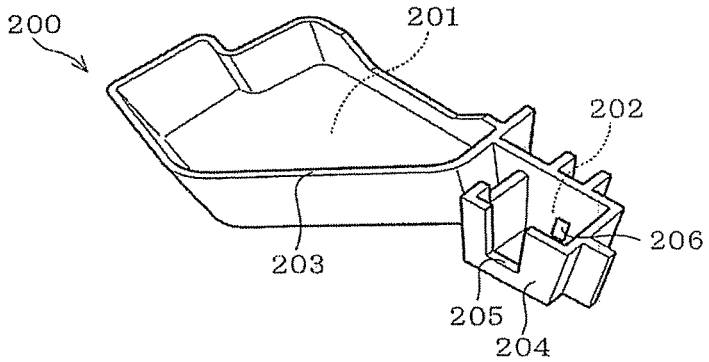
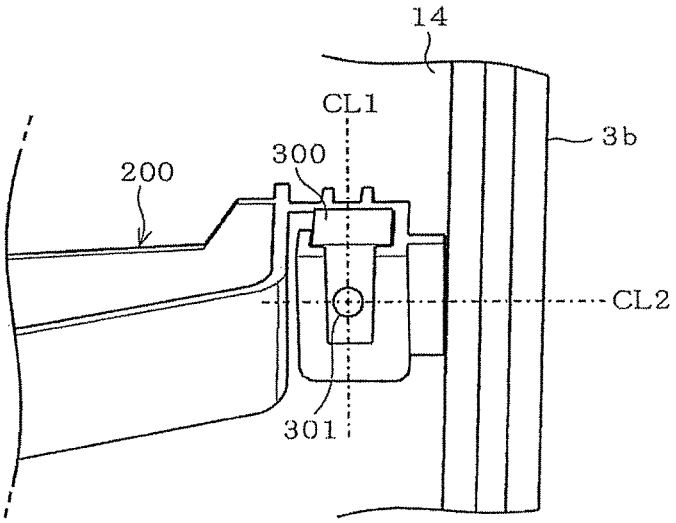
FIG.14

REFRIGERATOR AND CAMERA DEVICE

CROSS REFERENCE TO RELATED APPLICATIONS

This application is a Continuation of U.S. application Ser. No. 14/776,729 filed Sep. 14, 2015, which is a U.S. National Stage Application of International Application No. PCT/JP2014/056326 filed Mar. 11, 2014, which claims priority from Japanese Patent Application No. 2013-049073 filed Mar. 12, 2013, Japanese Patent Application No. 2013-147562 filed Jul. 16, 2013, Japanese Patent Application No. 2013-225439 filed Oct. 30, 2013 and Japanese Patent Application No. 2014-038460 filed Feb. 28, 2014. The entirety of all the above-listed applications are incorporated herein by reference.

TECHNICAL FIELD

Embodiments of the present invention relates to a refrigerator and a camera device.

BACKGROUND

Systems configured to manage food by capturing images of food stored in a refrigerator have been proposed (See for example, patent document 1).

However, some users wish to check the status inside the refrigerator from a remote location.

PRIOR ART DOCUMENTS

Patent Document

Patent Document 1: JP 2012-226748 A

SUMMARY OF THE INVENTION

Problems to be Overcome by the Invention

The problem to be overcome by the present invention is providing a refrigerator and a camera device allowing the interior of the refrigerator to be checked with ease from a remote location.

Means for Overcoming the Problems

A refrigerator of one embodiment is provided with an image capturing unit configured to capture an image of an interior of the refrigerator; and a communication unit configured to transmit image information of the interior of the refrigerator captured by the image capturing unit to an exterior device. The image capturing unit is stored in a recess provided in the interior of the refrigerator.

A camera device of one embodiment is provided with an image capturing unit configured to capture an image of an interior of a refrigerator; and a camera-side communication unit configured to communicate with an external device.

BRIEF DESCRIPTIONS OF THE DRAWINGS

FIG. 1 briefly illustrates a home appliance network system employing a refrigerator of a first embodiment.

FIG. 2 schematically illustrates the refrigerator of the first embodiment.

FIG. 3 schematically illustrates how an image capturing camera of the first embodiment is attached.

FIG. 4 schematically illustrates the structure of the refrigerator of the first embodiment.

FIG. 5 schematically illustrates the status inside the refrigerator of the first embodiment.

FIG. 6 indicates the process flow of an image capturing process executed by the refrigerator of the first embodiment.

FIG. 7 illustrates one example of an image captured by the image capturing camera of the first embodiment.

FIGS. 8A-8C schematically illustrate change in the status of dew condensate on the image capturing camera of the first embodiment.

FIG. 9 illustrates the sequence of image capturing carried out by the image capturing camera of the first embodiment.

FIG. 10 indicates the process flow a terminal-side process carried out by a communication terminal of the first embodiment.

FIGS. 13A-13B schematically illustrate a camera device mounted on a refrigerator door pocket of a second embodiment.

FIG. 14 schematically illustrates the refrigerator door pocket of the second embodiment attached to a refrigerator.

Figure 15:
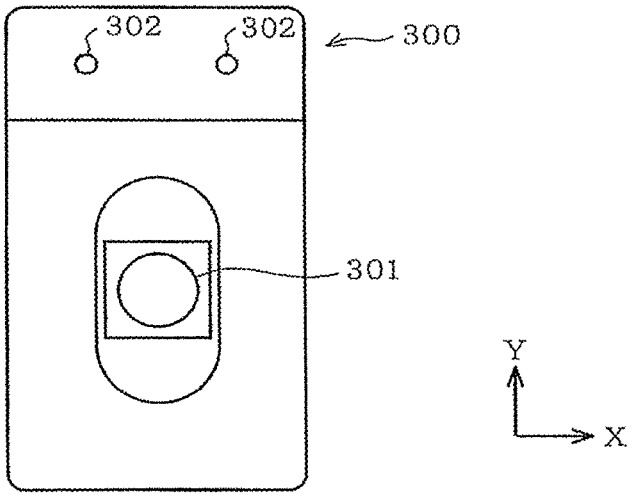

FIG. 15 schematically illustrates an exterior look of the camera device of the second embodiment.

Figure 16:
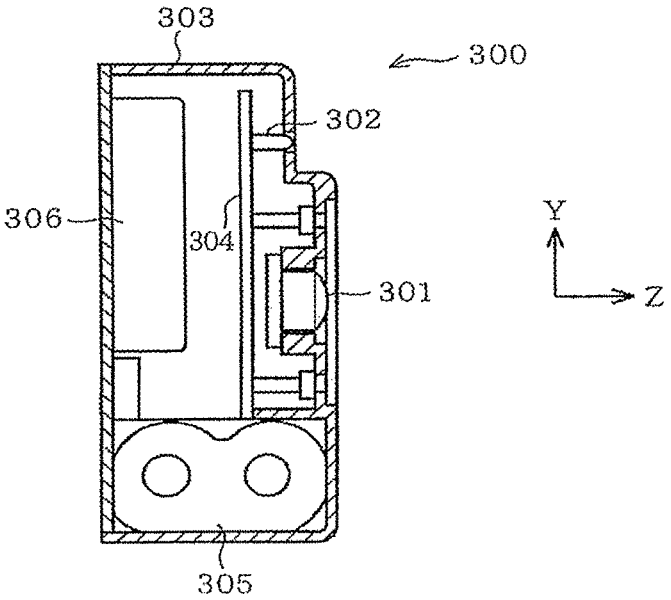

FIG. 16 schematically illustrates an exterior look of the camera device of the second embodiment and the layout of parts provided therein.

Figure 17:
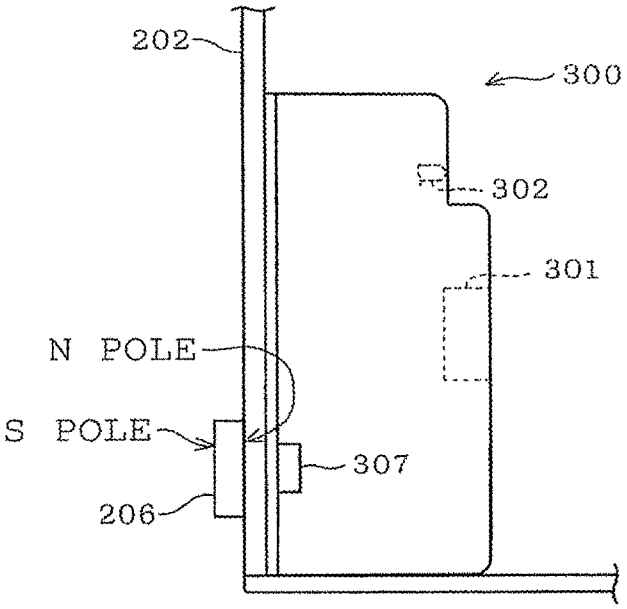

FIG. 17 schematically illustrates the camera device of the second embodiment being attached to the refrigerator door pocket.

Figure 18:
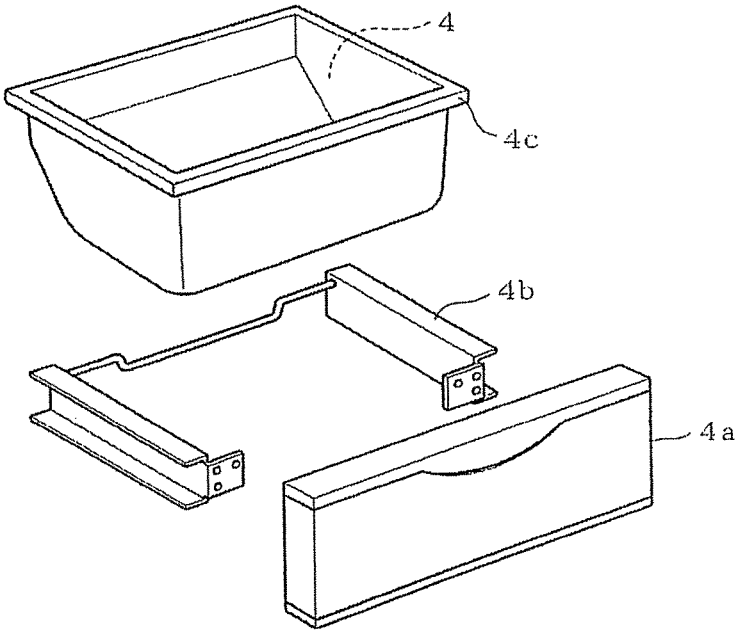

FIG. 18 schematically illustrates the location in which a refrigerator holder of the second embodiment is attached.

Figure 19A:
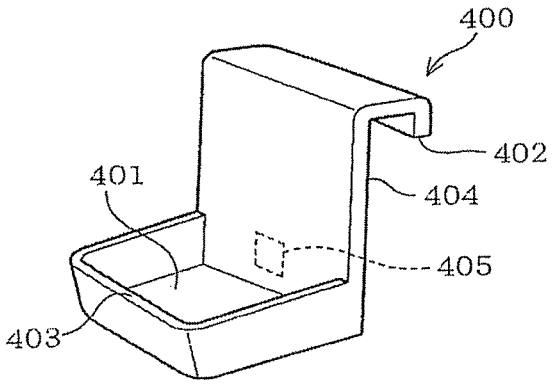
Figure 19B:
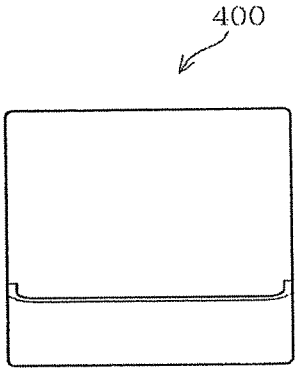

FIGS. 19A-19B schematically illustrate the refrigerator holder of the second embodiment.

Figure 20:
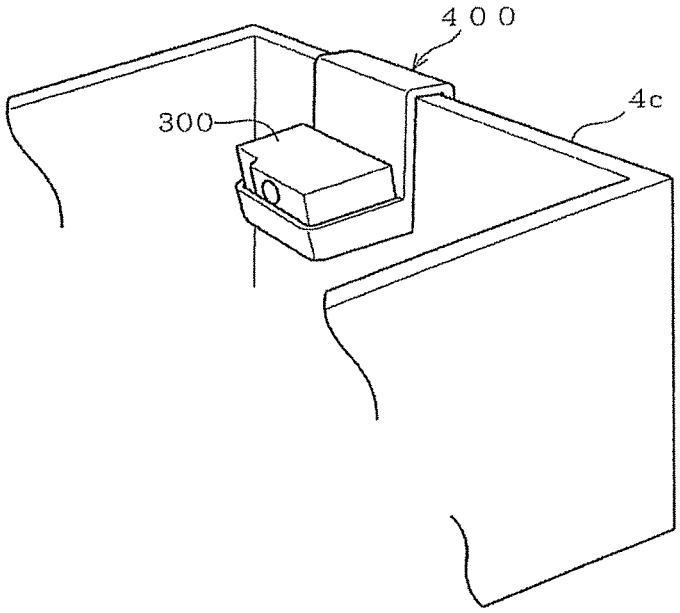

FIG. 20 schematically illustrates the refrigerator holder of the second embodiment being attached.

Figure 21:
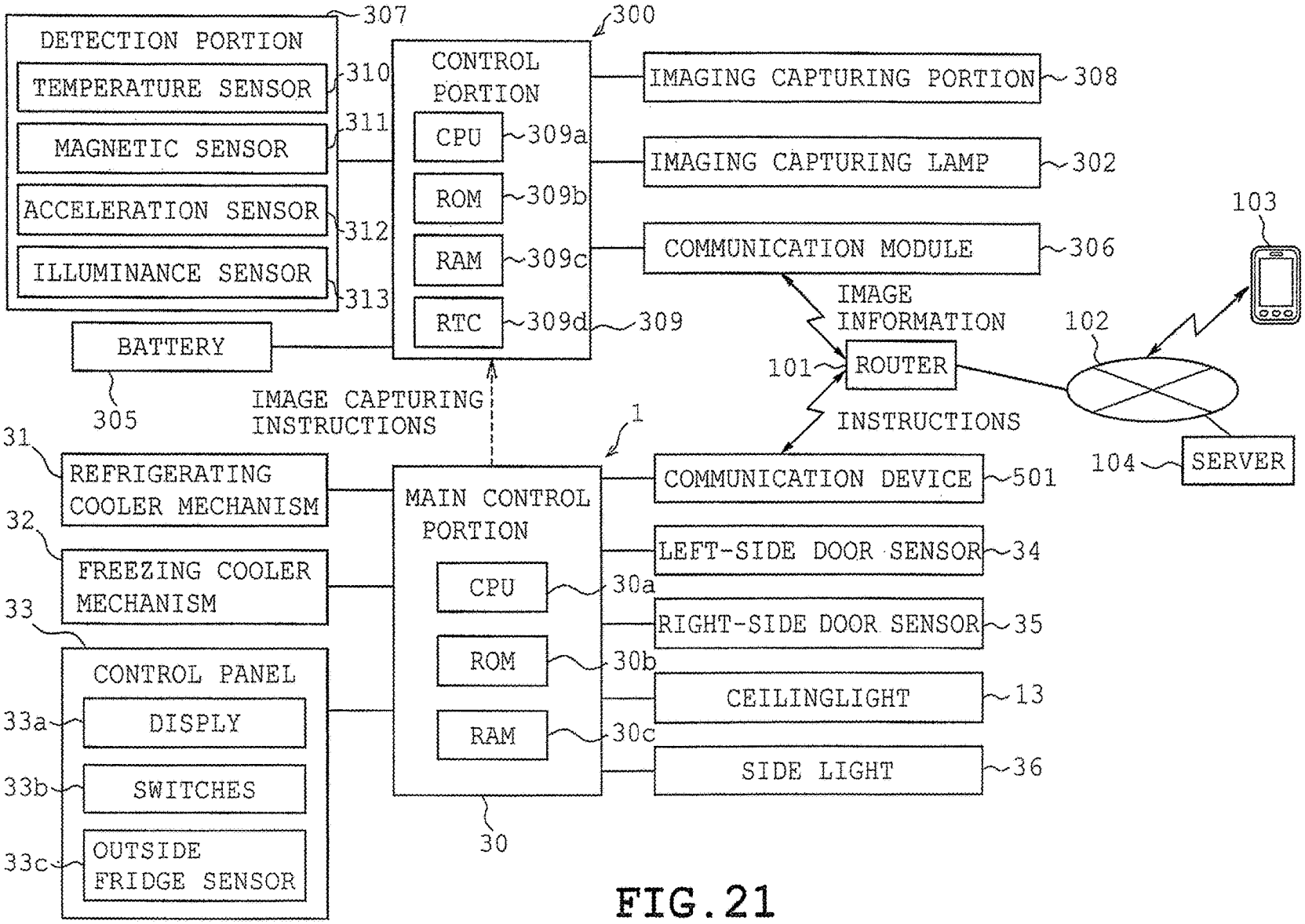

FIG. 21 schematically illustrates an electrical configuration of the camera device of the second embodiment.

Figure 22A:
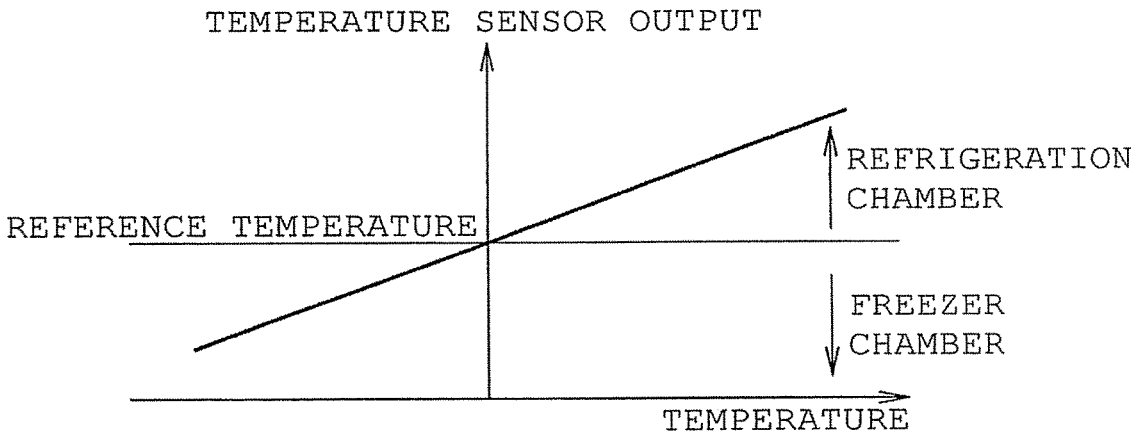
Figure 22B:
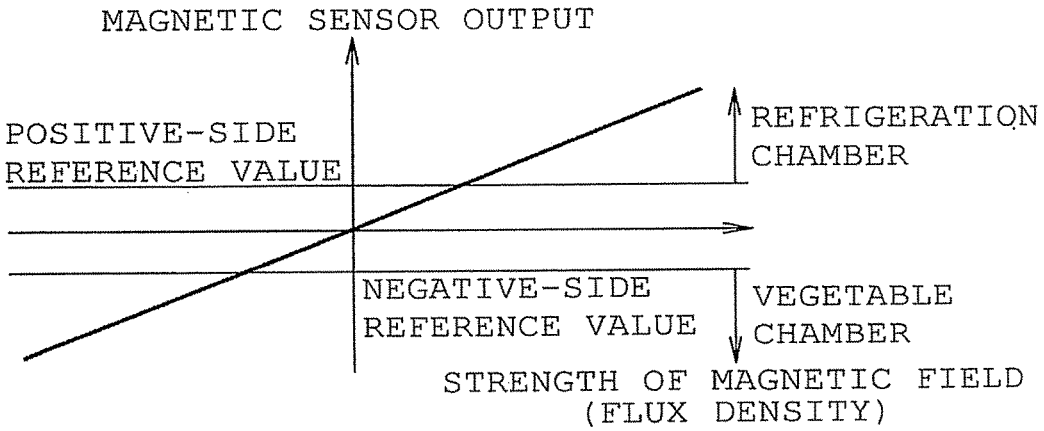
Figure 22C:
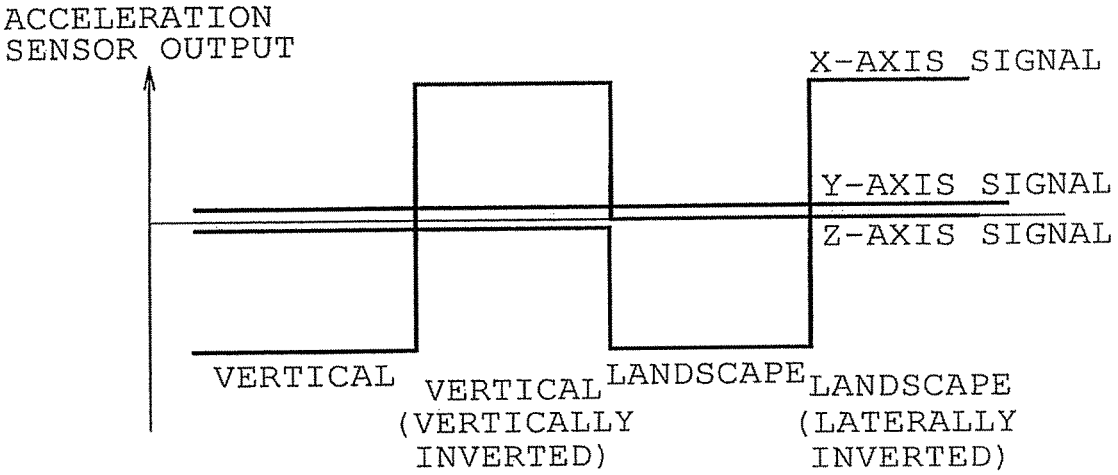

FIGS. 22A-22C schematically illustrate how detection is performed by a detection portion of the camera device of the second embodiment.

Figure 23:
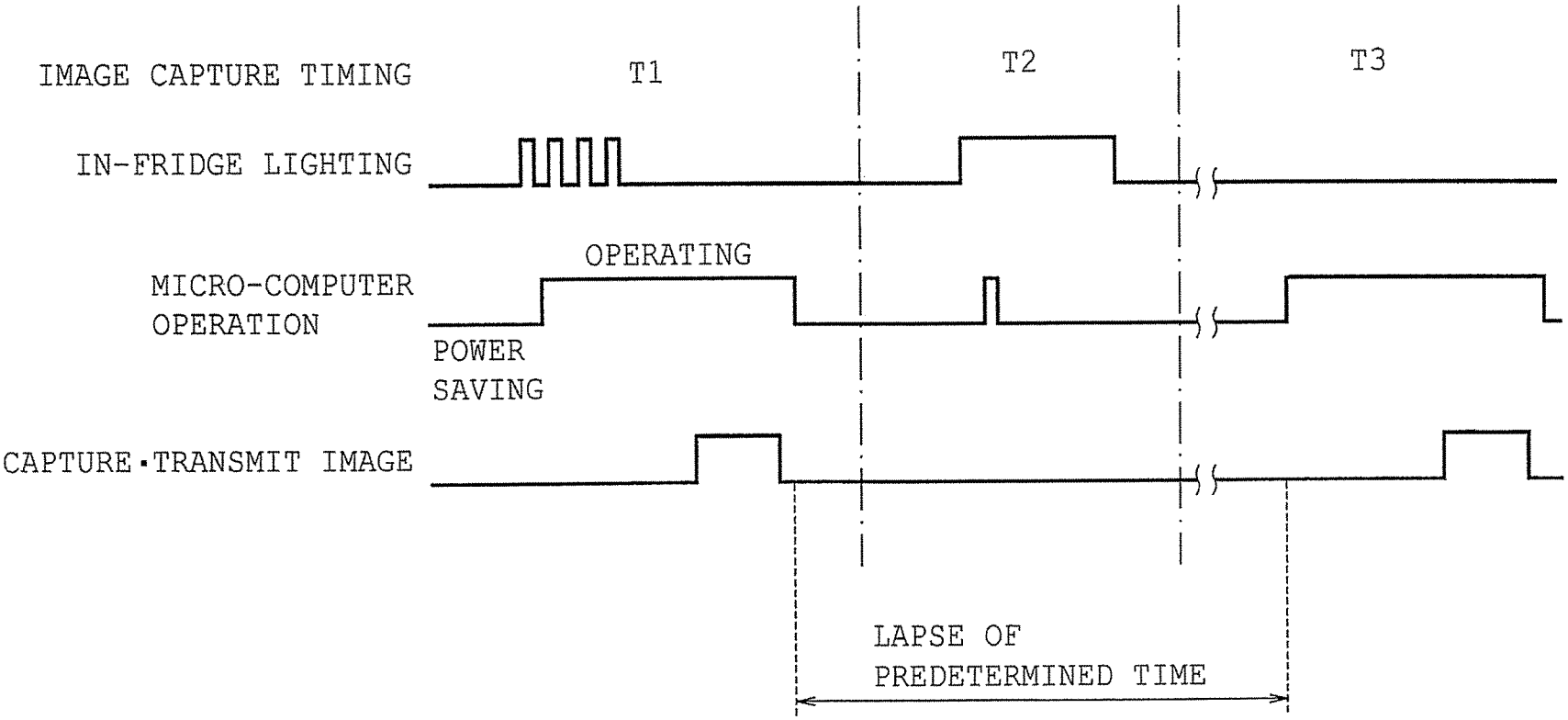

FIG. 23 illustrates an example of a timing of image capturing by the camera device of the second embodiment.

Figure 24C:
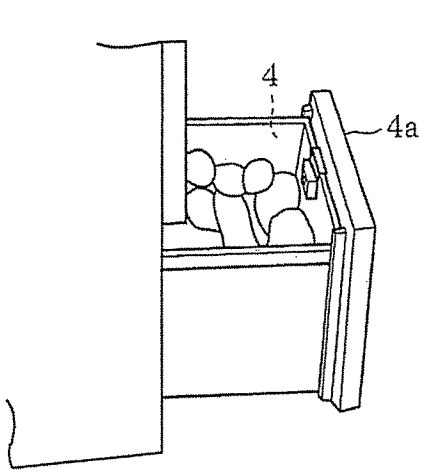
Figure 24C:
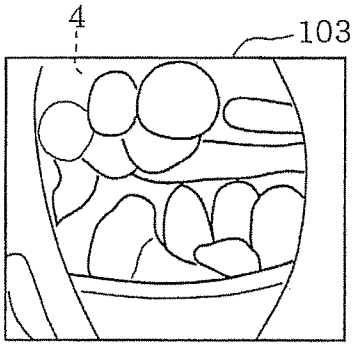
Figure 24B:
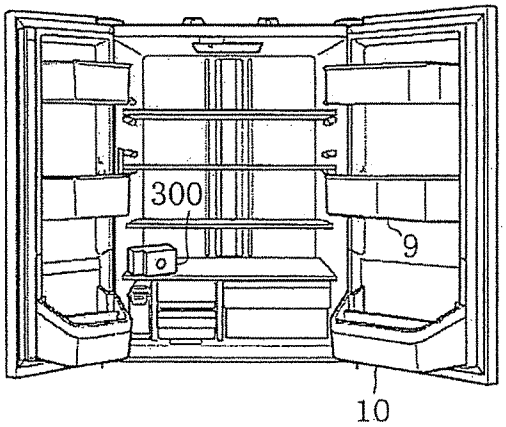
Figure 24B:
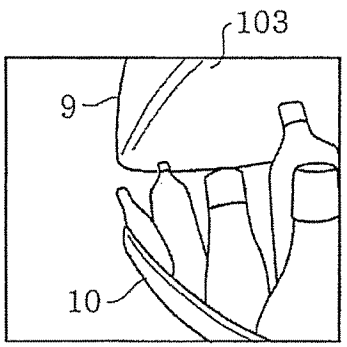
Figure 24A:
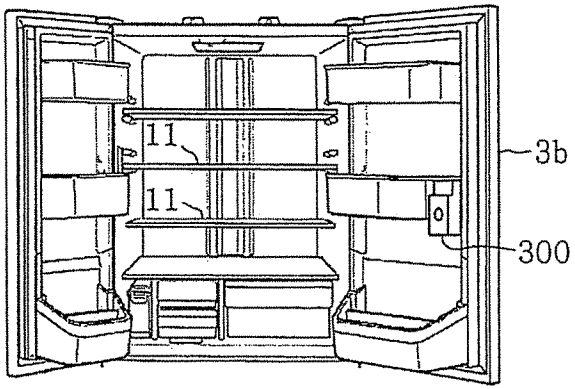
Figure 24A:
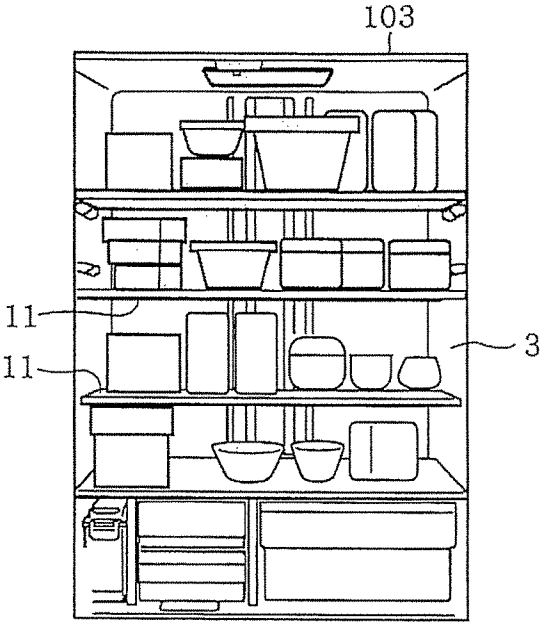

FIGS. 24A-24C illustrate an example of an image of a fridge interior captured by the camera device of the second embodiment.

Figure 25:
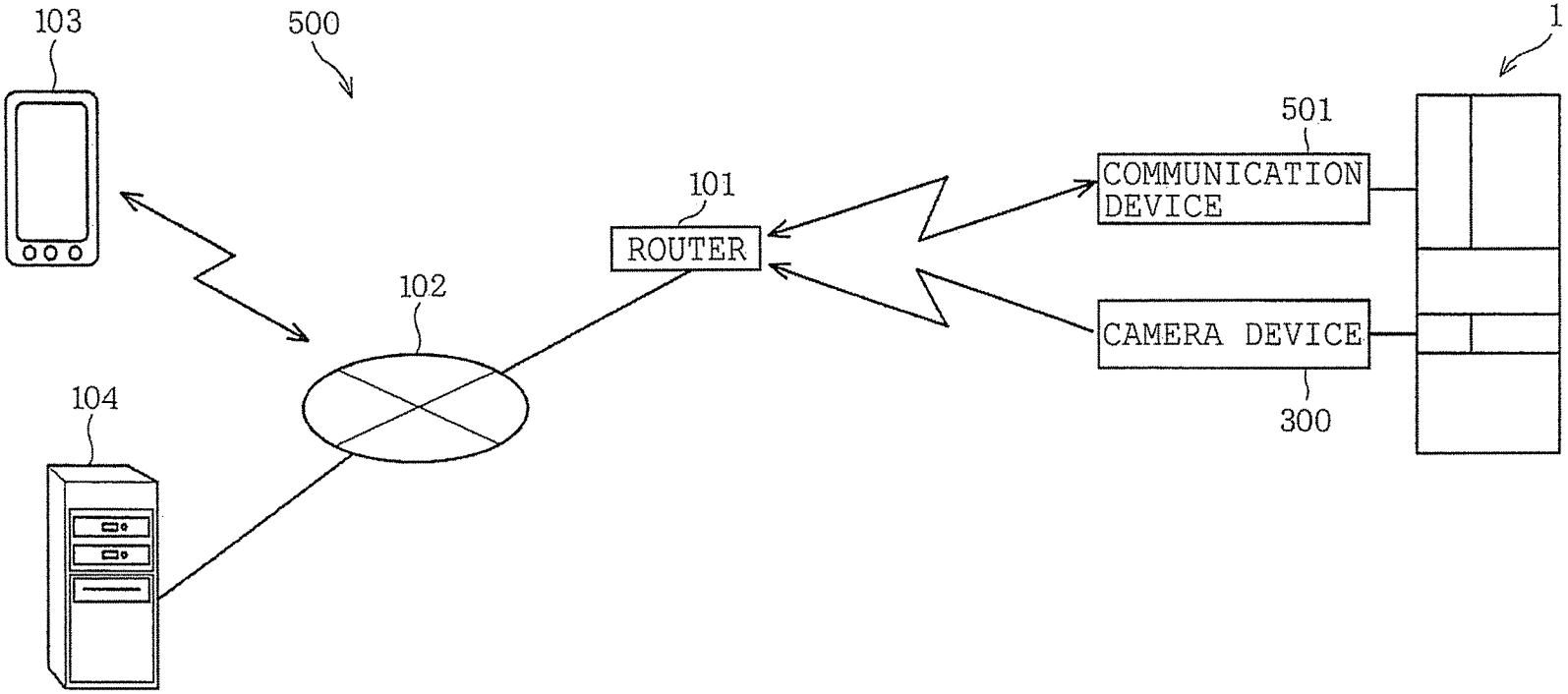

FIG. 25 provides an overview of a home appliance network system of the second embodiment.

Figure 26:
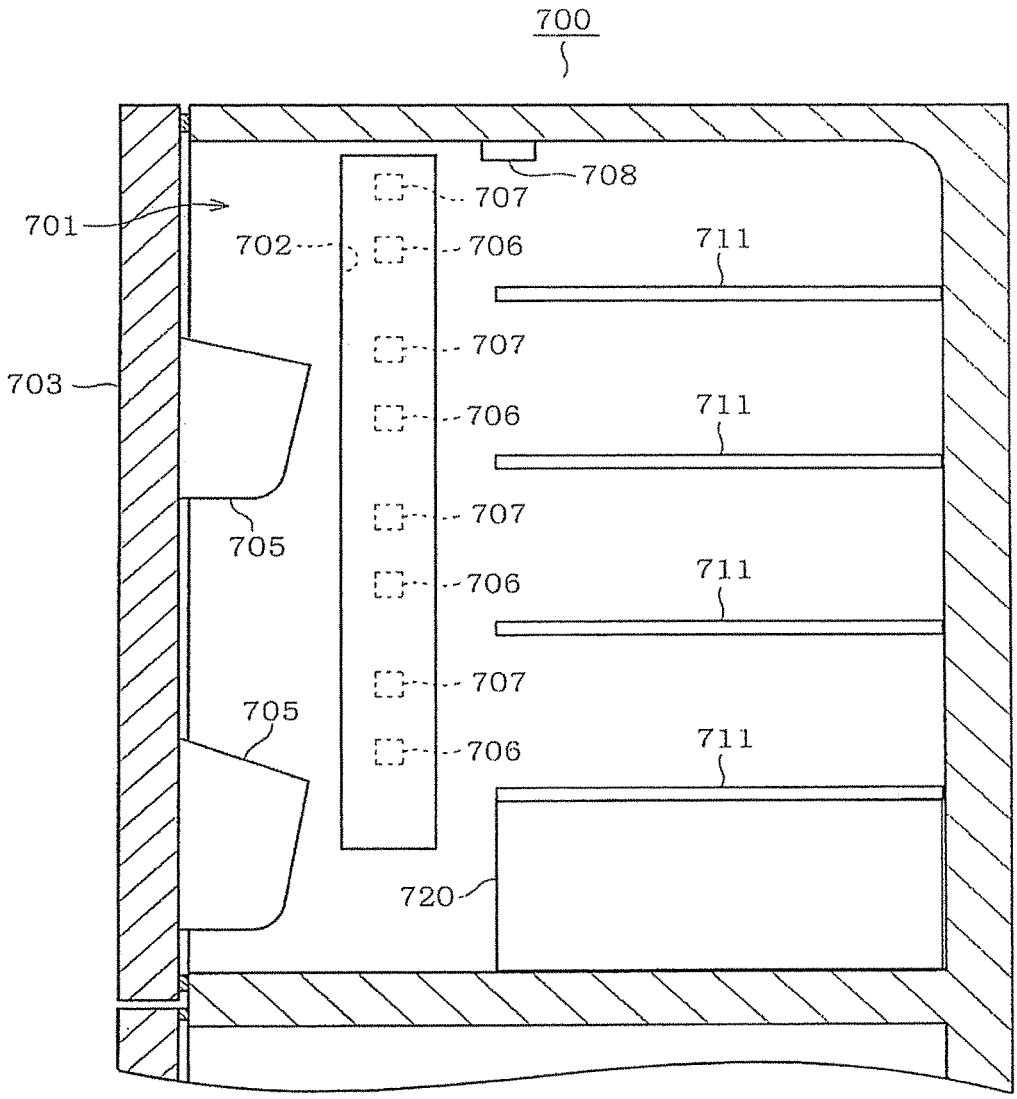

FIG. 26 is a side view illustrating an example of a structure inside a storage chamber of the refrigerator of a third embodiment (part 1).

Figure 27:
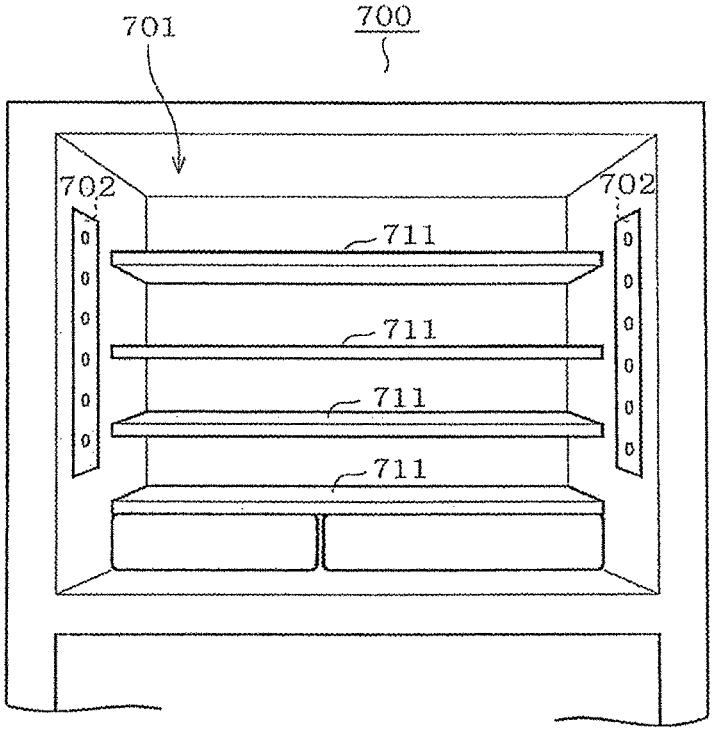

FIG. 27 is a front view illustrating an example of a structure inside a storage chamber of the refrigerator of the third embodiment (part 1).

Figure 28:
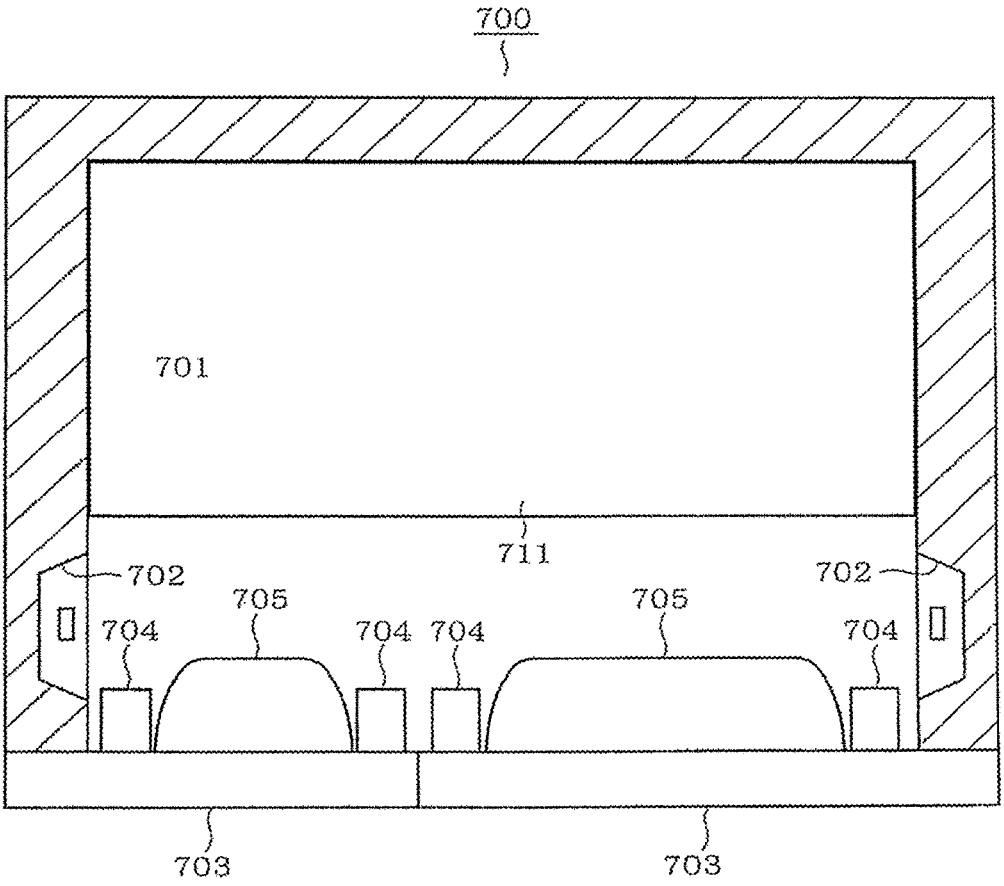

FIG. 28 is a plan view illustrating an example of a structure inside a storage chamber of the refrigerator of the third embodiment (part 1).

Figure 29:
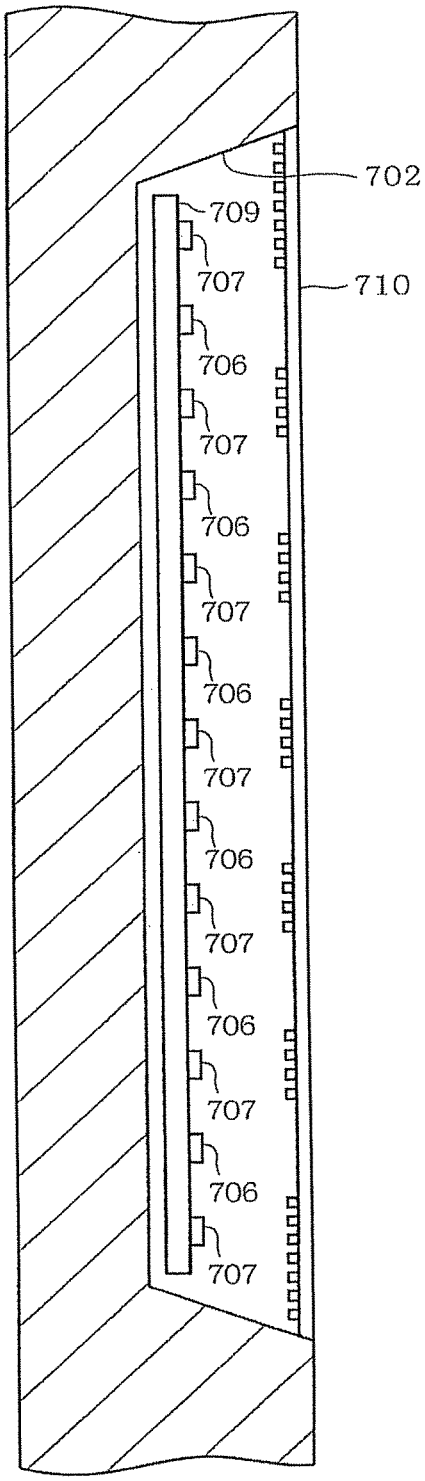

FIG. 29 is a vertical cross-sectional view illustrating an example of a structure inside a recess of the third embodiment.

Figure 30:
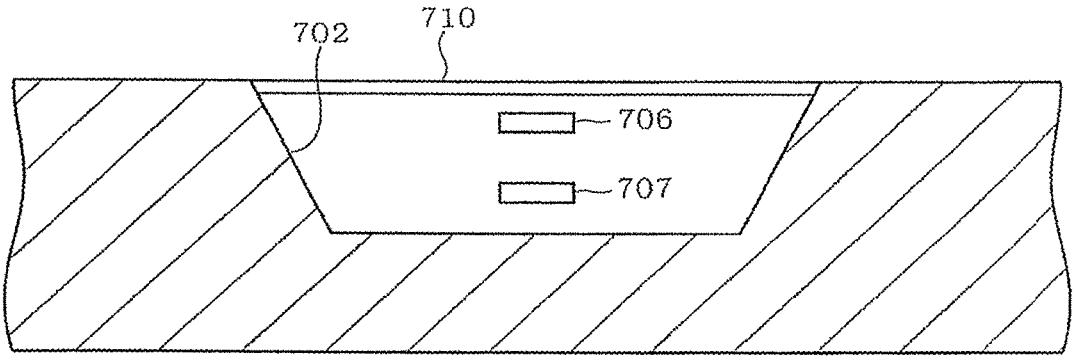

FIG. 30 is a transverse cross-sectional view illustrating an example of a structure inside the recess of the third embodiment (part 1).

Figure 31:
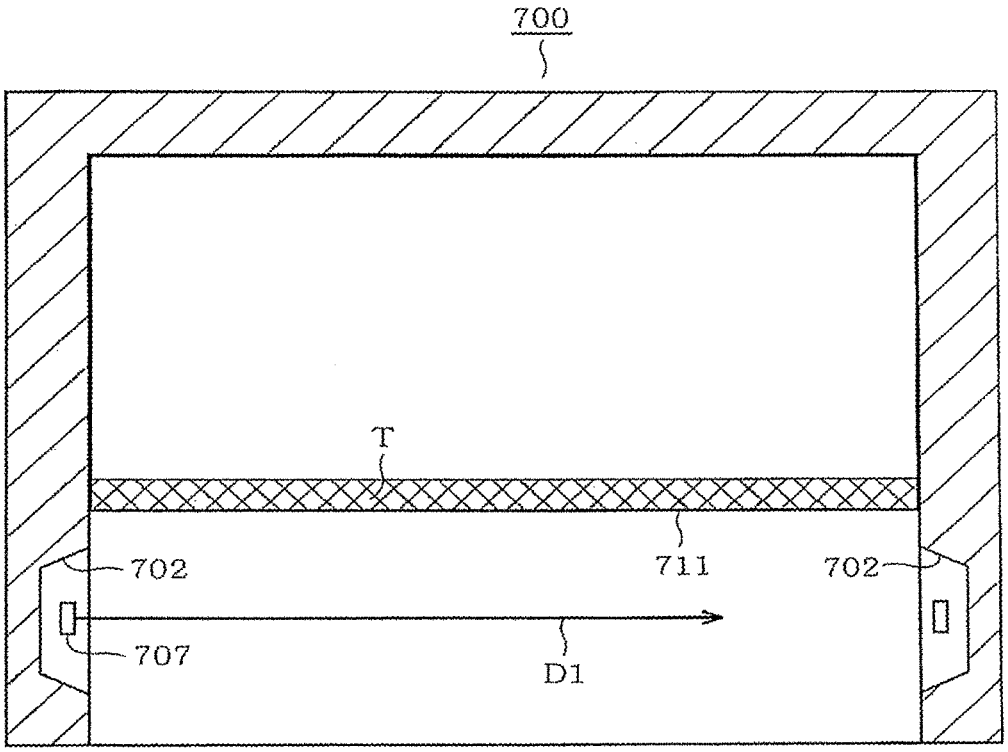

FIG. 31 is a plan view illustrating an example of a structure inside a storage chamber of the refrigerator of the third embodiment (part 2)

Figure 32:
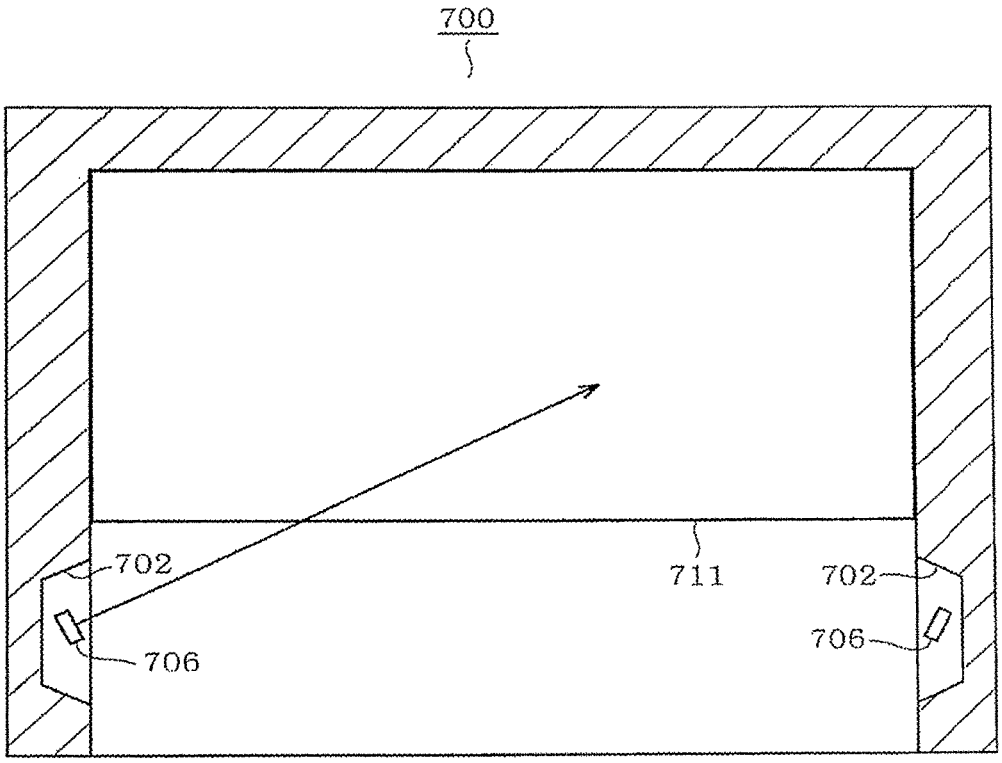

FIG. 32 is a plan view illustrating an example of a structure inside a storage chamber of the refrigerator of the third embodiment (part 3)

Figure 33:
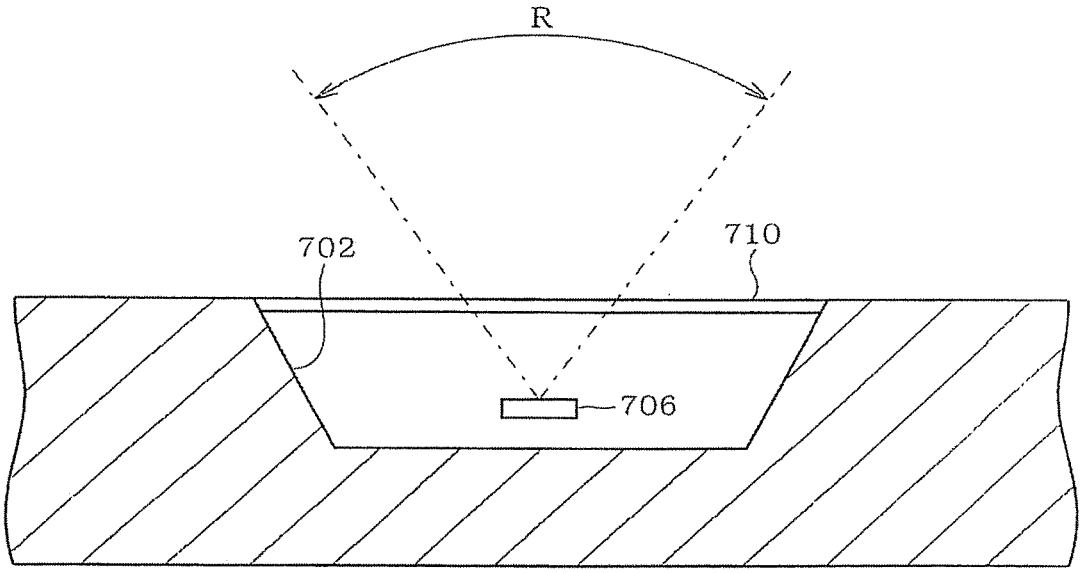

FIG. 33 is a transverse cross-sectional view illustrating an example of a structure inside the recess of the third embodiment (part 2).

Figure 34:
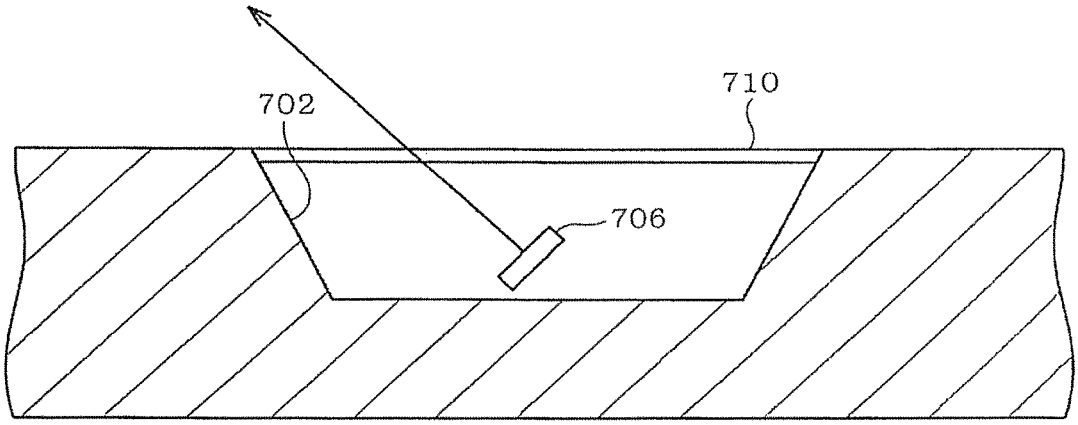

FIG. 34 is a transverse cross-sectional view illustrating an example of a structure inside the recess of the third embodiment (part 3).

Figure 35:
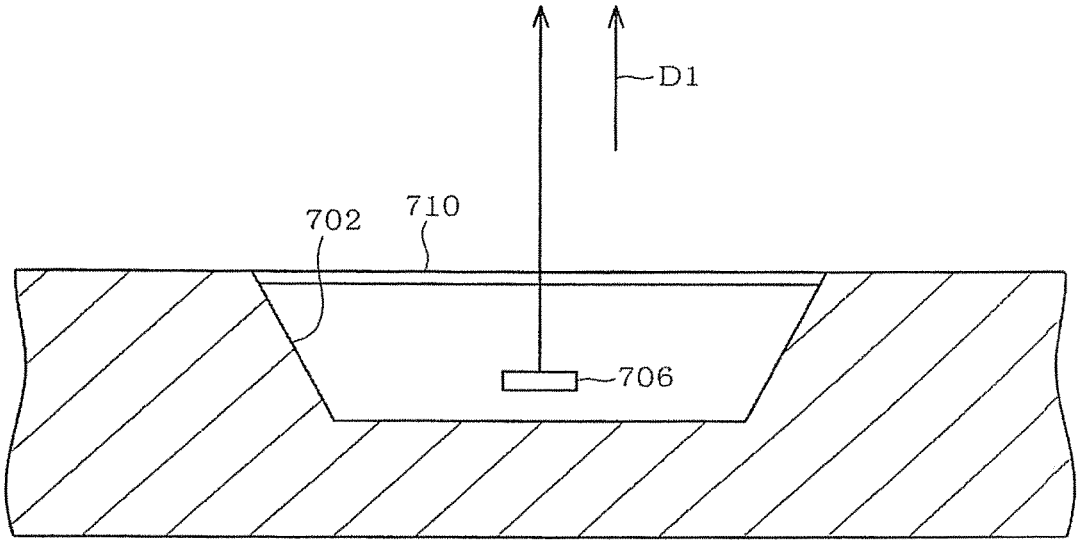

FIG. 35 is a transverse cross-sectional view illustrating an example of a structure inside the recess of the third embodiment (part 4).

Figure 36:
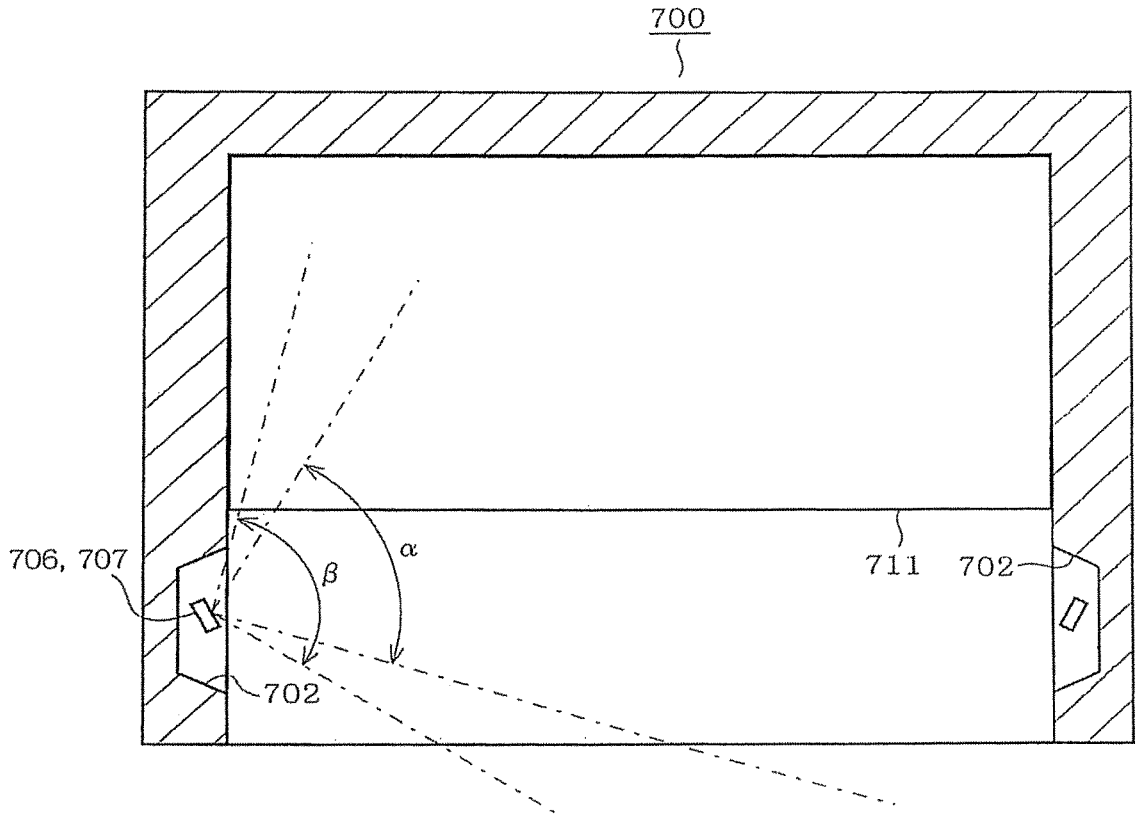

FIG. 36 is a plan view illustrating an example of a structure inside a storage chamber of the refrigerator of the third embodiment (part 4).

Figure 37:
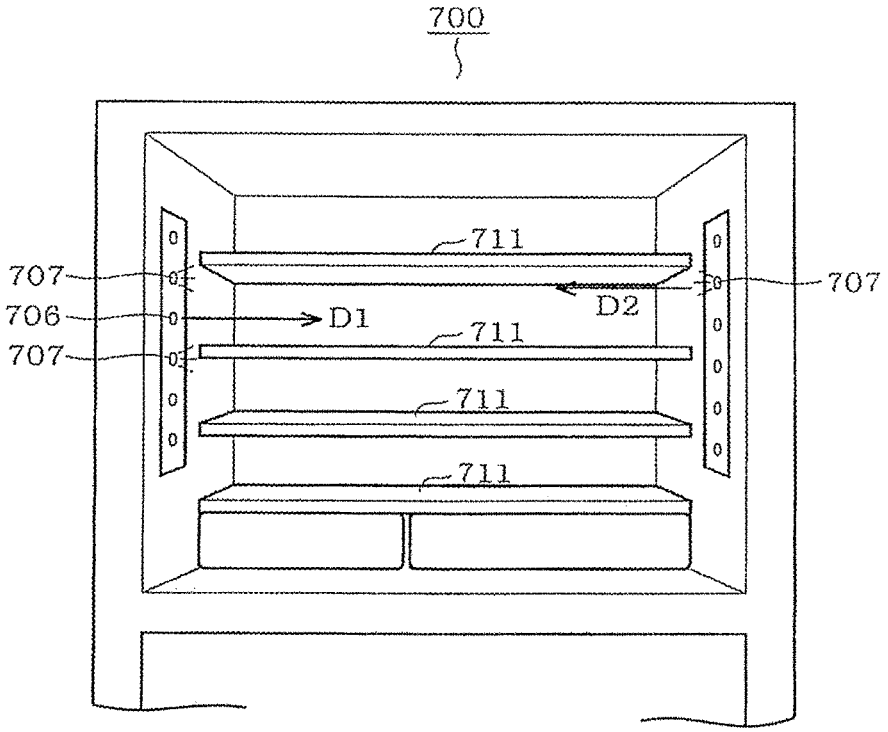

FIG. 37 is a front view illustrating an example of a structure inside a storage chamber of refrigerator of the third embodiment (part 2).

Figure 38:
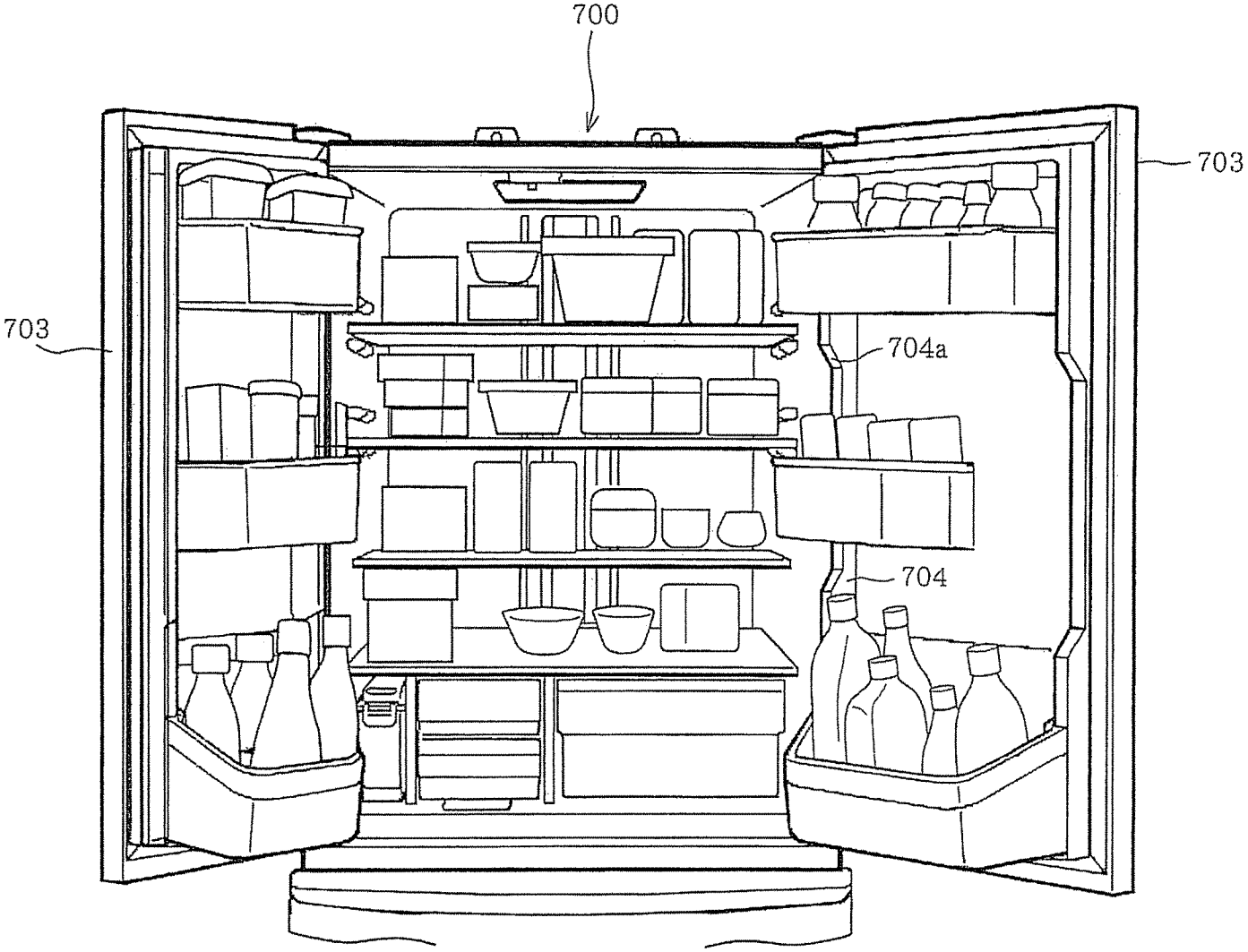

FIG. 38 illustrates an example of a structure of a door of the refrigerator of the third embodiment.

Figure 39:
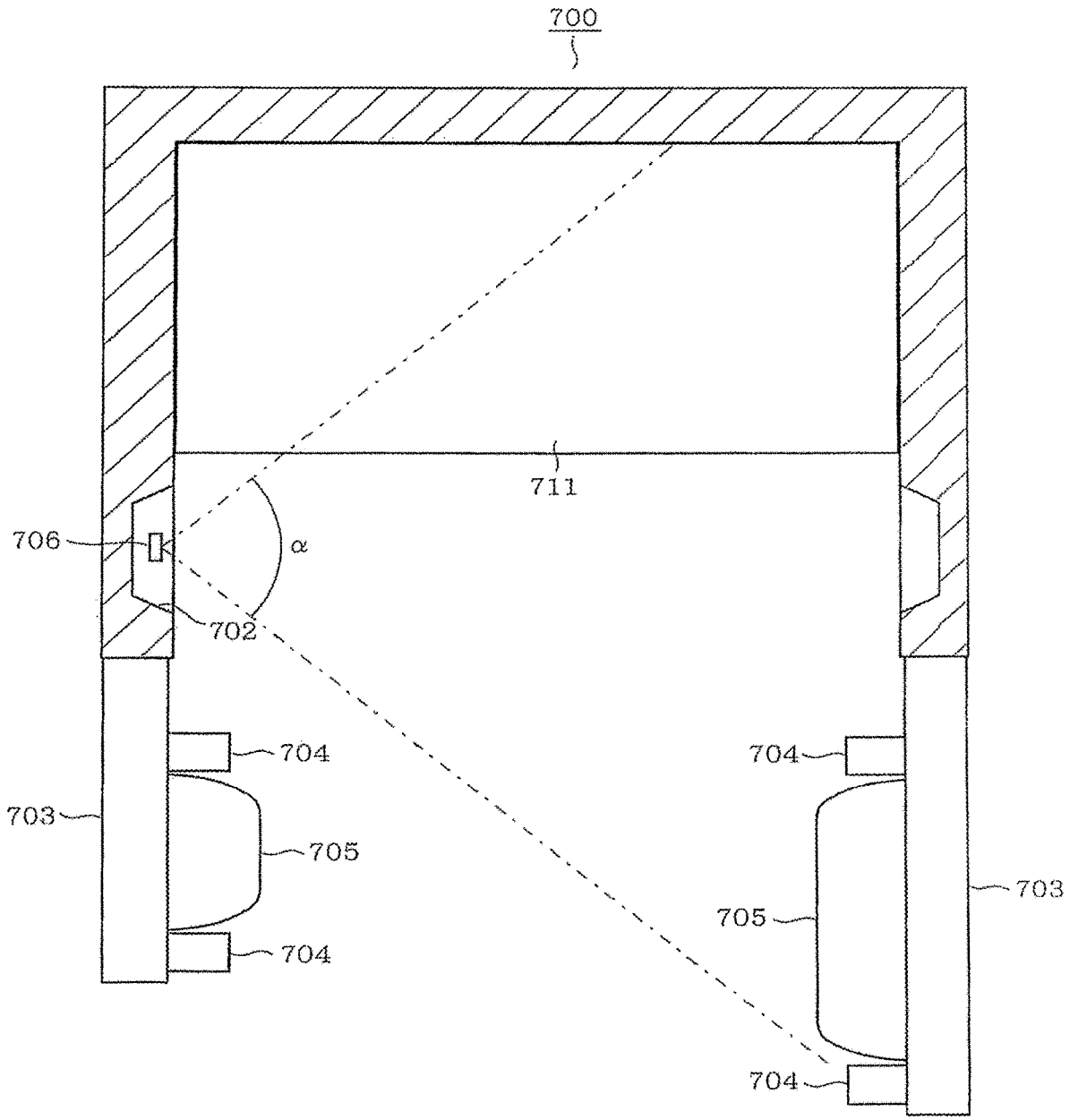

FIG. 39 is a plan view illustrating an example of a structure inside a storage chamber of the refrigerator of the third embodiment (part 5).

Figure 40:
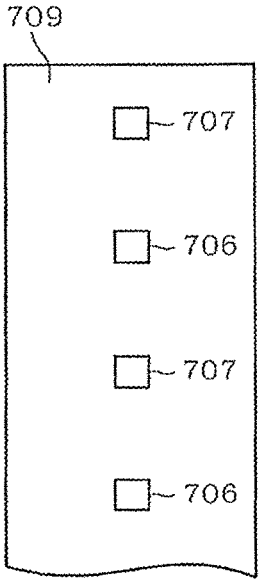

FIG. 40 illustrates an example of a layout of an image capturing camera and lighting LED of the third embodiment (part 1).

Figure 41:
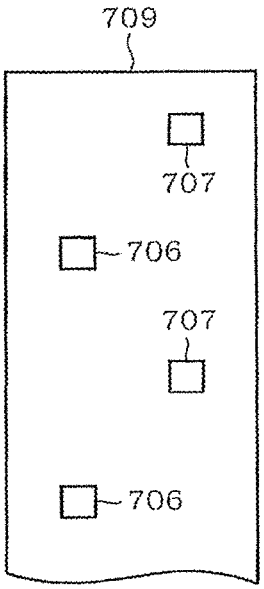

FIG. 41 illustrates an example of a layout of an image capturing camera and lighting LED of the third embodiment (part 2).

Figure 42:
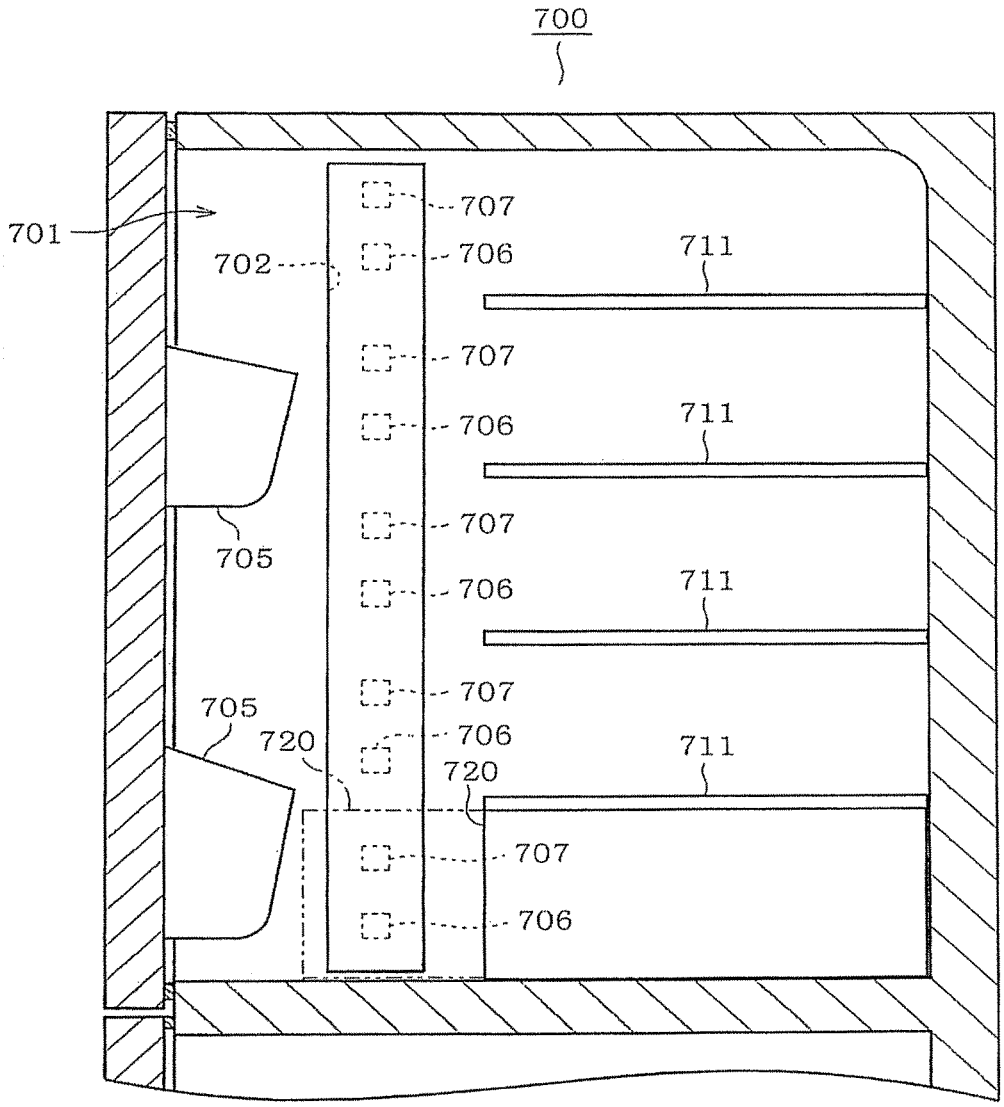

FIG. 42 is a side view illustrating an example of a structure inside a storage chamber of the refrigerator of the third embodiment (part 2).

Figure 43:
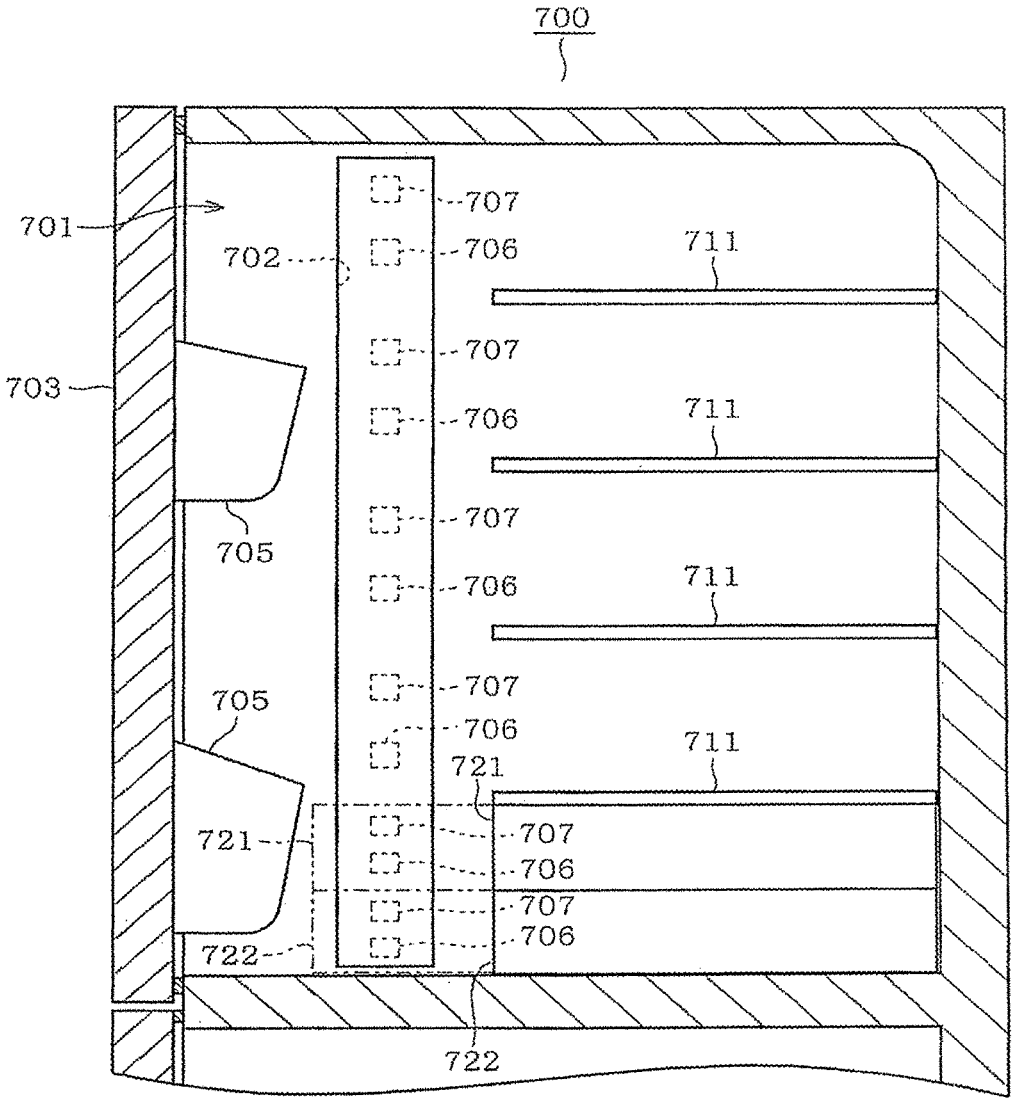

FIG. 43 is a side view illustrating an example of a structure inside a storage chamber of the refrigerator of the third embodiment (part 3)

Figure 44:
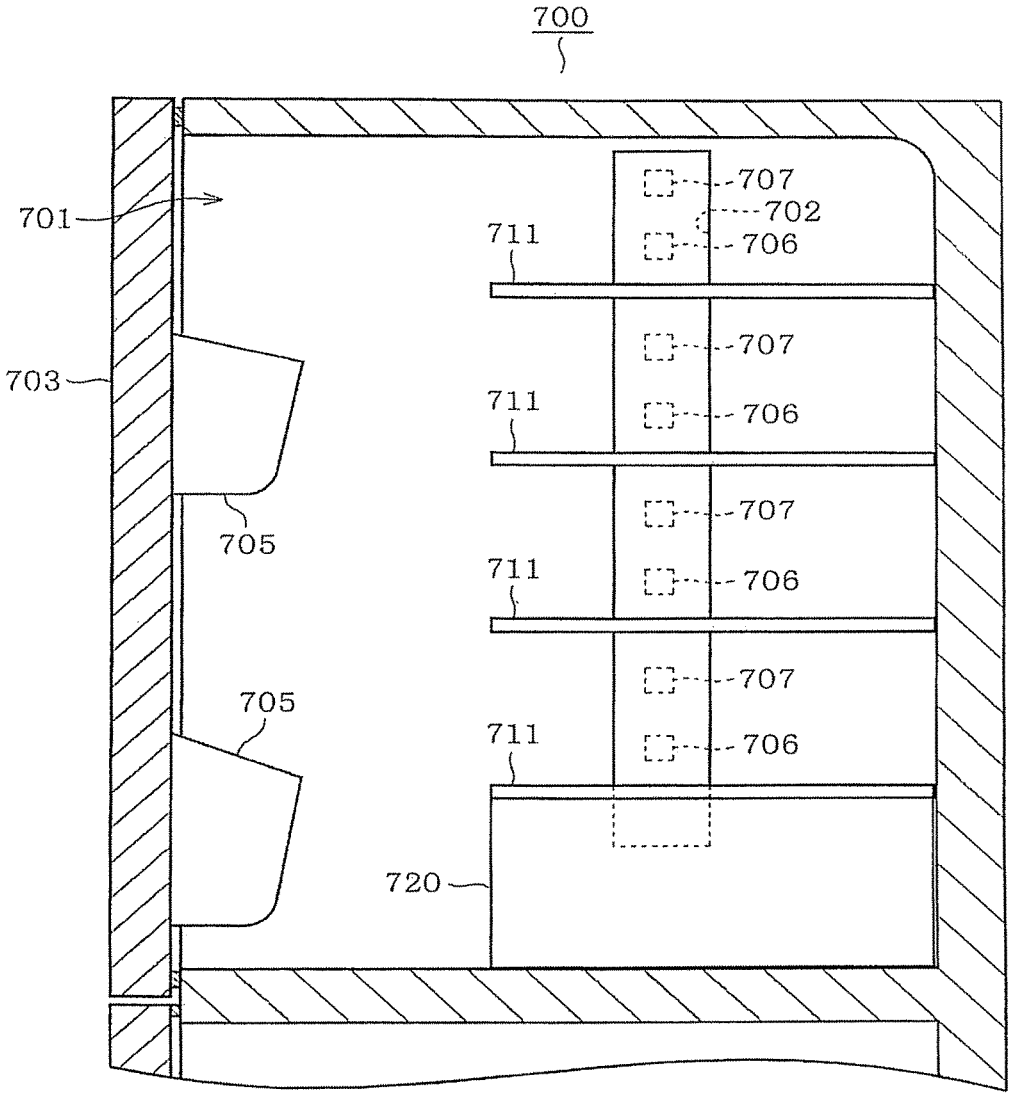

FIG. 44 is a side view illustrating an example of a structure inside a storage chamber of the refrigerator of the third embodiment (part 4)

Figure 45:
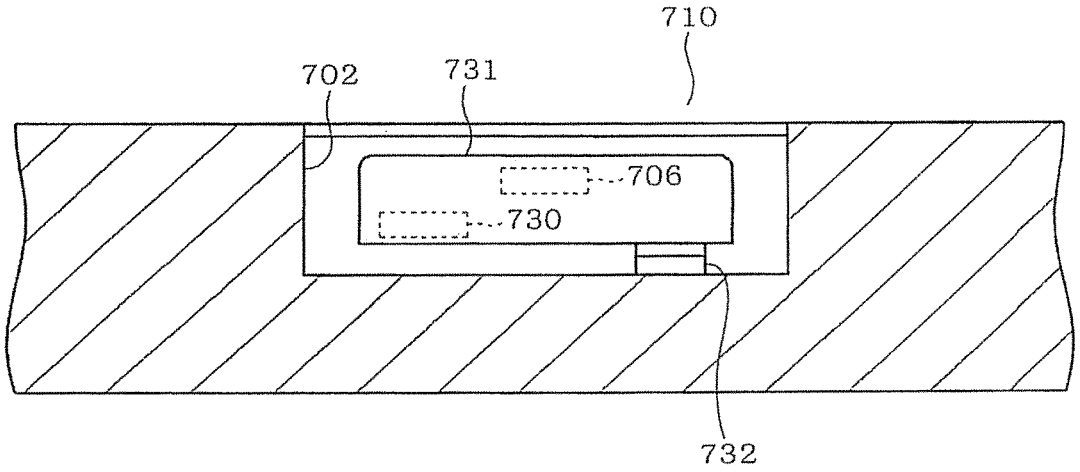

FIG. 45 is a transverse cross-sectional view illustrating an example of a structure inside the recess of the third embodiment (part 5).

Figure 46:
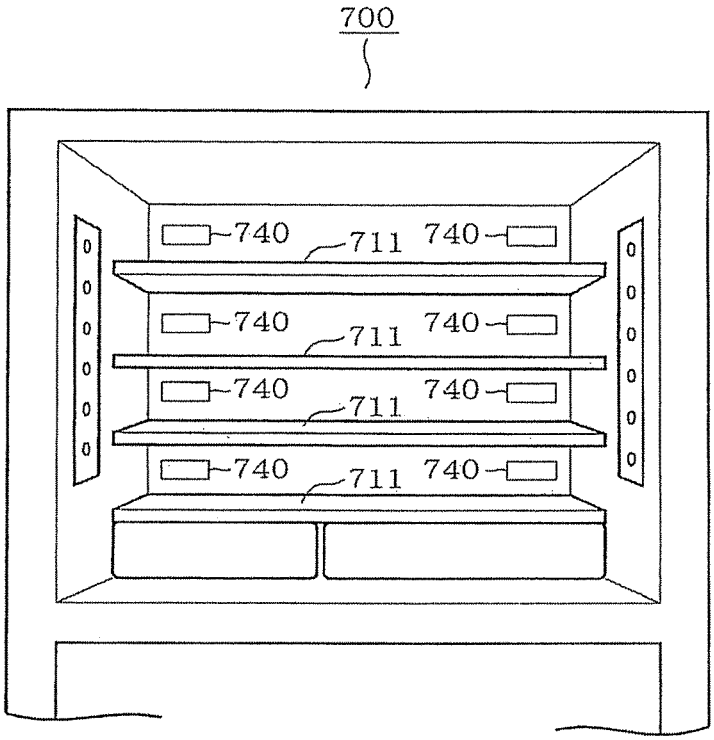

FIG. 46 is a front view illustrating an example of a structure inside a storage chamber of refrigerator of the third embodiment (part 3).

Figure 47:
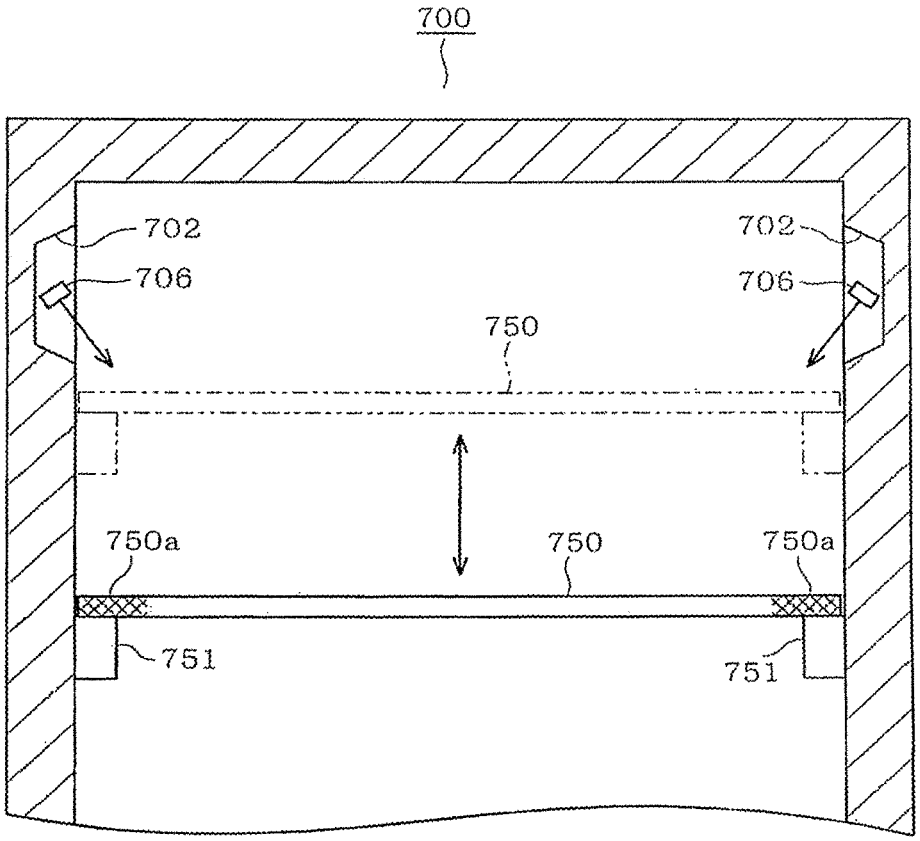

FIG. 47 is a front view illustrating an example of a structure inside a storage chamber of refrigerator of the third embodiment (part 4).

Figure 48:
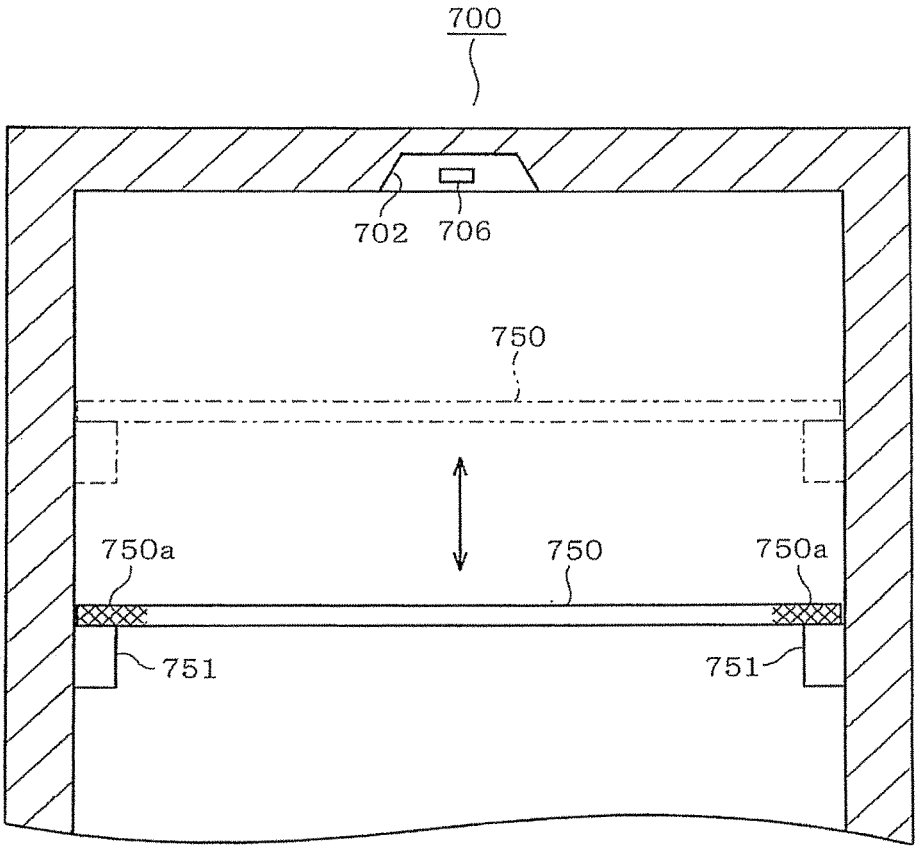

FIG. 48 is a front view illustrating an example of a structure inside a storage chamber of refrigerator of the third embodiment (part 5).

Figure 49A:
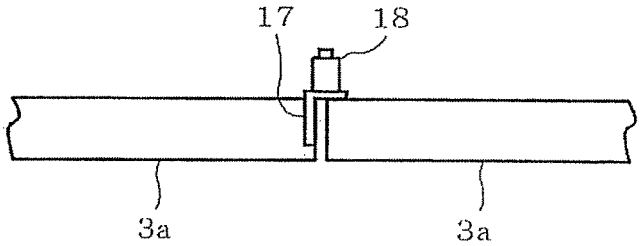
Figure 49B:
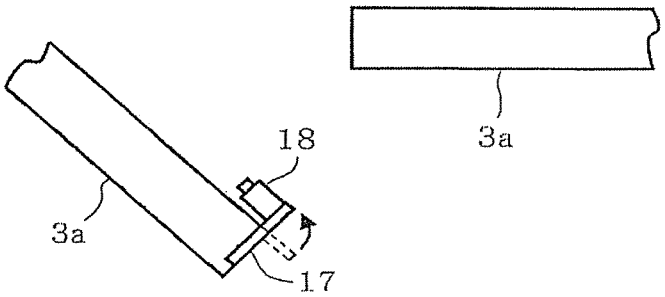

FIGS. 49A-49B schematically illustrate how a camera device of a modified embodiment is attached.

Figure 50:
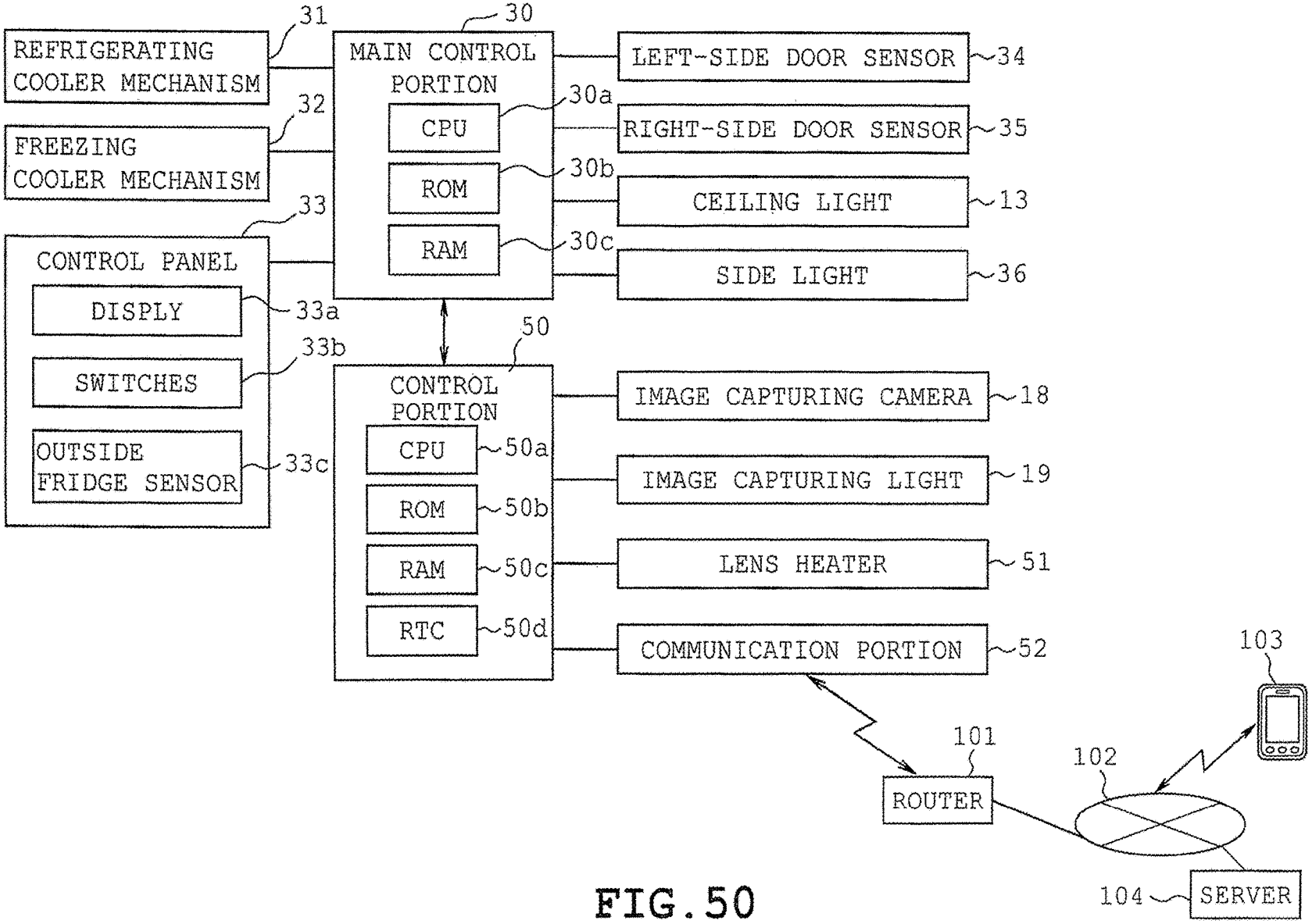

FIG. 50 schematically illustrates a structure of a refrigerator of a modified embodiment.

Figure 51:
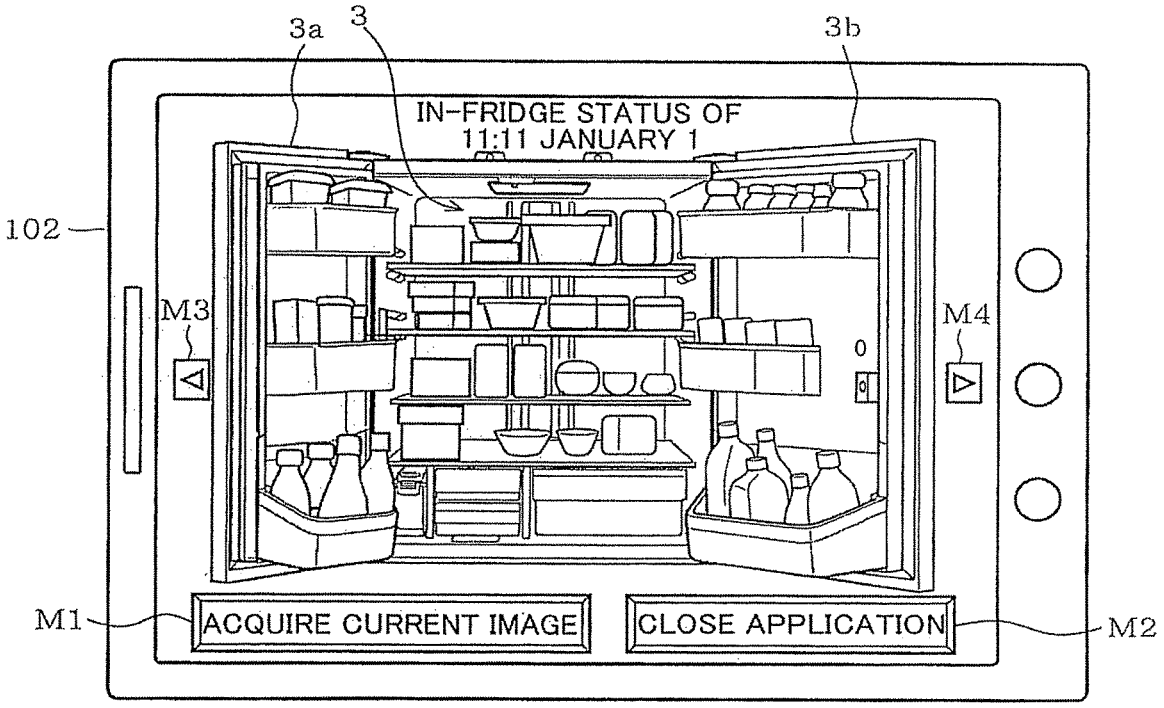

FIG. 51 illustrates one example of how image is displayed on a communication terminal of a modified embodiment.

Figure 52A:
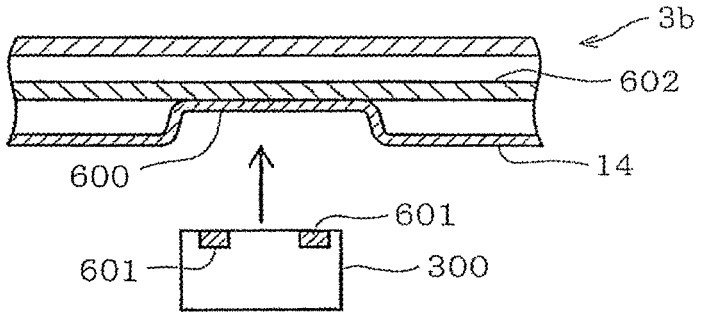
Figure 52B:
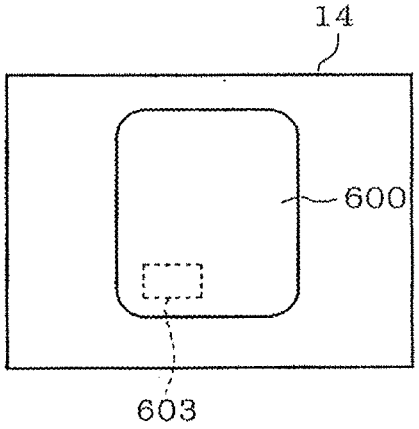

FIGS. 52A-52B illustrate one example of a mounting portion of a modified embodiment.

Figure 53:
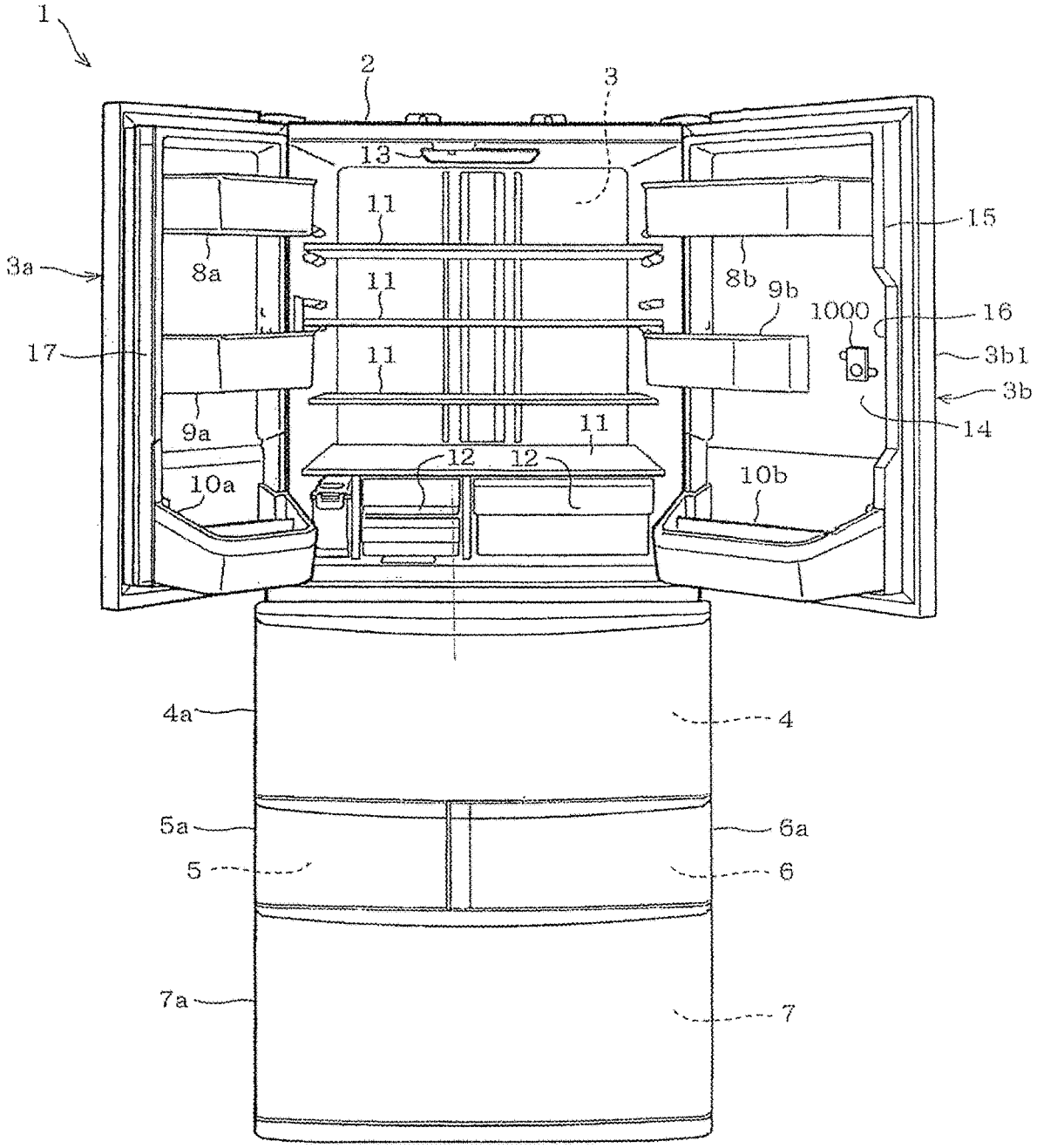

FIG. 53 schematically illustrates a refrigerator of a fourth embodiment.

Figure 54A:
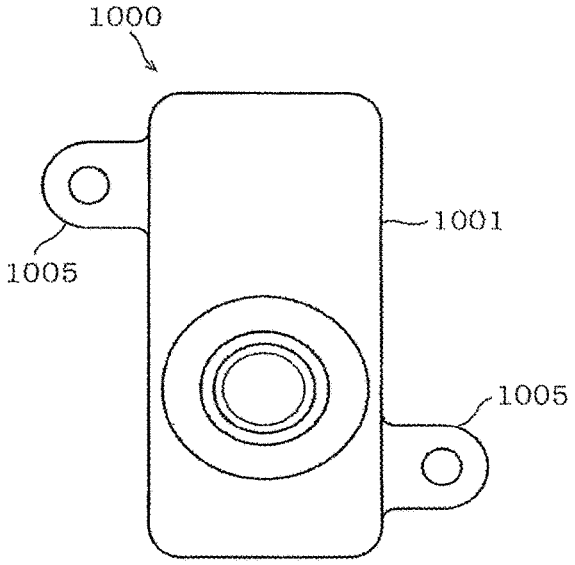
Figure 54B:
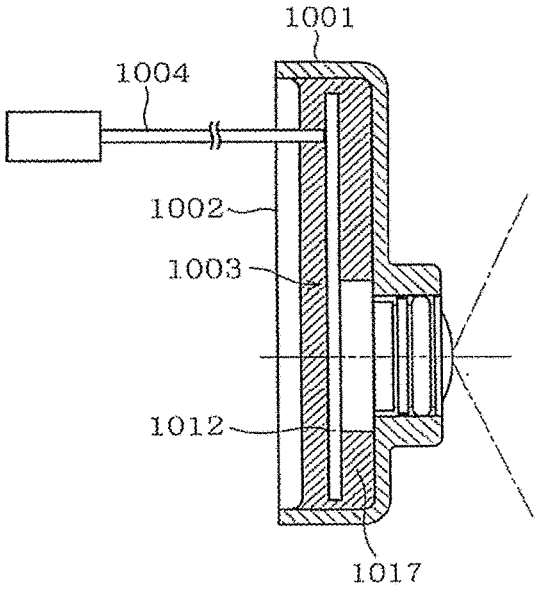
Figure 55:
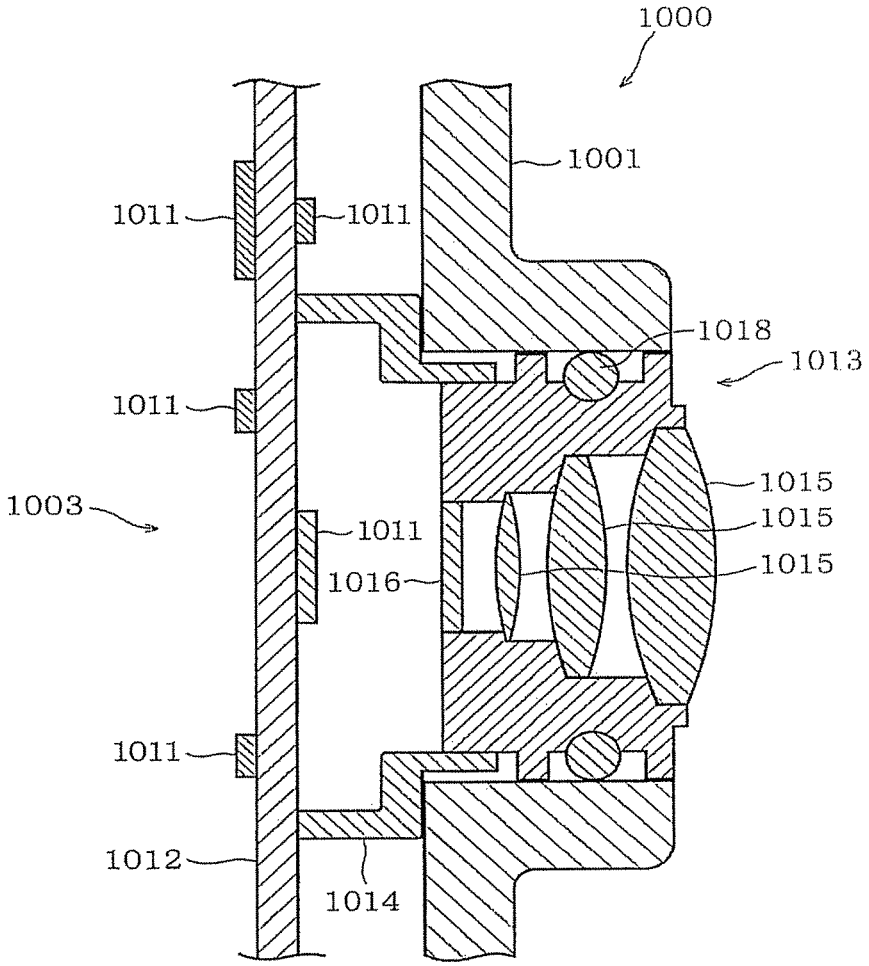

FIGS. 54A-54B schematically illustrate a structure of a camera unit of the fourth embodiment FIG. 55 schematically illustrates a lens unit of a fourth embodiment.

Figure 56A:
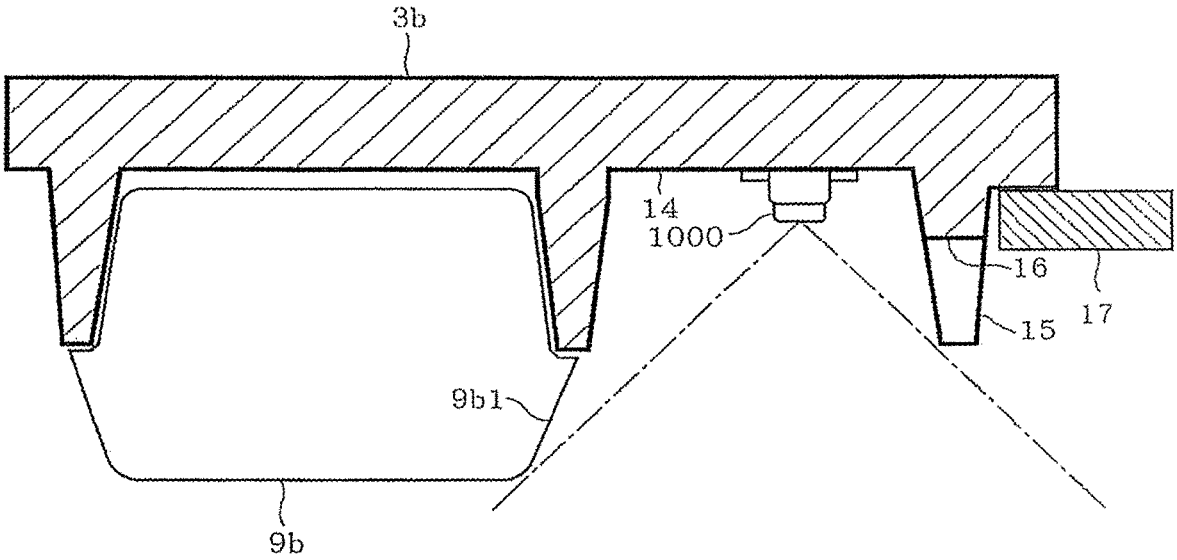
Figure 56B:
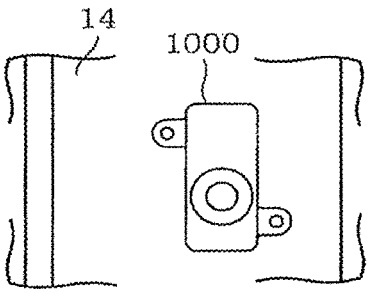

FIGS. 56A-56B schematically illustrate the mode of attachment of EXAMPLE 1 of the fourth embodiment (part 1).

Figure 57:
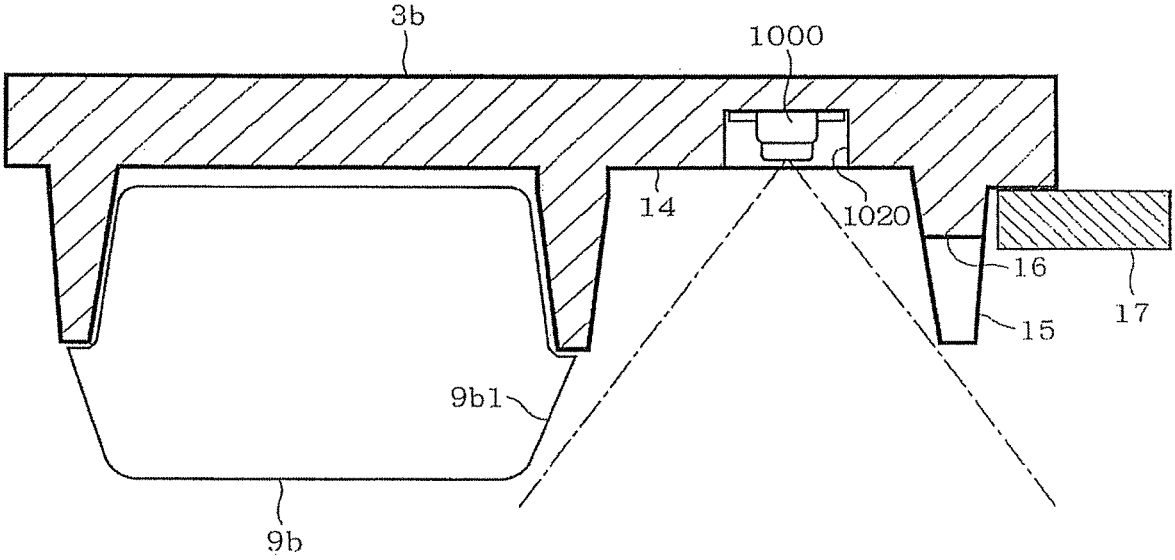

FIG. 57 schematically illustrates the mode of attachment of EXAMPLE 2 of the fourth embodiment (part 2).

Figure 58:
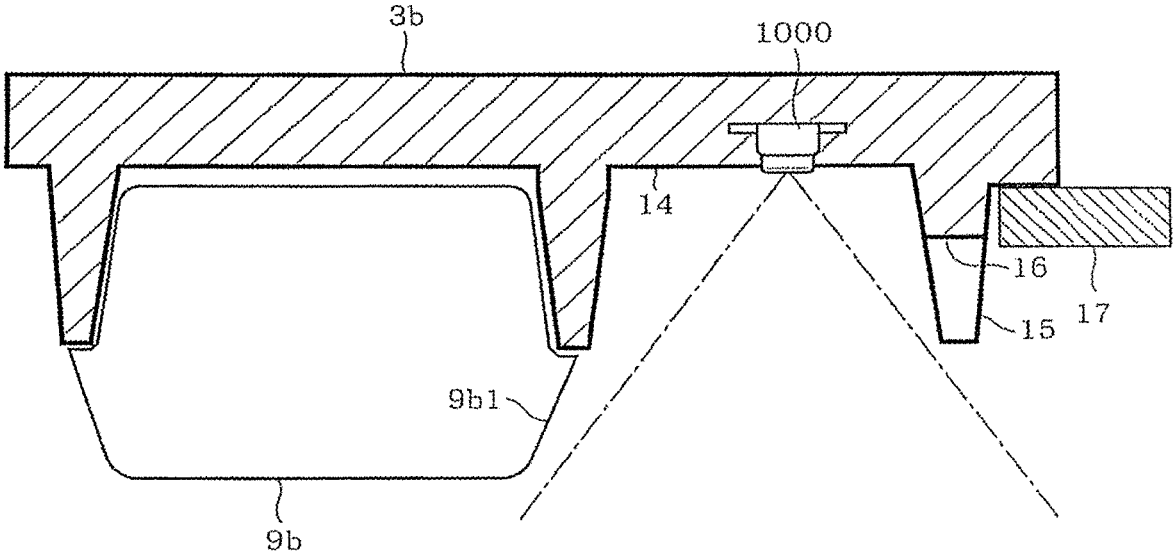

FIG. 58 schematically illustrates the mode of attachment of EXAMPLE 3 of the fourth embodiment (part 3).

Figure 59A:
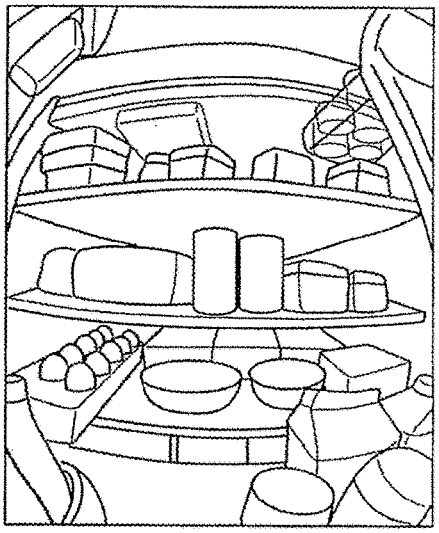
Figure 59B:
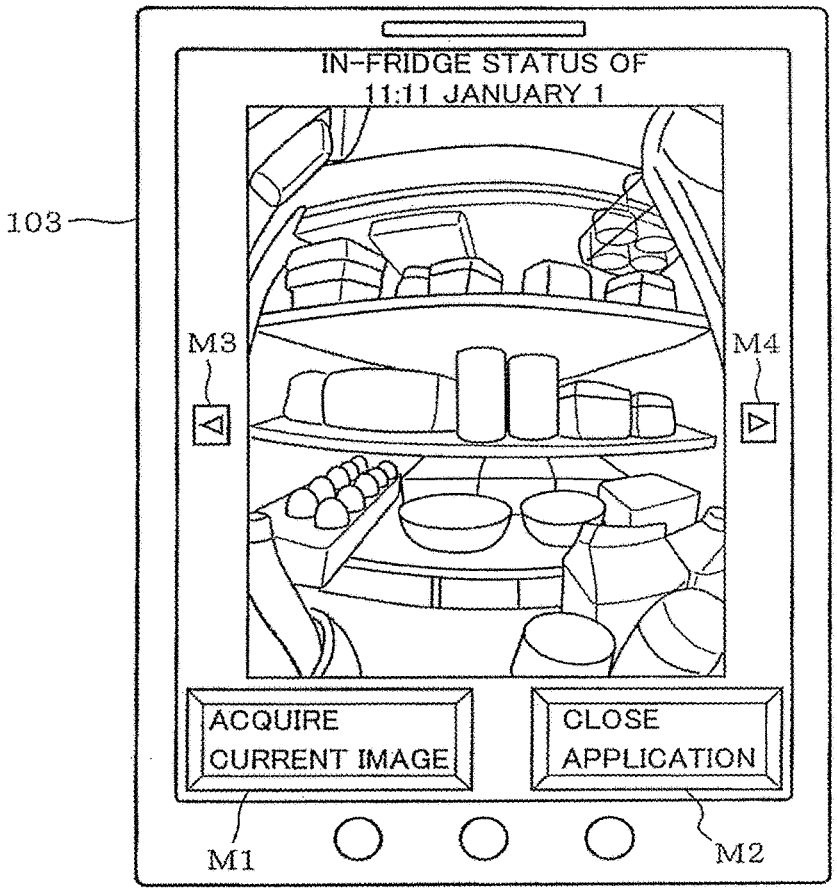

FIGS. 59A-56B schematically illustrate the result of image capturing and how the captured image is displayed in the fourth embodiment.

Figure 60A:
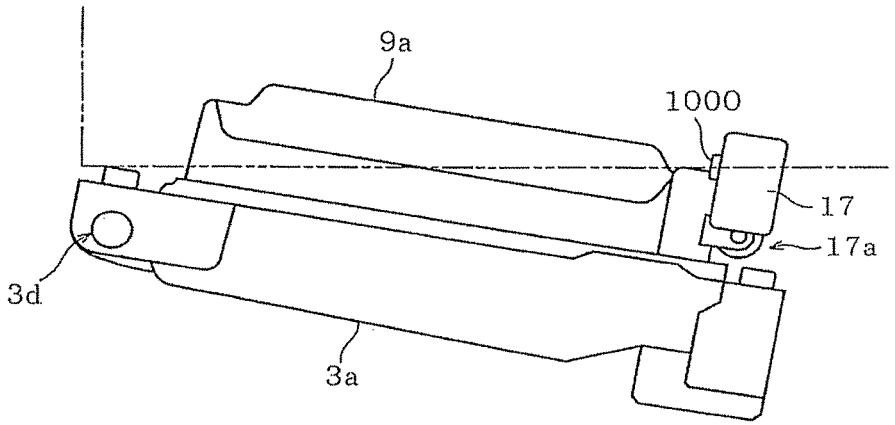
Figure 60B:
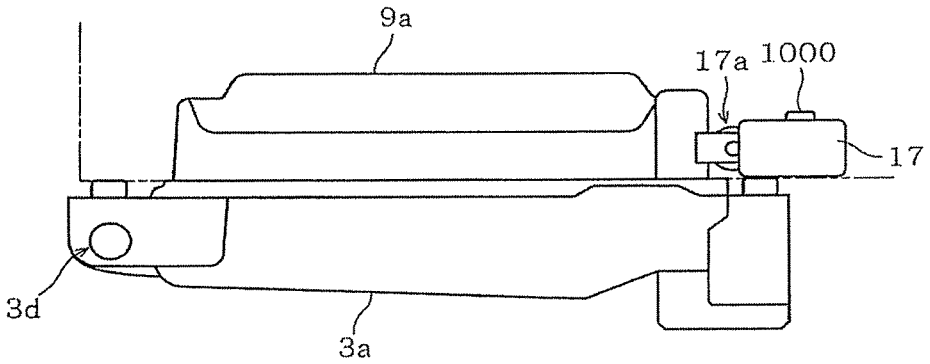

FIGS. 60A-60B schematically illustrate how the vertical partition of EXAMPLE 4 of fourth embodiment is rotated.

Figure 61A:
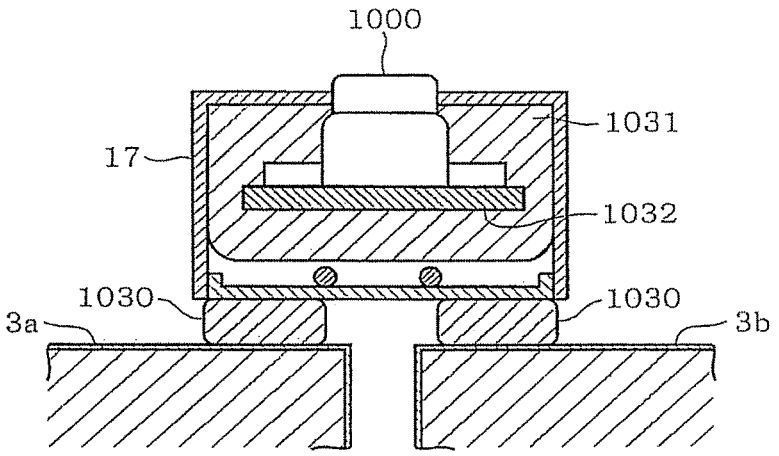
Figure 61B:
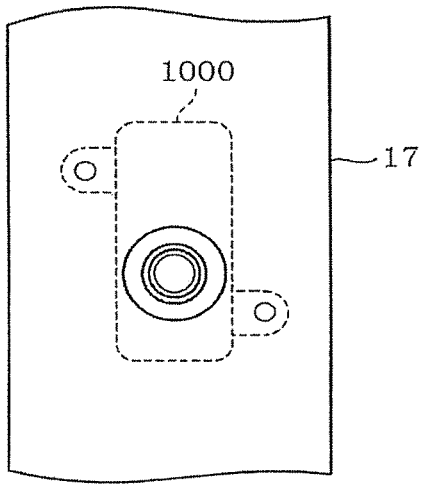

FIGS. 61A-61B schematically illustrate the mode of attachment of EXAMPLE 4 of the fourth embodiment (part 1).

Figure 62:
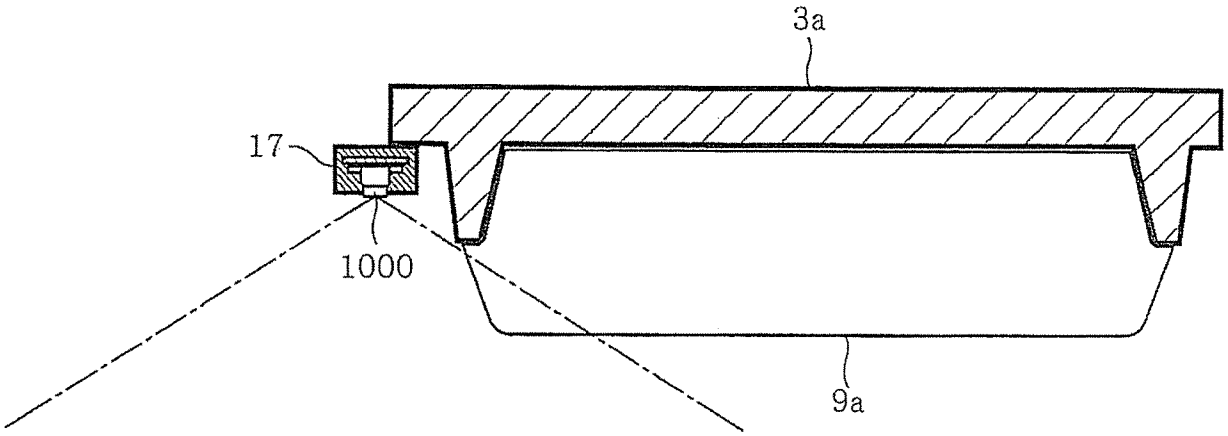

FIG. 62 schematically illustrates the mode of attachment of EXAMPLE 4 of the fourth embodiment (part 2).

Figure 63:
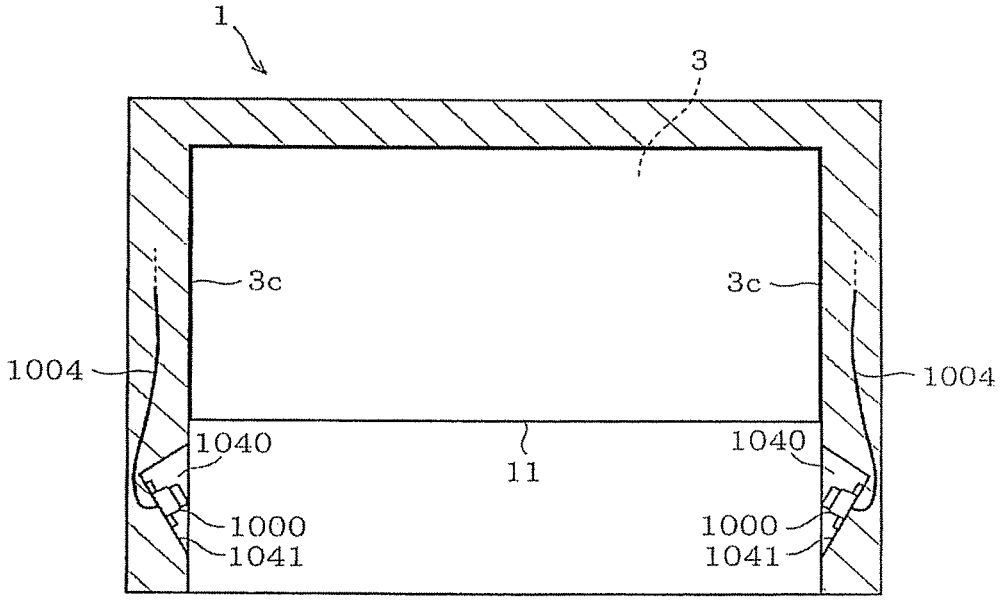

FIG. 63 schematically illustrates the mode of attachment of EXAMPLE 5 of the fourth embodiment.

Figure 64A:
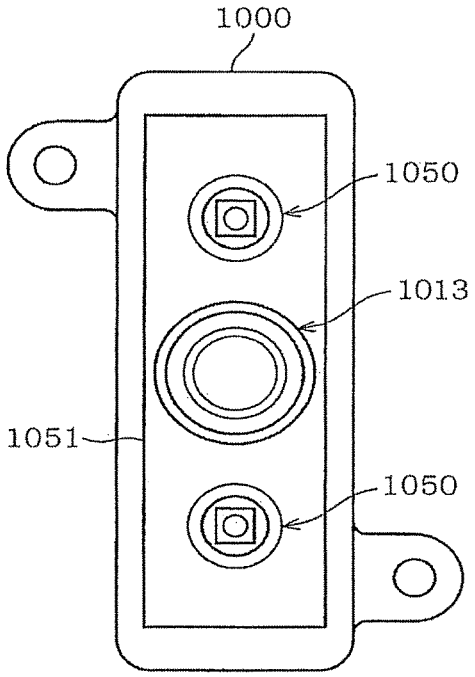
Figure 64B:
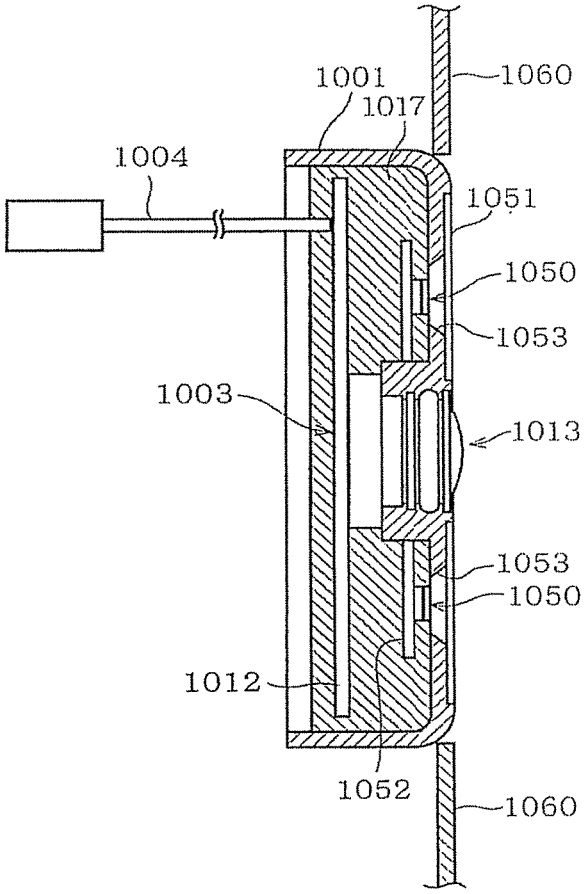

FIGS. 64A-64B schematically illustrate a structure of a camera unit of EXAMPLE 6 of the fourth embodiment.

EMBODIMENTS OF THE INVENTION

A refrigerator, a camera device, a refrigerator door pocket, a communication terminal, a home appliance network system, and an in-fridge image displaying program will be described through the embodiments given below. Elements that are substantially identical across the embodiments are represented by identical reference symbols and are not described in detail.

First Embodiment

A first embodiment will be described hereinafter with reference to FIGS. 1 to 12.

Figure 1:
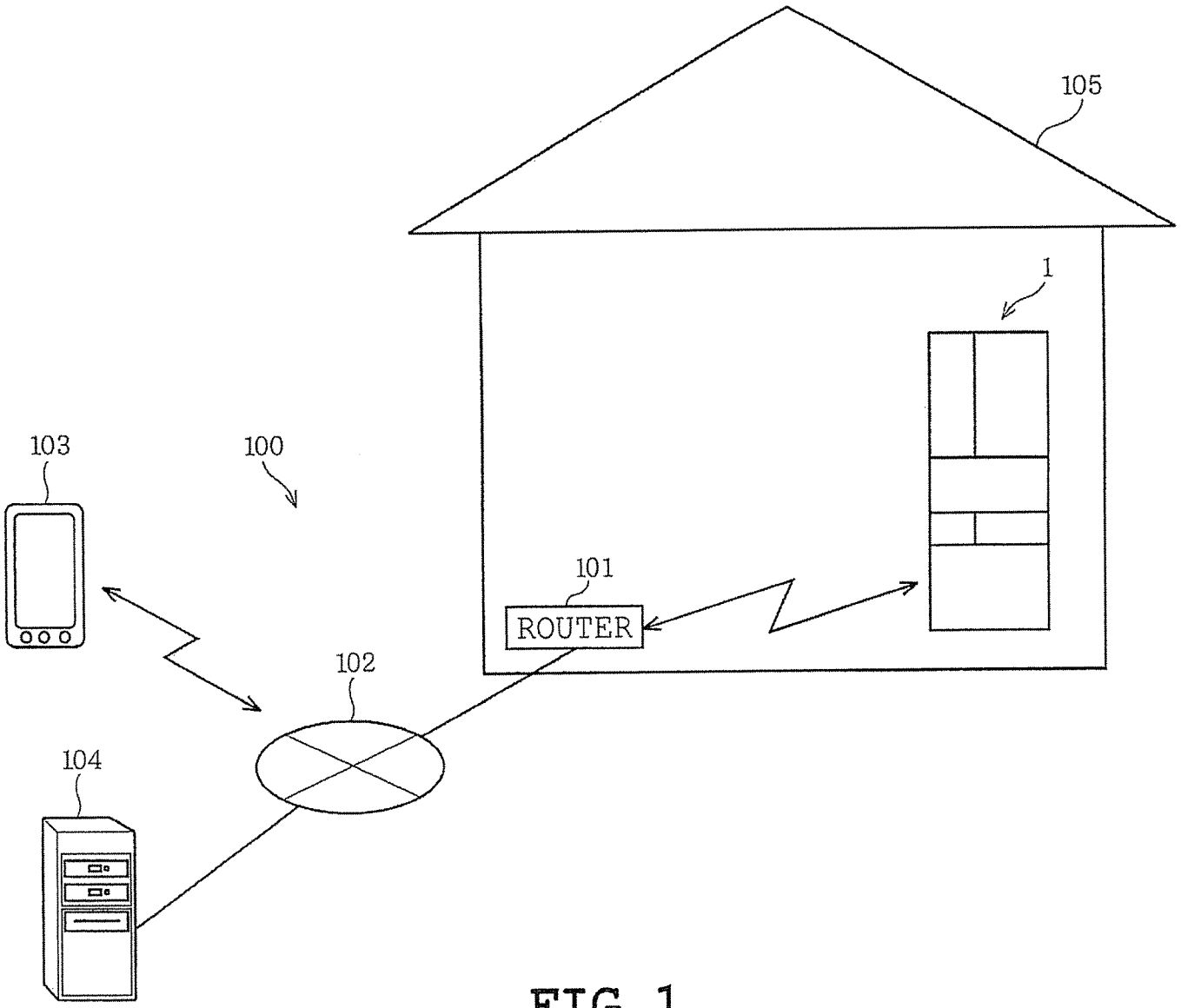

In the present embodiment illustrated in FIG. 1, a home appliance network system 100 employs a refrigerator 1. The refrigerator 1 is connected communicably with an external communication line 102 via a router 101. The router 101 serves as the so-called wireless access point and is connected communicably with the refrigerator 1 by a wireless communication method. The refrigerator 1 exchanges various information with a communication terminal 103 and a server 104 (both being an example of an external device) connected to the communication line 102. In the home appliance network system 100 of the present embodiment, the image information, capturing images of the interior of the refrigerator 1, is stored to the server 104 and the communication terminal 103 is configured to retrieve the in-fridge images from the server 104. The image information is information (data) given in the form of images that depict the fridge interior. The image information may come in any data format as long as it can be transmitted via a communication unit and ultimately allows the fridge interior to be visualized. Examples of the image information includes: an image data (still image, moving image) of known formats such as a bit map format and JPEG/MPEG format; compressed/encrypted data; and data converted by image processing as in the second embodiment. Examples of the communication terminal 103 envisaged in the present embodiment include the so-called smart phone (highly functional mobile phone) which may be carried outside a residence 105, a tablet PC (Personal Computer), and a television connected to the home appliance network system 100.

Figure 2:
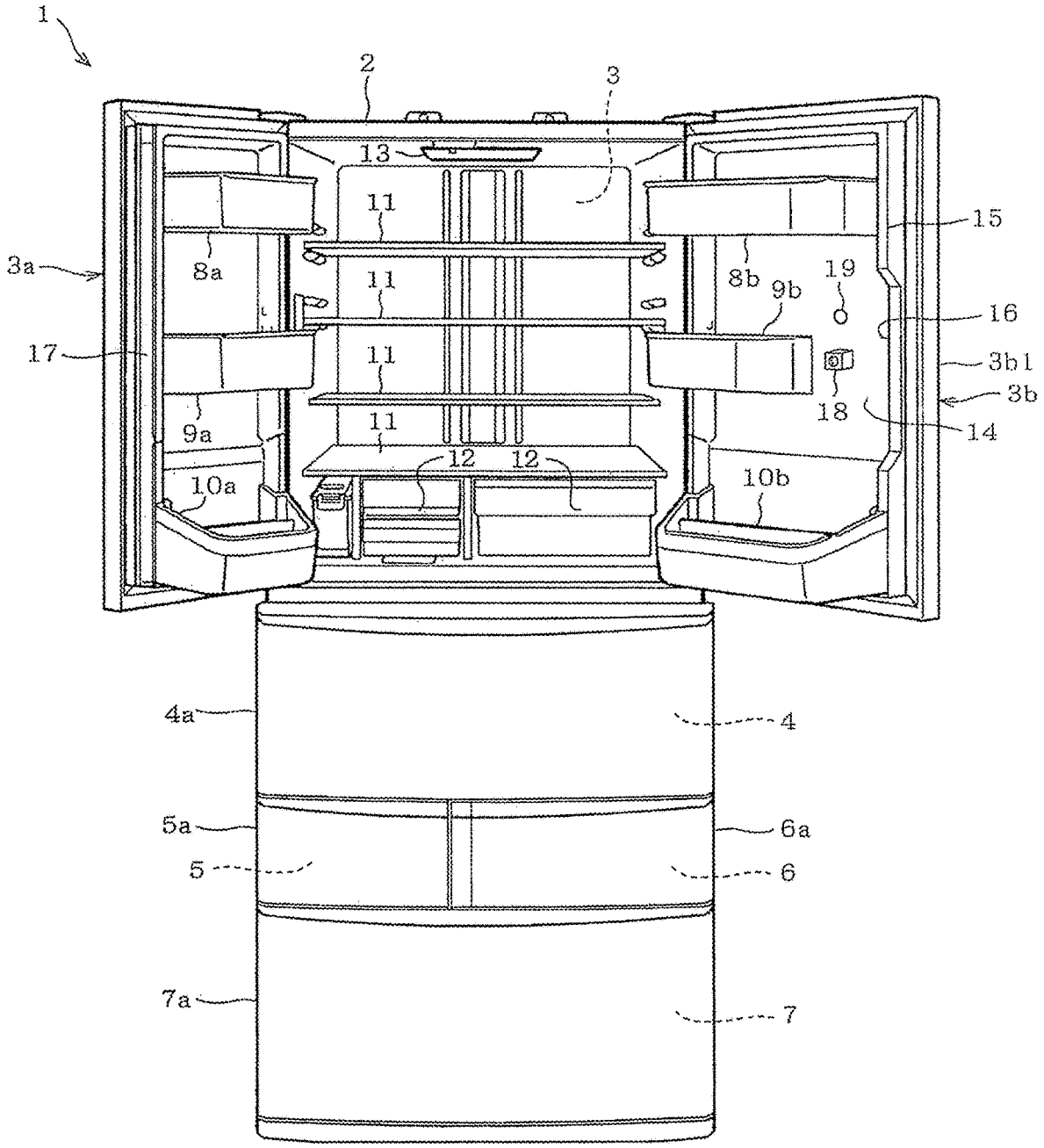

As illustrated in FIG. 2, the refrigerator 1 is provided with storage chambers for storing food namely, a refrigeration chamber 3, a vegetable chamber 4, an ice maker chamber 5, an upper freezer chamber 6, and a lower freezer chamber 7 in the listed sequence from the upper side of a fridge body 2. The compartment of the refrigeration chamber 3 and the vegetable chamber and the compartment of the ice maker chamber 5 and the upper freezer chamber 6 are divided by a thermally insulative partition wall. The refrigeration chamber 3 is double doored and is opened/closed by a left-side door 3*a* and a right-side door 3*b*. The vegetable chamber 4, the ice maker chamber 5, the upper freezer chamber 6, and the lower freezer chamber 7 are opened/closed by drawer-type doors 4*a*, 5*a*, 6*a*, and 7*a*.

Figure 4:
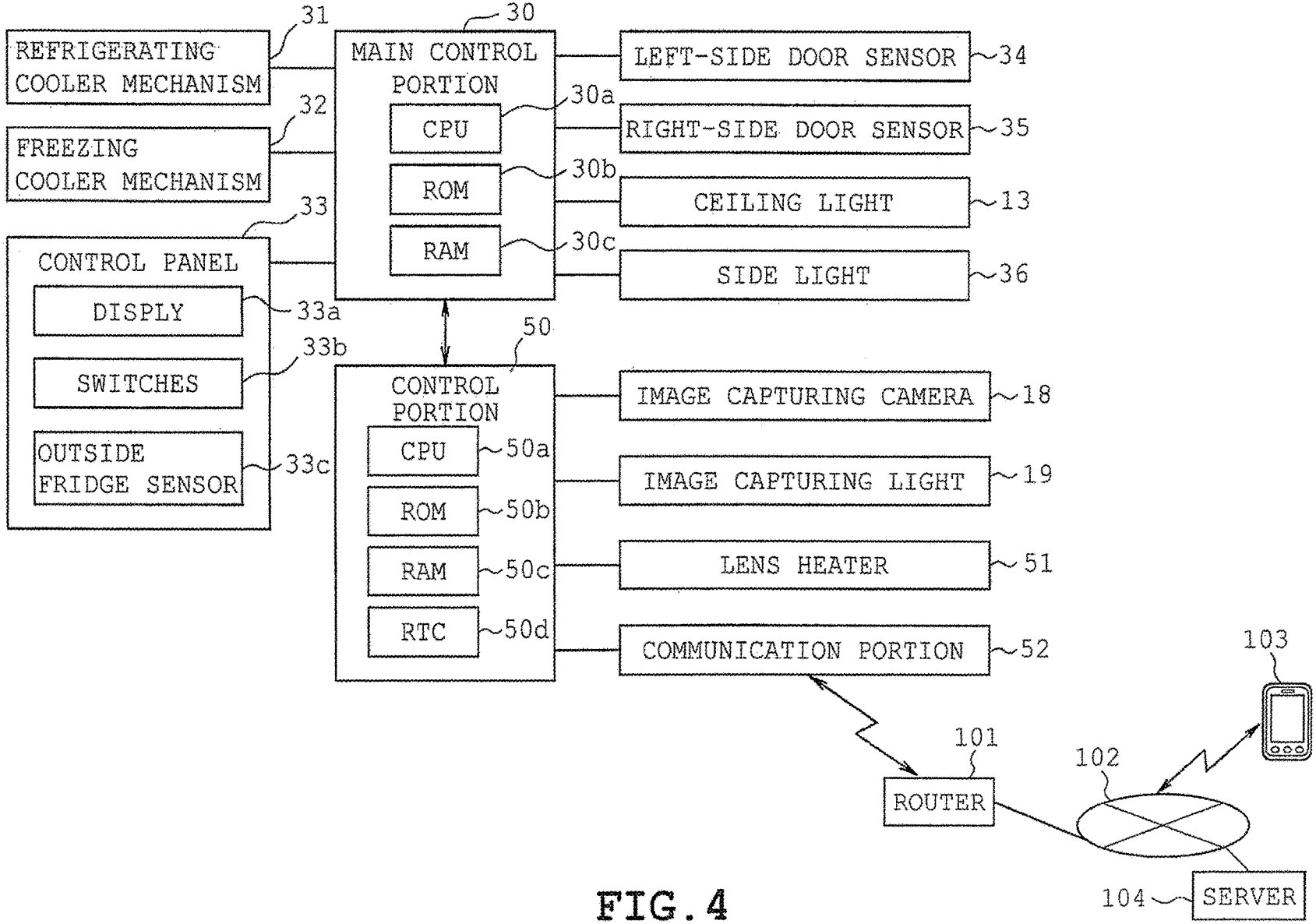

Each of the doors are provided with a sensor for detecting the opened/closed state (See FIG. 4. However, FIG. 4 only illustrates a left-side door sensor 34 for the left-side door 3*a* and a right-side door sensor 35 for the right-side door 3*b*). The structure of the refrigerator 1 illustrated in FIG. 2 is only an example and thus, the location of the storage chambers may be rearranged or the upper freezer chamber 6 may be configured as a switchover chamber which may be switched to be used for refrigeration or for freezing purposes.

The left-side door 3*a* of the refrigeration chamber 3 is provided with a door pocket 8*a*, a door pocket 9*a*, and a door pocket 10*a* in the listed sequence from the upper side thereof. The right-side door 3*b* is provided with a door pocket 8*b*, a door pocket 9*b*, and a door pocket 10*b* in the listed sequence from the upper side thereof. The refrigeration chamber 3 contains plural shelves 11 formed by a transparent material such as glass and is provided with a special purpose chamber 12 such as an egg container chamber and a chiller chamber in the lowermost compartment. A ceiling light 13 serving as a lighting unit is provided in the upper portion of the refrigeration chamber 3. A side light 36 (see FIG. 4) is further provided in the side surface of the refrigeration chamber 3. The ceiling light 13 is provided for lighting the upper portion of the fridge interior and the side surface light 36 is provided for lighting the central portion and the lower portion of the fridge interior, and thus are provided for lighting specific portions of the fridge interior.

The front surface of the left-side door 3*a* and the right-side door 3*b* of the refrigeration chamber 3 are covered by a glass plate 3*b*1 formed of an insulative glass and the interior of the left-side door 3*a* and the right-side door 3*b* are packed with a fill material such as urethane serving as a thermal insulation material. As known, an inner plate 14 made of a nonmetallic resin and a vertical plate 15 are provided on the inner side of the left-side door 3*a* and the right-side door 3*b*. That is, the front surface side of the left-side door 3*a* and the right-side door 3*b* are configured by the glass plate 3*b*1 being a nonmetallic material allowing permeation of electric waves. The door pockets 8 to 10 are provided on the inner plate 14. The vertical plate 15 has a recess portion 16 formed thereto so as to be located near a mid portion thereof as viewed in the vertical direction and near an opening end side of the right-side door 3*b* as viewed in the lateral direction (more specifically, near the location where a later described image capturing camera 18 is provided). The recess portion 16 is provided so as not to block the sight of the image capturing camera 18. Further, the left-side door 3*a* is provided with a revolving vertical partition 17 provided so as to fill the clearance from the right-side door 3*b*. Door 4*a*, etc. of the vegetable chamber 4 has its front surface covered by glass plate and its interior packed with urethane serving as a thermal insulation material as was the case for the right-side door 3*b*.

As illustrated in FIG. 2, the image capturing camera 18 and an image capturing light 19 are provided on the inner plate 14 of the right-side door 3*b* (on the door which is not vertically partitioned). That is, in the present embodiment, the inner plate 14 serves as one example of a receiving portion. The image capturing camera 18 is provided with an image capturing element such as a CCD or CMOS and is configured to capture in-fridge images from the door side. The image capturing camera 18 is provided with a wide-angle lens having a view angle of approximately 120 degrees. The image capturing camera 18 is provided at a location adjacent to a mid-level door pocket 9*b* and closer to the left-side door 3*a* as compared to the door pocket 9*b*. That is, the image capturing camera 18 is provided near the vertical center of the refrigeration chamber 3 and near the lateral center of the refrigeration chamber 3. Thus, when the right-side door 3*b* is closed, the view of the image capturing camera 18 is capable of capturing images of substantially the entirety of the interior of the refrigeration chamber 3 as illustrated in the later described FIG. 7 and at least some of the door pockets 8 to 10. By comparison, web cameras in general have a view angle of approximately 55 degrees.

Figure 3:
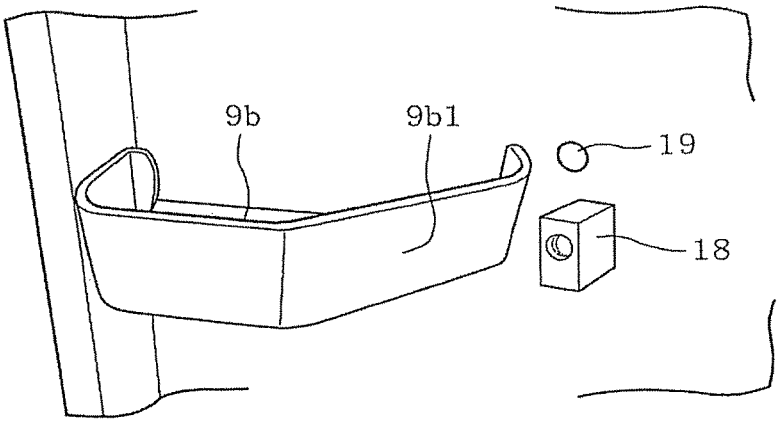

The door pocket 9*b* located adjacent to the image capturing camera 18 is shaped so that one side proximal to the image capturing camera 18 is sloped as illustrated in FIG. 3. That is, a notch 9*b*1 is formed in the door pocket 9*b*, which is normally shaped to exhibit a square (rectangular) storage portion, to secure a view for the image capturing camera 18 employing a wide-angle lens. FIG. 3, etc. schematically illustrate the image capturing camera 18 and thus, differs from the actual size and shape of the image capturing camera 18. The image capturing camera 18, being secured to the refrigerator 1 in the present embodiment, may be configured to be removable from the refrigerator 1 (so as to be mounted as an optional accessory after purchasing the refrigerator 1 for example) as described in the later described second embodiment.

For example, the image capturing light 19 may be provided above the image capturing camera 18. That is, the image capturing light 19 is disposed so that its lighting direction is oriented in the same direction as the view of the image capturing camera 18 so that the light illuminated by the image capturing camera does not directly enter the image capturing camera 18 (so as not to be in confrontation). In other words, the image capturing light 19 is disposed in a location which is difficult to provide back light to the image capturing camera 18 or which does not provide back light to the image capturing camera 18. The image capturing camera 18 is one example of an image capturing unit recited in the claims and the image capturing light 19 is one example of a lighting unit recited in the claims.

The refrigerator 1 is controlled by a main control portion 30 as illustrated in FIG. 4. The main control portion 30 is configured by a microcomputer provided with components such as a CPU 30*a*, a ROM 30*b*, and a RAM 30*c* and controls the entire refrigerator 1 by executing a computer program stored for example in the ROM 30*b*, etc.

The main control portion 30 is connected to a refrigerating cooler mechanism 31 and freezing cooler mechanism 32 configured by a known refrigeration cycle, etc.; a control panel 33 used for inputting settings and operations to the refrigerator 1; the left-side door sensor 34; the right-side door sensor 35; the ceiling light 13; the side light, and the like. The refrigerator 1 is also provided with an in-fridge sensor, etc. not shown for detecting the temperature of the refrigeration chamber 3, the lower freezer chamber 7, and the like.

The control panel 33 is provided with a display 33*a*, switches 33*b*, and outside fridge sensor 33*c*. The display 33*a* presents various information such as the operational status of the refrigerator 1. The switches 33*b* input settings and operations made by the user to the refrigerator 1. The switches 33*b* include a go-out switch for switching the operating mode of the refrigerator 1 when the user goes outdoor. The go-out switch may have options such as "power save", "leave home", etc. that, when selected, perform the relevant power saving modes. That is, since the refrigerator 1 will not be used when the user goes outdoor, the refrigerator 1 makes a transition to the power saving mode to reduce power consumption.

For example, when the "power save" option is selected, the refrigerator 1 makes minor adjustments in the in-fridge temperature so as not to affect the environment of food preservation, while also controlling the operational status of a heater for preventing dew condensation to make a transition to a power saving mode in which power consumption is reduced by approximately 10% from the normal operation mode. Alternatively, when the "leave home" option is selected, the refrigerator 1 reduces the number of times of automatic ice making to make a transition to a power saving mode in which power consumption is reduced from the normal operation mode. More specifically, the refrigerator 1 reduces the frequency of automatic ice making to once every 8 hours for example to reduce power consumption by approximately 20% from the normal operation mode.

The "power save" switch and the "leave home" switch provided in the refrigerator 1 serve as the go-out switch in the present embodiment. Alternatively, a dedicated go-out switch may be provided instead.

The outside fridge sensor 33*c* is formed of a temperature sensor, a humidity sensor, or the like and acquires information of the environment outside the refrigerator. The outside fridge sensor 33*c* is one example of an outside environment acquiring unit recited in the claims.

The main control portion 30 controls the operational status of the refrigerator 1 based on the environment inside the refrigerator acquired by the in-fridge sensor as well as the environment outside the refrigerator acquired by the outside fridge sensor 33*c* and based on the settings made from the control panel 33. Further, the main control portion 30 acquires the opened/closed status of the doors through the left-side door sensor 34 and the right-side door sensor 35. The main control portion 30 is connected communicably with the control portion 50 and is capable of transmitting the opened/closed status of the doors to the control portion 50 and receive instructions for illuminating the ceiling light 13, the side light 36, etc. from the control portion 50, etc.

The control portion 50 is configured by a microcomputer provided with a CPU 50*a*, a ROM 50*b*, a RAM 50*c*, and a real time clock (hereinafter referred to as RTC 50*d*) for acquiring time. The control portion 50 is connected to the image capturing camera 18, the image capturing light 19, a lens heater 51, and a communication portion 52.

The control portion 50 controls the timing and the environment in which the images of the fridge interior are captured by the image capturing camera 18 by executing a computer program stored in the ROM 50*b* for example. More specifically, the control portion 50 controls the timing of image capturing based on the opened/closed status of the doors received from the main control portion 30 and controls the environment of image capturing, i.e. the lighting status of the ceiling light 13, the image capturing light 19, etc. serving as the light source required in image capturing. The control portion 50 is one example of a control unit recited in the claims.

A description is given hereinafter on the timing of image capturing. When capturing images of the fridge interior, it is required to drive the image capturing camera 18 and illuminate the image capturing light 19, etc. That is, capturing images of the fridge interior requires power consumption. Thus, unnecessary power is consumed when image capturing is constantly enabled. The refrigerator 1 is configured to reduce power consumption by controlling the timing in which images of the fridge interior are captured and by controlling the environment of image capturing (i.e. illumination of the image capturing light 19) only when required so as to be synchronized with the controlled timing of image capturing.

The timing for capturing images of the fridge interior are preset to the following image capturing conditions 1 to 5 for example. When either of the conditions is met, the control portion 50 determines that a timing has arrived to capture an image of the fridge interior.

Image capturing condition 1: The timing in which either of the doors of the refrigeration chamber 3 is closed after being opened. That is, the timing in which the status of in-fridge food storage may have changed.

Image capturing condition 2: The timing in which either of the doors of the refrigeration chamber 3 is opened. That is, the timing in which there is a possibility that the status of in-fridge food storage may thereafter change.

Image capturing condition 3: The timing in which instructions have been received from external devices such as a communication terminal.

Image capturing condition 4: When the go-out switch has been operated. Image may be captured at the timing when the go-out switch has been operated or at the timing when a predetermined standby time has elapsed after the go-out switch has been operated. Either of the timings can be preset as desired.

Image capturing condition 5: The timing when a predetermined time has elapsed after the door has been closed after being opened. (The present embodiment employs the timing in which a delayed image capturing time has elapsed which is a time period expected to be required to remove dew condensate from the wide angle lens of the image capturing camera 18). That is, the timing in which dew condensate is removed from the wide angle lens. The delayed image capturing time may be a fixed value or may be varied depending upon the temperature, humidity, etc. outside the refrigerator acquired by the outside fridge sensor 33*c*.

Image capturing condition 6: The timing in which dew condensate is removed by the lens heater 51 from the wide angle lens of the image capturing camera 18 after the door has been closed after being opened. That is, the timing in which dew condensate is removed from the wide angle lens.

It is possible to employ either one of the image capturing conditions or a combination of the image capturing conditions if the conditions do not contradict with one another. The present embodiment employs condition 1, 3, 4, and 5.

The communication portion 52 is configured to communicate with the router 101 through wireless communication such as the so-called wireless LAN, Bluetooth (Registered Trademark), etc. More specifically, the communication portion 52 uploads the captured images of the fridge interior to the server 104 via the router 101 and the communication line 102. The communication portion 52 may employ a wired communication.

Figure 8A:
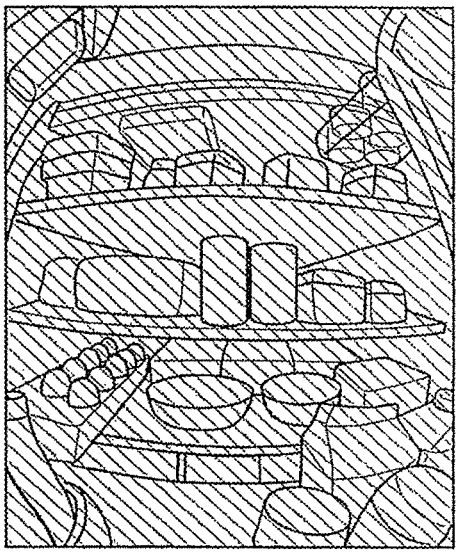
Figure 8B:
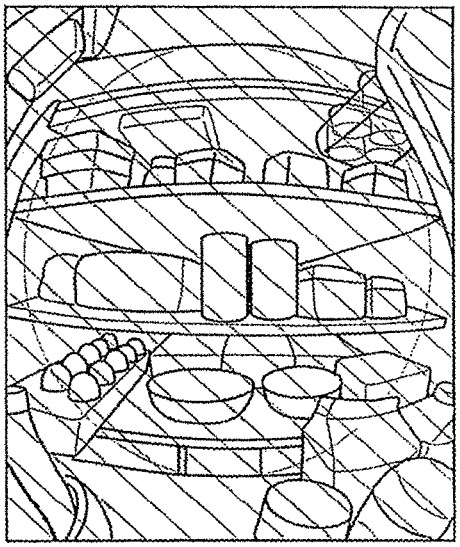
Figure 8C:
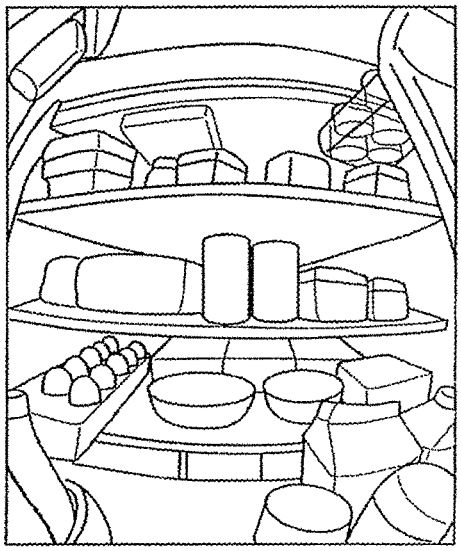

The lens heater 51 (one example of a removing unit) removes dew condensate from the lens surface as illustrated in the later described FIGS. 8A-8C by heating the wide angle lens of the image capturing camera 18. The lens heater 51 may be configured by an exothermic member that generates heat by energizing an electrically heated wire, etc. The lens heater 51 may also be configured by the heat produced by the microcomputer of the control portion 50 or by a heat conducting member that transmits the heat produced by the microcomputer. When utilizing the heat produced by the microcomputer, the microcomputer may be relieved from the power save mode. A fan, etc. may be employed as the removing unit. More specifically, a fan may be driven to blow cool air onto the lens surface and image capturing may be carried out after a predetermined time has lapsed which is expected to be sufficient for removing dew condensate. Any configuration may be employed as long as dew condensate can be removed from the lens surface.

The communication terminal 103 acquires and displays images of the fridge interior stored in the server 104 by accessing the server 104. In the present embodiment, the communication terminal 103 acquires images stored in the server 104 instead of acquiring images directly from the refrigerator 1.

The server 104 is configured by a computer system and stores multiple images uploaded thereto in chronological order. The server 104 is further configured to associate the communication terminal with a specific refrigerator 1 and provides images of the relevant refrigerator 1 to the communication terminal requesting image acquisition.

Next, a description is given on the operation of the above described configuration. The processes described below, being executed by cooperation of the main control portion 30 and the control portion 50, are described with the refrigerator 1 being the subject of process execution for simplicity.

Figure 5:
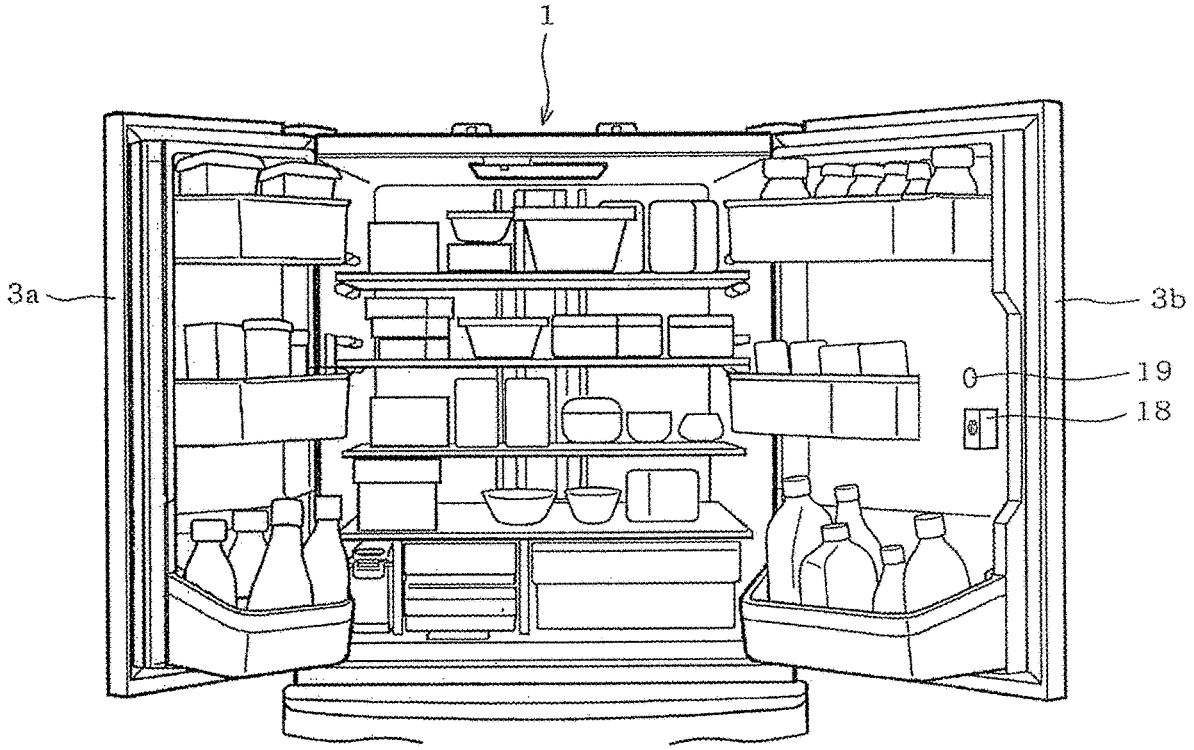
Figure 6:
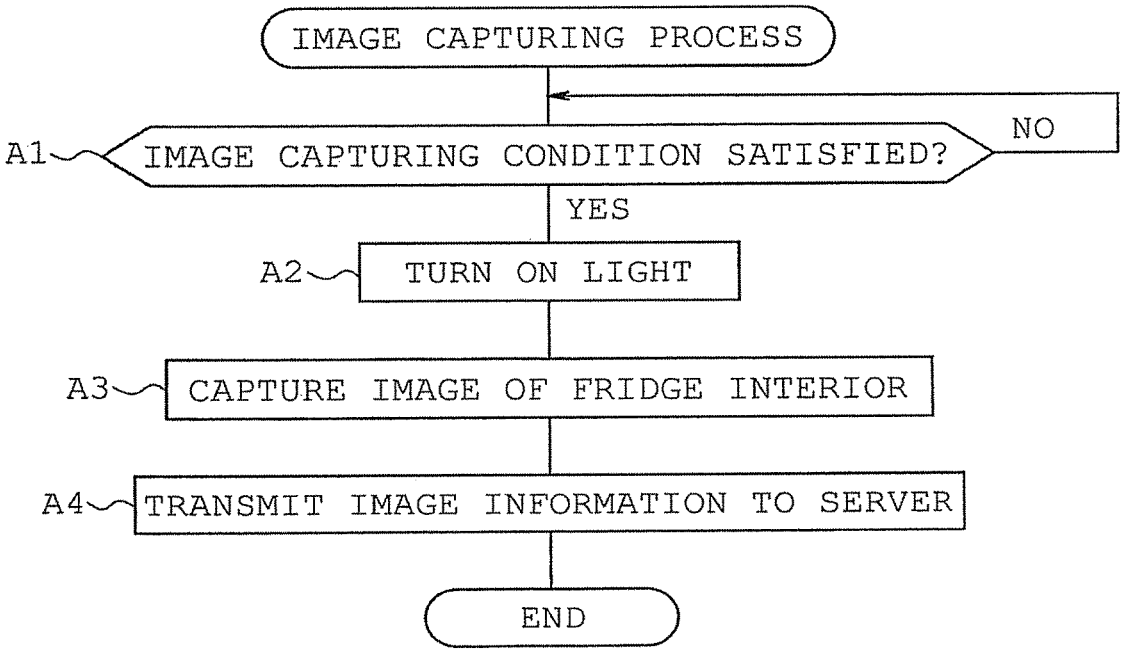

As illustrated in FIG. 5, various foods are stored in the refrigeration chamber 3 of the refrigerator 1. The refrigerator 1 executes the image capturing process indicated in FIG. 6 in which a determination is made as to whether or not conditions have been met for capturing images of the fridge interior by the image capturing camera 18 (A1). If either of the conditions has been met (A1: YES), that is, when it has been determined that the timing has arrived to perform image capturing, the light (image capturing light 19) is illuminated (A2) to capture images of the fridge interior (A3). The image of the fridge interior, one example of which is illustrated in FIG. 7, is captured in the above described manner.

Figure 7:
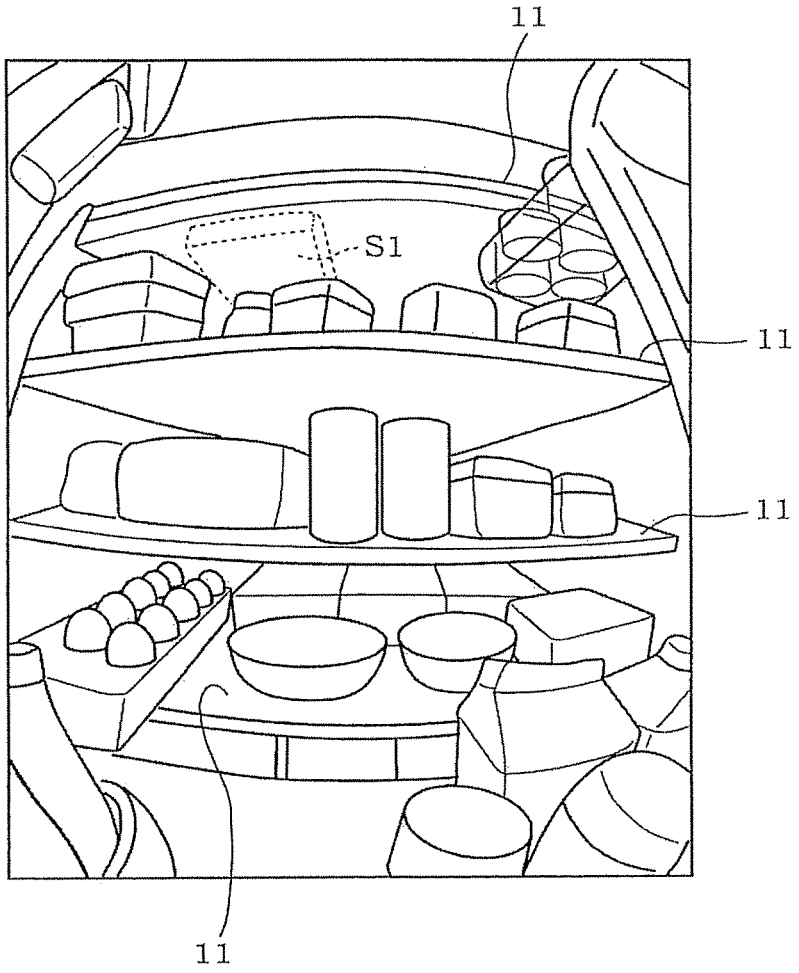

In FIG. 7, an image of substantially the entirety of the refrigeration chamber 3 interior is captured since the above described wide-angle lens is used in the image capturing of the fridge interior. An image of various types of food placed on each shelf 11 and various types of food stored in each door pocket is visibly captured. Since the shelves 11 are made of a transparent material, the image of food Si placed on the uppermost shelf 11 is captured so as to be visible through the shelf 11.

Further, since the image is captured by illuminating image capturing light 19, the image of food is visibly captured without being back lit. In a comparative embodiment not illustrated in which the image of the fridge interior is captured with the ceiling light 13 illuminated, the light coming from the ceiling light 13 results in a back light and the visibility of food Si and food placed on the second level shelf 11 becomes poor. That is, the refrigerator 1 controls the environment for enabling image capturing of the fridge interior by illuminating the image capturing light 19 which does not create a back light to the image capturing camera 18.

The refrigerator 1 transmits the image information of the captured image to the server 104 (A4). At this instance, the time stamp of the captured image is transmitted to the server 104 at the same time. As a result, the server 104 stores (accumulates) multiple images of the fridge interior in the chronological order.

When the door of the refrigeration chamber 3 is opened, the image capturing camera 18 as well as its wide-angle lens, provided on the inner plate 14 of the right-side door 3*b*, becomes exposed to the environment of the fridge exterior. The exposure occurs not only when the right-side door 3*b* is opened but also when the left-side door 3*a* is opened. Thus, the lens surface may fog by dew condensate as illustrated in FIG. 8A immediately after the door is closed though caused by the environment of the fridge exterior. FIGS. 8A-8C schematically illustrate the dew condensate on the lens surface by hatching where FIG. 8A illustrates the bedewed state (immediately after the door is closed), FIG. 8B illustrates the dew condensate being gradually removed (over some time after the door is closed), and FIG. 8C illustrates the dew condensate removed (after the delayed image capturing time has elapsed).

When the image of fridge interior is captured immediately after the door is closed, visibility may be poor because of dew condensate. In such case, the refrigerator 1 may employ condition 5 described above and further capture the image of the fridge interior at the timing when the delayed image capturing time has elapsed after the door once opened has been closed. That is, when condition 5 is met (A1: YES), light is illuminated (A2), image of the fridge interior is captured (A3), and the image information of the captured image is transmitted to the server 104 (A4).

Figure 9:
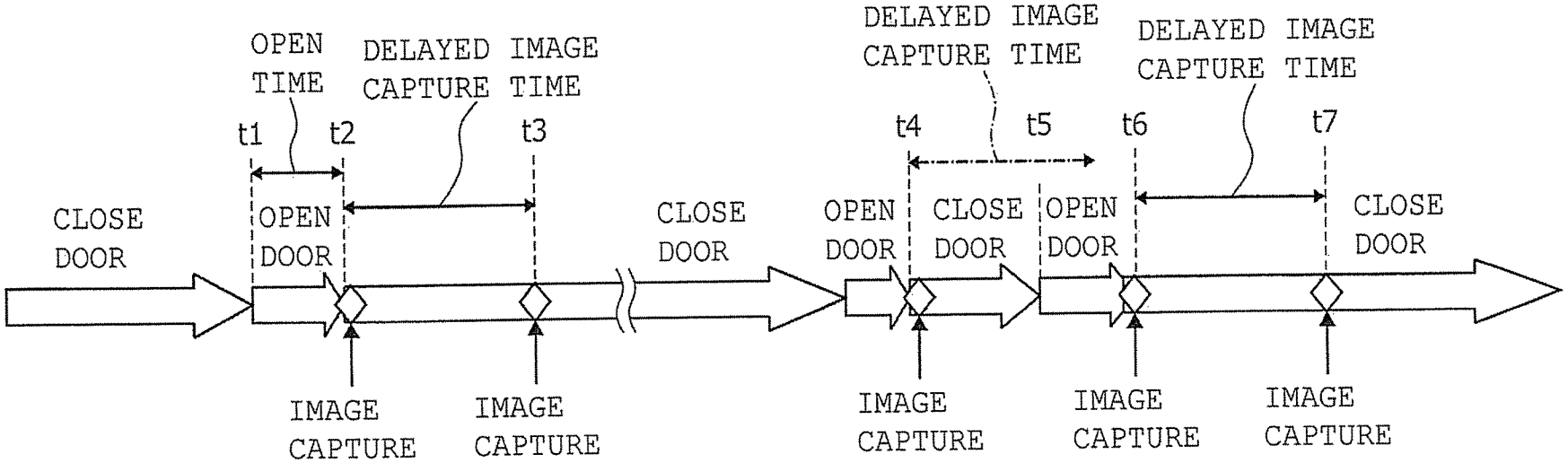

To described more specifically with reference to FIG. 9, the closed door is opened at time t1 and closed at t2. Image is captured at time t2 and at time t3, which is the timing after the delayed image capturing time has elapsed, image is captured again. After image is captured after door is closed at time t4, if the door is reopened at time t5 which precedes the lapse of the delayed image capturing time, image is captured at time t6 when the door is closed and image is captured again at time t7, which is the timing after the delayed image capturing time has elapsed. It is thus, possible to capture images with dew condensate of the wide-angle lens removed, that is, images with visibility of the fridge interior.

When image information is transmitted to the server 104, the control portion 50 is placed in a standby state. In the standby state, the control portion 50 may make a transition to a power save mode such as the so-called sleep mode (in which the ice making function may be stopped for example), or conduction of power to the control portion 50 including the image capturing camera 18 may be blocked to reduce power consumption to zero. Once opening of the door, etc. has been detected via the door sensor for example, instructions may be outputted to the control portion 50 from the main control portion 30 to make a transition to the normal mode.

As a result, it is possible to reduce total power consumption of the refrigerator 1.

Figure 10:
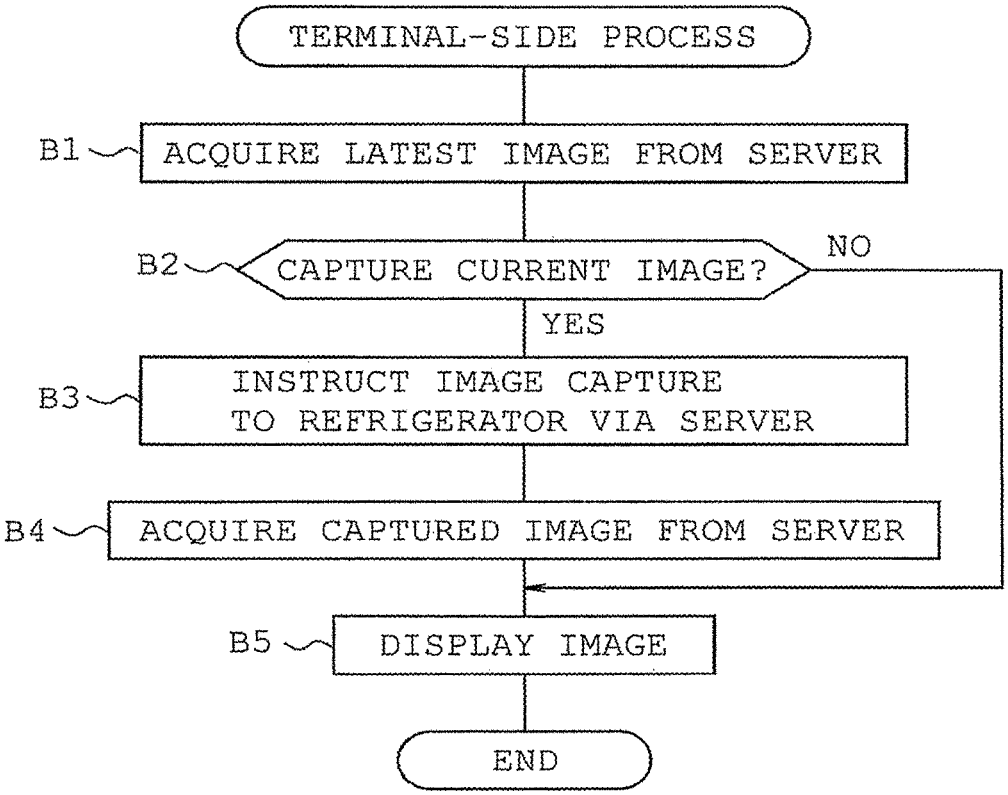
Figure 11:
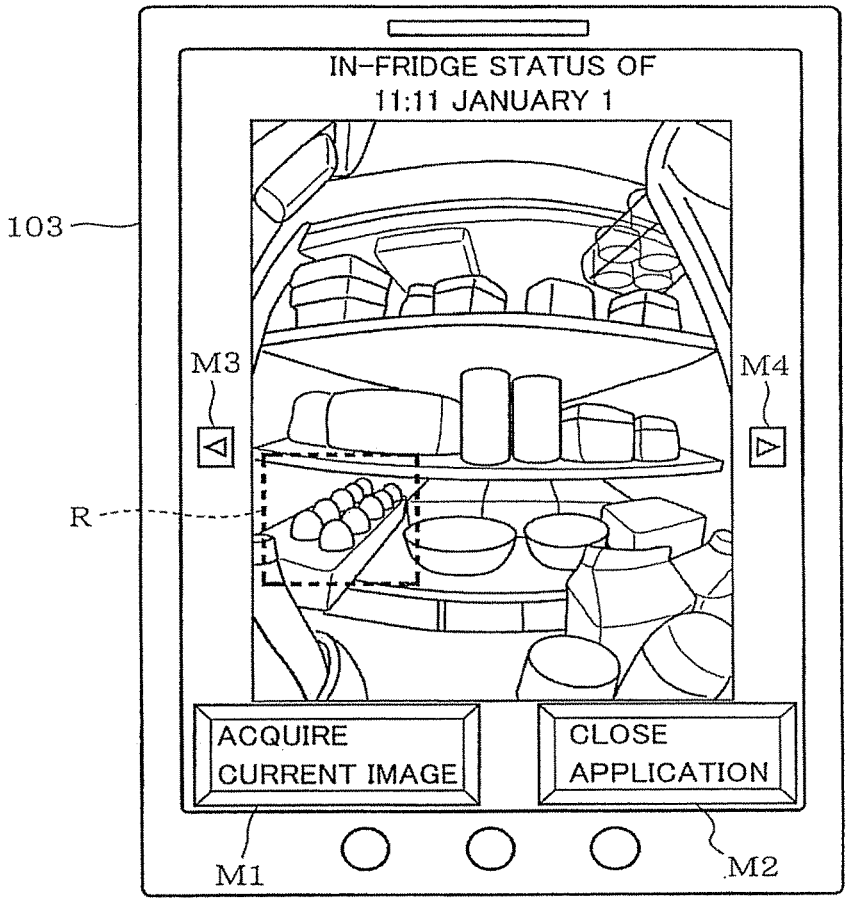
FIG. 11 illustrates how an image is displayed on the communication terminal of the first embodiment (part 1).

The images stored in the server 104 can be displayed on the communication terminal 103. The communication terminal 103 acquires the latest image (or the image information) from the server 104 (B1) when an application for image acquisition is invoked and the terminal-side process (fridge interior image displaying program) indicated in FIG. 10 is executed. As a result, images of the fridge interior are displayed, with the time in which the images were captured, on the screen of the communication terminal 103 as illustrated in FIG. 11. The screen of the communication terminal 103 is provided with a touch panel.

Figure 12:
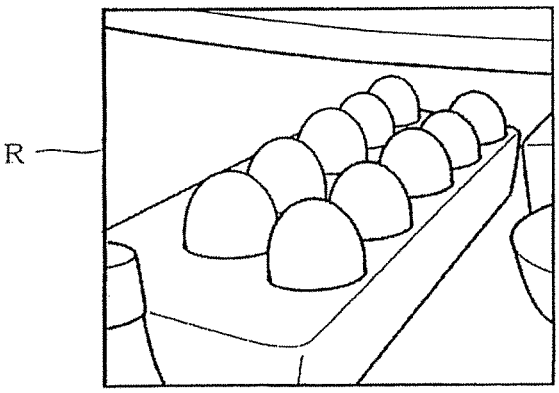
FIG. 12 illustrates how an image is displayed on the communication terminal of the first embodiment (part 2).

The screen is provided with button M1 for acquiring the current image, button M2 for terminating the application, button M3 for displaying images preceding the currently displayed image, button M4 for displaying newer images succeeding the currently displayed image, etc. Further, the communication terminal 103 is capable of enlarging the desired portion of the displayed image. For example, region R illustrated in FIG. 11 may be enlarged as illustrated in FIG. 12 to allow the user to be aware of the remaining number of eggs.

Further, when the user touches the button M1 of the communication terminal 103, that is, when an operation for acquiring the latest image is inputted (B2: YES), the communication terminal 103 transmits instructions for capturing images of the fridge interior to the refrigerator 1 (B3), acquires the image from the server 104 (B4), and displays the acquired image (B5). After step B3, the image of the fridge interior is captured in the refrigerator 1 side given that the condition 3 has been met in FIG. 6. The image information of the captured image is thereafter transmitted to the server 104.

The home appliance network system 100 allows the status inside the refrigerator 1 to be checked from a remote location since the refrigerator 1 transmits image information of the captured image of the fridge interior to the server 104, the server 104 stores the image, and the communication terminal 103 displays the image acquired from the server 104.

The present embodiment described above provides the following effects.

The refrigerator 1 is provided with the image capturing camera 18 configured to capture images of the interior of storage chambers for storing food such as the refrigeration chamber 3 and the communication portion 52 configured to transmit image information of images of the fridge interior captured by the image capturing camera 18 to external devices. It is thus, possible to acquire images of the fridge interior through external devices such as the communication terminal 103. As a result, it is possible to readily check the status inside the refrigerator from a remote location.

In the present embodiment, the images of the fridge interior are stored in the server 104. Thus, there is no need to provide a storage unit for storing the images in the refrigerator 1 side, thereby suppressing manufacturing cost. A storage portion may alternatively be provided in the refrigerator 1 so that the images are stored in the refrigerator 1 side.

The control portion 50 is placed in a standby state after image information is transmitted to the server 104. That is, power consumption of the control portion 50 side (including the image capturing camera 18) is reduced or cutoff to zero when image capturing is not ongoing. It is thus, possible to suppress total electricity consumption of the refrigerator 1.

The control portion 50 is configured to control the timing in which the images of the fridge interior are captured by the image capturing camera 18 and to control the image capturing environment such as illumination of lights for capturing images of the fridge interior so as to be synchronized with the controlled timing of image capturing. A light source is required in capturing the images of the fridge interior. Unnecessary power will be consumed if the image capturing is constantly enabled. However, by controlling the image capturing environment to illuminate the image capturing light 19, etc. only when the image capturing is carried out so as to be synchronized with the timing of image capturing, it is possible to reduce unnecessary power consumption. A night vision camera (such as an infrared camera), etc. capable of image capturing without a light source may be used to perform image capturing without illumination of light. Alternatively, light maybe illuminated continuously.

The refrigerator 1 captures an image of the fridge interior by the image capturing camera 18 at the timing after the door of the refrigeration chamber 3 has been closed. When images are captured even when the status of storage of the refrigerator has not been changed, unnecessary images will accumulate at the expense of unnecessary increase of power consumption. Thus, in the present embodiment, the refrigerator captures an image of the fridge interior at the timing after the door once opened has been closed. As a result, when encountering a state in which the status of food storage in the refrigerator may be changed (the state when the door is opened), the image of the fridge interior is captured when the status of storage has been settled (after the door is closed). It is thus, possible to suppress unnecessary image capturing and increase of power consumption.

Further, the refrigerator 1 captures an image of the fridge interior at the timing after the door has been closed and after the delayed image capturing time required to remove dew condensate from the wide-angle lens of the image capturing camera 18 has elapsed. During the summer time for example when the temperature as well as the humidity are high, dew condensate may result on the lens surface of the image capturing camera when the door is closed after once being exposed to exterior environment when the door was opened, since the temperature inside the refrigerator 3 is low. Hence, image of the fridge interior is captured again at the timing in which the delayed image capturing time, expected to be sufficient to remove the dew condensate, has elapsed. It is thus, possible to capture clear images with a fogless lens surface. As a result, it is possible to check the status inside the refrigerator even more reliably.

The delayed image capturing time may be specified based on the environment outside the refrigerator acquired by the outside fridge sensor 33*c* such as temperature and humidity. As a result, dew condensate can be expected not to occur (or occur in small amount) when temperature and/or humidity is low, etc. It is thus, possible to reduce the delayed image capturing time and thereby reduce power consumption. More specifically, when the control portion 50 is arranged to standby until the lapse of the delayed image capturing time for example, shorter standby time will result in less power consumption.

Further, dew condensate on the wide-angle lens of the image capturing camera 18 may be removed by a removing unit such as the lens heater 51. In such case, the refrigerator 1 captures an image of the fridge interior at the timing after the dew condensate has been removed from the lens surface by the lens heater 51. The use of the lens heater 51 further allows the delayed image capturing time to be shorted and consequently allows power consumption to be further reduced. A heat conducting member that transmits heat produced by the control portion 50 may be used as the lens heater 51. As a result, it is possible to remove dew condensate from the lens surface without consuming extra power. It also possible to reduce power consumption by shortened delayed image capturing time when a fan is used as the removing unit.

The refrigerator 1 captures image of the fridge interior for example at the timing when instructions to capture image of the fridge interior is received from the communication terminal 103. For example, when the user is at a remote location, the status of storage may change if the user's family takes food out of the refrigerator 1. It is possible to check the latest, i.e. the current status inside the refrigerator 1 by capturing the image of the fridge interior at the point of receiving user instructions.

The refrigerator 1 captures image of the fridge interior when the go-out switch has been operated. It is thus, possible to check the status inside the refrigerator 1 after going outdoors. In case the user living alone goes out, the status of storage of the refrigerator 1 is not expected to change from the moment the user leaves his/her residence. It is thus, possible to deem the image captured at the time of operating the go-out switch to be the latest image of the fridge interior.

Though not employed in the present embodiment, condition 2 may be employed to capture the image of the fridge interior when there is a possibility that the status of food storage may change. It is thus, possible to acquire image of the fridge interior which is close to the latest image. In such case, the view of the image capturing camera 18 may blur due to instability while the right-side door 3*b* is open. However, it is possible to reduce the image blur by capturing the image at the moment when the right-side door 3*b* is opened and by the illuminance provided by in-fridge lighting illuminated when the door is opened.

When capturing image of the fridge interior by the image capturing camera 18, the refrigerator 1 controls (organizes) the image capturing environment by illuminating the image capturing light 19 for lighting the fridge interior. It is thus, possible to secure source of light even when the door is closed and thereby allow image of the fridge interior to be visibly captured.

Among the lighting units such as the ceiling light 13, the image capturing light 19, and the side light 36 provided in the fridge interior, the refrigerator 1 illuminates the image capturing light 19 for lighting a specific location (in this case, the image capturing location, in particular). When capturing images using the image capturing camera 18, light may directly enter the view of the image capturing camera 18 to create a back light depending upon the relative positioning of the image capturing camera 18 and the lighting units provided in the fridge interior. In such case, the lighting unit, such as the image capturing light 19, for lighting a specific location which does not create a back light during image capturing may be illuminated for example instead of illuminating all of the lighting units. As a result, it is possible to capture images with improved clarity. More specifically, when a lighting unit is provided in the rear surface side so as to confront the image capturing camera 18 for example, at least the lighting unit creating the greatest degree of back light may be unlit while illuminating other lighting units (such as the ceiling light 13).

Because the image capturing light 19 is not disposed at a location to confront the image capturing camera 18 and is oriented in the direction in which the view of the image capturing camera 18 is oriented. Thus, light coming from the image capturing light 19 does not create a back light. As a result, it is possible to check the status of the fridge interior in detail.

The image capturing light 19 requires some amount of distance in order to establish a view for capturing an image of the fridge interior. Since the image capturing camera 18 is provided on the door of the refrigeration chamber 3, it is possible to secure sufficient distance between the image capturing camera 18 and food stored on the shelves 11, etc. and establish a large view.

Because the image capturing camera 18 is provided on the inner plate 14 of the right-side door 3*b*, it is possible to capture an image of the fridge interior even when the door is closed.

Since the image capturing camera 18 is provided near the vertical center and near the lateral center of the refrigeration chamber 3 while also employing a wide-angle lens, the image capturing camera 18 is capable of capturing the image of substantially the entirety of the refrigeration chamber 3 interior as viewed from the vicinity of the central portion of the fridge interior (which is close to the view available to the user when the user normally looks into the refrigerator 1). Because the shelves 11 are made of a transparent material, it is possible to visibly capture an image of food placed on the uppermost shelf 11 through the shelves 11.

The door pocket 9*b* located adjacent to the image capturing camera 18 is shaped so that one side proximal to the image capturing camera 18 extends in a direction to avoid the image capturing camera 18. It is thus, possible to secure sufficient lateral view in the image capturing camera 18 employing a wide-angle lens. Because the image capturing camera 18 is provided in a location adjacent to the door pocket 9*b*, the vertical view is not blocked by the door pocket 9*b*.

Because the image capturing camera 18 is disposed at a location capable of capturing an image of at least some of the door pockets 8 to 10, it is possible to capture an image of food stored in door pockets 8 to 10 to allow food stored in the fridge interior to be checked more elaborately. The door pocket 9*b* of the present embodiment disposed adjacent to the image capturing camera 18 need not be visible (image need not be captured for the same). The above described locationing of the image capturing camera 18 offers similar effects when applied to a removable camera later described in a second embodiment.

The communication terminal 103 is provided with a display portion configured to display images and is capable of acquiring images of the fridge interior captured by the above described refrigerator 1 and displaying the same on the display portion. It is thus, possible to check the status of the fridge interior from a remote location such as outdoors.

The home appliance network system 100 provided with the refrigerator 1, the communication terminal 103, and the server 104, provided with the storage unit for storing images of the fridge interior captured by the refrigerator 1. The communication terminal 103 establishes connection with the server 104 via the communication line 102 and acquires and displays images of the fridge interior stored in the server 104. It is thus, possible to check the status of the fridge interior from a remote location for example from outdoors. Since the images are stored in the server 104, a large volume storage portion need not be provided in the refrigerator 1 side, thereby preventing increase in the cost of the refrigerator 1. Since the communication terminal 103 acquires images from the server 104, it is not required to keep the control portion 50 of the refrigerator 1 in a communicable state. It is thus, possible to inhibit increase of power consumption in the refrigerator 1 side.

It is further possible to check the fridge interior from a remote location by executing the in-fridge image displaying program from the communication terminal 103. The in-fridge image displaying program executes the image acquiring process (steps B1 and B4 of FIG. 10) for acquiring image information of the storage chamber interior captured by the image capturing camera 18, the display process (step B5 of FIG. 10) for displaying image information acquired in the image acquiring process, and an image capturing process (step B2 and B3) for capturing images of the fridge interior through the image capturing camera serving as the image capturing unit by outputting instructions for capturing images of the fridge interior.

Second Embodiment

A description will be given hereinafter on a second embodiment with reference to FIGS. 13A to 25. Since the configuration of the refrigerator 1 is substantially identical to the configuration of the first embodiment, a description will be given with reference to FIG. 2, etc. as well.

As illustrated in FIGS. 13A and 13B, a door pocket 200 (one example of a refrigerator door pocket) of the present embodiment is provided with a storing portion 201 for storing items and a holding portion 202 for holding a camera device 300. The door pocket 200 functions as a refrigerator door pocket and a refrigerator holder recited in the claims. The holder 200 may be considered as one example of a receiving portion for mounting the image capturing unit. From the standpoint of the storage portion 201, the door pocket 200 may be described as being provided adjacent to the camera device 300 (i.e. the image capturing unit) held by the holding portion 202.

The storing portion 201 is provided with a wall 203 disposed in the holding portion 202 side which extends obliquely away from the holding portion 202. That is, the door pocket 200 is formed into a shape extending along the outer edge of the view of the camera device 300 so as not to block its view when the camera device 300 is held by (attached to) the holding portion 202.

The upper side (the upper side as viewed in FIG. 13A) of the holding portion 202 of the present embodiment is shaped like an open box and the camera device 300 is taken in and out (attached/detached) from the upper side opening. Further, a wall 204 provided in the front surface side of the holding portion 202 (that is, the side facing the fridge interior) has a notch 205 formed at a location where a lens 301 and an image capturing lamp 302 (See FIG. 15, etc. examples of a camera side light unit and lighting unit) are located when the camera device 300 is held. Thus, the view of the camera device 300 is unblocked and reflection of lighting is prevented.

Further, the holding portion 202 is provided with a magnet 206. The magnet 206 is arranged so that one side of the magnet 206 facing the back side of the camera device 300 is the N pole or the S pole. The polarity of the magnet 206 will be detailed when describing the structure of the camera device 300.

The door pocket 200 is mounted on the inner plate 14 of the right-side door 3*b* as illustrated in FIG. 14. Thus, the view of the camera device 300 faces the fridge interior (refrigeration chamber 3) when the right-side door 3*b* is closed. The camera device 300 is held by the holding portion 202 so that the center of the lens 301 is located on the intersection of line CL1 running through the lateral center of the refrigeration chamber 3 and line CL2 running through the vertical center of the refrigeration chamber 3. That is, the camera device 300 disposed in this state has a view centering on the central portion of the refrigeration chamber 3. More specifically, the door pocket 200 is configured so that the bottom portion of the holding portion 202 is slightly lower than the bottom portion of the storing portion 201 in consideration of the location where the door pocket 200 is mounted and the shape of the camera device 300 so that the central portion of the lens 301 is located at the optimal position.

As illustrated in FIGS. 15 and 16, the camera device 300 is provided with the lens 301 and the image capturing lamp 302 which are exposed on a surface of body 303 formed into a generally cuboid shape. The surfaces of the lens 301 and the image capturing lamp 302 may be covered by a cover, etc. instead of being exposed in a naked state. A wide-angle lens is employed in the present embodiment as well.

A description will be given hereinafter with an assumption that one side (the right side in FIG. 16) of the camera device 300 in which lens 301 and the image capturing lamp 302 are provided is the front surface and the opposite side is the rear surface. Further, as illustrated in FIG. 13, the orientation in which the lens 301 and the image capturing lamp 302 are disposed along the up and down direction of the refrigerator 1 is referred to as the vertical orientation and the orientation in which the lens 301 and the image capturing lamp 302 are disposed along the left and right direction of the refrigerator 1 as illustrated in the later described FIG. 20 is referred to as the landscape orientation.

As illustrated in FIG. 16, the camera device 300 contains a control substrate 304, a battery 305, a communication module 306, and a detecting portion 307 inside the body 303. The control substrate 304 is provided with: an image capturing portion 308 (see FIG. 21) including the lens 301, an image capturing element not illustrated, etc.; the image capturing lamps 302, two in the present embodiment; and a control portion 309 (see FIG. 21) for controlling the foregoing components. The image capturing element is a known image capturing element such as a CCD, CMOS, or the like, which, in this example, exhibits a rectangular shape. In the present embodiment, the lengthwise direction of the image capturing element is oriented in the up and down direction (that is, the vertical direction of the body). Thus, when capturing images of the refrigeration chamber 3 formed in a vertically elongated shape, the image capturing element can, in general, be oriented along the vertically elongated shape by orienting the camera device 300 in the vertical direction. When capturing an image of the vegetable chamber 4 formed in a laterally elongated shape as later described, the image capturing element can be oriented along the laterally elongated shape by orienting the camera device 300 in the landscape direction. Further, an LED is employed as the image capturing lamp 302 in the present embodiment. Though not illustrated, the camera device 300 is also provided with a power switch.

The battery 305 is configured by a lithium battery which supplies electric power to the control portion 309, the communication module 306, the detection portion 307, and the like. The battery 305 is located on the lowermost portion of the body 303 and occupies substantially the entire area extending in the front and rear direction (the left and right direction as viewed in FIG. 16). The balance of the mounted camera device 300 is somewhat established by disposing the battery 305, being relatively heavy among the components stored in the body 303, in such location. By placing the gravitational center at the lower portion (when oriented in the vertical direction) of the camera device 300, the camera device 300 is prevented from falling out of the door pocket 200, etc. by the centrifugal force, oscillation, etc. exerted by the opening and closing of the door, when the camera device 300 is placed in the door pocket 200 of the right-side door 3*b*. By using the lithium battery, excellent discharge properties can be achieved even in a relatively cool place such as the interior of the refrigerator 1.

As illustrated in FIG. 25, the home appliance network system 500 of the present embodiment is provided with another communication device 501 in the refrigerator 1 side which is different from the communication module 306 of the camera device 300. The communication device 501 allows the refrigerator 1 to receive image capturing instructions from external devices. The communication device 501 is mounted on the refrigerator 1 and the camera device 300 is disposed inside the refrigeration chamber 3. The communication device 501 serves as a fridge-side communication unit configured to receive instructions for capturing an image of the fridge interior (hereinafter also referred to as image capturing instructions) from external devices. In the present embodiment, the communication device 501 is configured as an adapter for wireless communication and is detachably attached to the refrigerator 1. Thus, it is possible for the user to set up the communication device 501 as an optional accessory after purchasing the refrigerator 1. The communication device 501 is capable of communicating with the main control portion 30 of the refrigerator 1 as illustrated in FIG. 21 through wireless communication method or wired communication method. As later described in detail, the refrigerator 1 is sends image capturing instructions (see FIG. 23 which indicates a light flickering signal in the present embodiment) to the camera device 300 when receiving an image capturing instructions.

The communication module 306 of the camera device 300 is configured to be communicable with the router 101 and transmits image information to the communication terminal 103 and the server 104. The communication module 306 serves as a camera-side communication unit configured to transmit image information of the fridge interior captured by the camera device 300 to external devices such as the communication terminal 103 and the server 104 (see FIG. 1). The communication module 306 is provided along the wall in the rear surface side (outermost edge side) of the body 303 of the camera device 300. The antenna not shown installed in the communication module 306 is disposed so that other components, etc. do not intervene the body 303 and the antenna. As a result, transmission of electronic waves to and from the antenna is inhibited from being interrupted (communication failure is inhibited). Further, the communication module 306 is disposed in the vertical direction with respect to the battery 305 so that the antenna and the battery 305 do not confront each other.

The front surface of the right-side door 3*b* of the refrigerator 1 is formed of a glass material as described above. Thus, electric waves for wireless communication outputted from the camera device 300 disposed in the fridge interior is allowed to permeate more easily through the door as compared to metal plate, or the like. Further, the camera device 300 is disposed in the holding portion 202 (that is, the opening end side of the right-side door 3*b*) of the door pocket 200. Thus, especially in a double door configuration as is the case in the present embodiment, it is possible to let out the electric waves from the clearances between the doors. Further, by disposing the camera device 300 in the holding portion 202, it becomes easier to propagate the electric waves coming from the camera device 300 even when the front surface of the door is made of metal material, etc. for example. Because urethane is filled inside the door, there is a small possibility of the electric waves being blocked.

A vacuum thermal insulation material may be used instead of urethane or with urethane to serve as a thermal insulation material of the refrigerator 1. The vacuum insulation material is formed into a thin rectangular plate by wrapping a core material with glass fiber, etc. with a film formed by adhering (laminating) a metal foil (aluminum foil for example) on a film made of synthetic resin for example. The vacuum thermal insulation material is used inside the body and the doors of the refrigerator 1; however, when the camera device 300 is disposed in the door pocket 200, the vacuum insulation material may be provided for example so as to avoid the portion corresponding to the holding portion 202 so as to facilitate propagation of electric waves.

For example, the vacuum thermal insulation material may be provided in the right-side door 3*b* so as to avoid the projected surface (especially the portion of the communication module) of the camera device 300; whereas in the left-side door 3*a* and door 7*a* of the lower freezer 7 in which the camera device 300 is not provided, their entire surface may be provided with the vacuum thermal insulation material and thereby facilitate propagation of electric wave without degrading the thermal insulativity of the refrigerator 1. The glass plate 3*b*1 described above may be reinforced or a metal material for mounting the camera device 300 may be provided on the door using a magnet as illustrated in FIG. 29 later described. It is possible to facilitate propagation of electric waves by disposing them in appropriate locations as was the case with the vacuum thermal insulation material.

The structure for facilitating the propagation of electric waves from the fridge interior is especially useful in a configuration in which the communication module 306 is provided in the camera device 300 disposed inside the refrigerator 1 and the captured image information is transmitted directly to external devices from the camera device 300 (that is, in a configuration in which the camera device 300 transmits image information without the intervention of the communication device 501 of the refrigerator 1) as is the case in the present embodiment.

Next, a description will be given on the polarity of the magnet 206 described above.

As illustrated in FIG. 17, the magnet 206 is provided in a location of the holding portion 202 corresponding to the detecting portion 307 in the rear surface of the camera device 300. Thus, when the camera device 300 is held by the holding portion 202, the detecting portion 307 confronts the magnet 206 and is placed in close proximity of the magnet 206. In such case, the magnet 206 is disposed so that the N pole side of the magnet 206 faces the camera device 300. Thus, the detecting portion 307 detects the strength of magnetic field produced by the N pole.

The polarity of the magnet 206 is oriented in the above described manner because the camera device 300 is also designed to be placed in other locations besides the refrigeration chamber 3 such as the vegetable chamber 4. As illustrated in FIG. 18, the vegetable chamber 4 is structured so that a rail member 4*b* is mounted on the door 4*a* and a vegetable chamber box 4*c* is mounted on the rail member 4*b*. A refrigerator holder 400 illustrated in FIGS. 19A-19B is employed in the present embodiment in order to capture an image of the above described vegetable chamber 4 using the camera device 300. The refrigerator holder 400 is provided with a holding portion 401 configured to hold the camera device 300, an engagement portion 402 configured for mounting the holding portion 401 on the vegetable chamber box 4*c*. The holding portion 401 is formed in a shape to allow the camera device 300 to be held in a landscape orientation and is provided with a front wall 403 located in the front surface side thereof that is formed in a height that does not block the view of the lens 301.

A magnet 405 is provided in a location of a rear wall 404 of the holding portion 401 corresponding to the rear surface of the camera device 300. The magnet 405 is disposed so that the S pole side of the magnet 405 faces the camera device 300. Thus, when the refrigerator holder 400 is mounted on the vegetable chamber 4 as illustrated in FIG. 20 and the camera device 300 is held by the holding portion 401, the camera device 300 is held in the landscape orientation and the detecting portion 307 confronts the magnet 405 as was the case illustrated in FIG. 17.

The detecting portion 307 detects the strength of magnetic field produced by the S pole.

As described above, the polarities of the sides of the magnet 206 and magnet 405 confronting the camera device 300 are opposite of one another. Thus, the detecting portion 307 of the camera device 300 detects different magnetic field levels when the camera device 300 is installed in the refrigeration chamber 3 and in the vegetable chamber 4. Stated differently, the camera device 300 is capable of detecting the storage chamber in which it is placed. Further, the camera device 300 is capable of judging whether the refrigerator 1 in which it is placed is eligible for its operation through detection of magnetism. That is, the magnet 206 and the magnet 405 serves as one example of a detection subject unit recited in the claims.

Next, a description will be given on the electrical configuration of the camera device 300.

As illustrated in FIG. 21, the camera device 300 is provided with a control portion 309. The control portion 309 is configured by a microcomputer including components such as a CPU 309*a*, ROM 309*b*, RAM 309*c*, RTC 309*d*, etc. and serves as one example of the camera-side control unit responsible for overall control of the camera device 300. More specifically, the control portion 309 executes a control of the timing of image capturing carried out by the image capturing portion 308 provided with the lens 301, the image capturing element, etc.; a control for preparing image capturing environment using the image capturing lamp 302 (illumination control) at the time of image capturing; a control for transmission of image information, receiving a later described instructions, etc. carried out by the communication module 306; and a control for judging and identifying the installation status by the detecting portion 307. In the present embodiment, the control portion 309 is also configured to execute image processing in which the captured image is corrected, etc.

First a description will be given on the control of judgment and identification of installation status executed by the detecting portion 307. The detecting portion 307 is provided with a temperature sensor 310, a magnetic sensor 311, an acceleration sensor 312, and an illuminance sensor 313. The control portion 309 judges which of the storage chambers the camera device 300 is installed by detecting the outside temperature using the temperature sensor 310. A description will be given hereinafter on how the judgment is made in more detail.

The temperature sensor 310 detects the temperature of the place in which the camera device 300 is installed. The temperature sensor 310 increases its output in proportion to the increase in the temperature as illustrated in FIG. 22A. Generally, there is approximately 11 to 19 degrees Celsius of difference between the temperature of the refrigeration chamber 3 and the temperature of the lower freezer 7. Thus, a reference temperature serving as a reference may be specified and if the detected temperature is greater than the reference temperature, a judgment is made that the place of installation is the refrigeration chamber 3, whereas if the detected temperature is less than the reference temperature, a judgment is made that the place of installation is the lower freezer 7. When a judgment is made that the place of installation is the lower freezer 7, there is a risk of failure, etc. thus, the image capturing lamp 302 may be illuminated or an audio output unit such as a buzzer may be provided to output a sound alert that the place of installation is an unintended place or such alert may be transmitted to the refrigerator 1 side through the communication module 306 and presented to the user through the touch panel 33, etc. of the refrigerator 1. The camera device 300 determines its place of installation based on the temperature detected by the temperature sensor 310.

The magnetic sensor 311 detects the magnetic fields produced by the magnet 206 and magnet 405 as described above. As illustrated in FIG. 22B, the magnetic sensor 311 varies its output to the positive side (in case of N pole) and to the negative side (in case of S pole) depending upon whether the magnetic field is produced from the N pole or the S pole. That is, when the output of the magnetic sensor 311 is positive (not 0), it is possible to detect that the camera device 300 has been installed in a location confronting the magnet 206 provided in the door pocket 200 of the refrigeration chamber 3, meaning that it is possible to detect that the camera device 300 has been installed inside the refrigeration chamber 3.

When there is temperature difference between the refrigeration chamber 3 and the vegetable chamber 4, a judgment may be made as to whether the place of installation is the refrigeration chamber 3 or the vegetable chamber 4 based on the output of the temperature sensor 310. In either case, it is possible to detect that the camera device 300 has been installed in the storage chamber based on the output of the temperature sensor 310.

When the output of the magnetic sensor 311 is negative (not 0), it is possible to detect that the camera device 300 has been installed in a location confronting the magnet 405, meaning that it is possible to detect that the camera device 300 has been installed inside the vegetable chamber 4. In the present embodiment, the possibility of installing the camera device 300 on the shelf 11, etc. for example (see FIG. 24B) is taken into consideration. When the output of the magnetic sensor 311 is greater than the positive reference value, a judgment is made that the place of installation of the camera device 300 is the refrigeration chamber 3. When the output of the magnetic sensor 311 is less than the negative reference value, a judgment is made that the place of installation of the camera device 300 is the vegetable chamber 4. When the output of the magnetic sensor 311 is close to zero, a judgment is made that the place of installation of the camera device 300 is the shelf 11, etc. which is not provided with a magnet. The judgment of the temperature sensor 310 may be combined to judge whether or not the camera device 300 is stored in the storage chamber.

The acceleration sensor 312 is configured to detect the acceleration (gravitational acceleration) applied to the camera device 300. The acceleration sensor 312 serves as the so-called triaxial sensor configured to detect the acceleration of the three axes namely, the X axis, the Y axis, and the Z axis (see FIGS. 15 and 16). Thus, as illustrated in FIG. 22C, the output varies when the camera device 300 is oriented in the vertical direction, oriented in the vertical direction (reversed in the up and down direction), oriented in the landscape direction, and oriented in the landscape direction (reversed in the left and right direction). It is thus, possible to detect the orientation of the installed camera device 300. The detected orientation of the camera device 300 is used in the later described image processing or may be used in the judging the place of installation of the camera device 300.

Next, a description will be given on the timing of image capturing. The process flow of image capturing is substantially the same as FIG. 6 of the first embodiment and thus a description will be given with reference to FIG. 6 as well. The camera device 300 judges whether a predetermined time period has elapsed or instructions have been received from an external device; that is, a judgment is made as to whether or not image capturing conditions have been met (A1). The camera device 300 judges whether or not the predetermined time period has elapsed by measuring time using RTC 309*d* and whether or not instructions have been received based on the illuminance detected by the illuminance sensor 313.

The illuminance sensor 313 configuring the detecting portion 307 detects the illuminance of the place where the camera device 300 has been installed. In the present embodiment, the illuminance sensor 313 informs the control portion 309 when detecting an illuminance approximating the illuminance of the in-fridge lighting being turned on. Further, the refrigerator 1 of the present embodiment, in which the camera device 300 is installed, flickers the in-fridge lighting such as the ceiling light 13 according to a predetermined flickering pattern when receiving instructions for image capturing from an external device. The image capturing instructions is issued in the similar manner as steps B2 to B4 of the terminal-side process indicated in FIG. 10 of the first embodiment when issued for example by the communication terminal 103.

The flickering pattern informs the image capturing timing to the camera device 300, being detachably attached to the refrigerator 1, and is preset. That is, the refrigerator 1 alerts the image capturing instructions to the camera device 300 by flickering the in-fridge lighting. This is realized by providing the configuration to judge whether or not the refrigerator 1 is eligible for image capturing operation (that is, whether or not the refrigerator is capable of flickering the in-fridge lighting) and the configuration to cause the camera device 300 to identify whether or not the refrigerator is eligible for image capturing operation as described above. That is, the in-fridge lighting being capable of flickering is an indication that the refrigerator 1 is eligible for operation of the camera device 300.

The camera device 300 is normally placed in a power save mode known as a sleep mode, etc. as indicated by period T1 in FIG. 23 during which period the illumination sensor is in operation. The refrigerator 1 flickers the in-fridge lighting according to a predetermined flickering pattern when receiving instructions from an external device as described above. The illumine tion of the in-fridge lighting causes the illuminance sensor 313 to report (input of interruption signal, etc.) to the control portion 309 to place the control portion 309 in an operating state. That is, a judgment is made that the image capturing conditions have been met when the in-fridge illumination has flickered in a predetermined flickering pattern. The flickering pattern may be of any pattern which may be specified by the ON/OFF period and the times of repeating such period, etc.

When judging that the image capturing conditions have been met (A1: YES), the camera device 300 illuminates the image capturing lamp 302 (A2), captures the image of the fridge-interior (A3), and transmits the image information to the server 104, etc. (A4).

The refrigerator 1 may illuminate the in-fridge lighting even in the absence of instructions. For example, the in-fridge lighting is illuminated in a non-flickering pattern (in a continuous illumination) when the door has been opened by the user as in period T2 indicated in FIG. 23. In this case, the camera device 300 is temporarily placed in an operating mode since the in-fridge lighting has been illuminated. However, the camera device 300 is returned to the standby mode since the predetermined flickering pattern is not followed, that is, the image capturing conditions have not been met.

When a predetermined period has elapsed, for example when a preset image-capturing time interval has elapsed as indicated by period T3 in FIG. 23, from the previous (period T1) image capturing, the camera device 300 makes a judgment that the image capturing conditions have been met (A1: YES), is placed in the operating mode, illuminates the image capturing lamp 302 (A2), captures the image of the fridge-interior at that point in time (A3), and transmits the image information (A4).

As described above, the camera device 300 captures an image of the fridge interior based on whether the predetermined period has elapsed and whether instructions have been given by an external component (presence of user's intent). The user is allowed to check the status of the fridge interior as illustrated in FIGS. 24A to 24C depending upon the place where the camera device 300 has been installed. Multiple camera devices 300 may be provided; for example, one in the refrigeration chamber 3 and one in the vegetable chamber 4.

In the present embodiment, the camera device 300 does not merely capture images of the fridge interior but also executes image processing such as image conversion. The camera device 300 may be oriented in the vertical direction or the landscape direction as described above in which case the image is rotated by 90 degrees (or 270 degrees). Thus, the camera device 300 executes image conversion before the images are transmitted to the server 104. As a result, images with uniform vertical orientations looking like the view available when the user directly checks the refrigerator 1 can be displayed on the communication terminal 103 even when the camera device 300 is oriented differently as illustrated in FIGS. 24A and 24B or 24C.

Further, because the lens 301 is a wide-angle lens, the central portion of the captured image may be distorted as illustrated in FIG. 7 of the first embodiment. Thus, the camera device 300 is configured to correct the distortion by image processing. More specifically, an image processing is carried out so that the ratios of the central portion and upper and lower edge of the image match. As a result, it is possible to display images having little distortions as illustrated in FIG. 24A. The orientation of the image and the orientation of the camera device 300 may be transmitted as image information and image processing may be executed at the server 104 or the communication terminal 103. It is possible to reduce power consumption of the camera device 300 by executing the image processing at the external device side. Such arrangement is meaningful for the camera device 300 which does not possess means for supplying power from external sources.

The present embodiment described above provides the following effects in addition to (or instead of) the effects of the first embodiment. Some users wish to check the interior of the refrigerator 1 from remote locations such as outdoors. It is possible to check the fridge interior by acquiring images of the fridge interior using the communication terminal 103 from outdoors since the image capturing portion 308 (image capturing unit) for capturing images of the fridge interior and the communication module 306 (communication unit) for transmitting image information of the fridge interior acquired using the image capturing portion 308 to external devices such as the server 104 are provided in the refrigerator 1.

When capturing images of the fridge interior, repeating unnecessary image capturing will increase power consumption, cause battery shortages, and storage of unnecessary (redundant images) to the server 104. It is possible to reduce such concerns by controlling the timing in which the in-fridge images are captured by the control portion 309 of the camera device 300.

More specifically, there is a possibility that the user's family may take out food from the refrigerator 1, etc. when predetermined time period has elapsed. It is thus, possible to prevent unnecessary image capturing from being repeated by capturing images of the fridge interior at the timing when the predetermined period has elapsed, that is, when there is a possibility that the status of food storage may have changed.

Further, capturing an image of the fridge interior at the timing when instructions from the user have been received will allow the user to be updated with the latest storage status. Thus, by refraining from capturing images at the timing when a predetermined time period has elapsed, stated differently, by capturing images only when instructed by the user will eliminate unnecessary image capturing and thereby further reduces power consumption. As described earlier, image may be acquired when the storage status has changed by incorporating the image capturing conditions of the first embodiment.

Some users may not need to check the status inside the refrigerator 1. The camera device 300 provided with the image capturing portion 308 for capturing images of the fridge interior and the communication module 306 for transmitting image information of the fridge interior captured by the image capturing portion 308 to external devices such as the sever 104 is configured to be detachably attached to the refrigerator 1. Thus, users who do not need to check the status inside the refrigerator 1 may remove the camera device 300. Further, users who did not feel the need to check the status inside refrigerator 1 when purchasing the refrigerator 1 but has later felt such need will be able to check the status inside the refrigerator 1 by simply adding the camera device 300.

Because the communication device 501 is also configured to be detachably attached, users who do not need to check the status of the fridge interior may remove the same as was the case in the camera device 300 to reduce power consumption while also allowing the user to add the same at a later time.

A light source is required for image capturing. Because the image capturing lamp 302 (camera-side lighting unit) for illuminating the fridge interior is provided to the camera device 300, it is possible to capture the image of the fridge interior by the camera device 300 alone. Needless to say, the fridge interior may be illuminated through cooperation with the refrigerator 1.

Image capturing of the fridge interior may not be successful as it may be difficult to obtain a clear view depending upon where the camera device 300 is installed. It is thus, important to find a suitable place for image capturing. It is possible to install the camera device 300 in a location where the image of the entire refrigeration chamber 3 can be captured for example by providing a receiving portion (examples of which are holding portion 202 of the door pocket 200 and holding portion 401 of the refrigerator holder 400 in the embodiments) for mounting the camera device 300 to the refrigerator 1.

If it is not possible to flicker the in-fridge lighting as described above, it will not be possible to issue image capturing instructions from external components. By implementing a configuration in which magnetisms of the magnet 206 and the magnet 405 are detected by detecting portion 307, that is, by providing a detection subject unit for detecting that the refrigerator 1 is eligible for image capturing (image capturing is permitted) using the camera device 300, it is possible to reduce such concerns.

The communication module 306 may be configured to communicate with the refrigerator 1 side so that the communication module 306 serves as the detecting unit (in which case the communication device 501 serves as the detection subject unit). The communication module 306 may be used as an identifying unit for identifying whether or not the camera device 300 has been designed for use in the refrigerator 1 (for example designed to capture images by flickering the in-fridge lighting).

In the embodiment described above, the camera device 300 is driven by the battery 305 (meaning that when installed to the refrigerator 1, the camera device 300 is driven without power supply from external components). It is thus, preferable to reduce electricity consumption as much as possible. It is possible to reduce electricity consumption originating from wireless communication by making the communication module 306 communicate with the communication device 501 as compared to the electricity consumption resulting from the wireless communication between the communication module 306 and external components.

When configured to receive instructions from external devices, the communication unit needs to operate continuously to standby for the instructions. However, by configuring the communication device 501 to receive the instructions, it is no longer necessary to maintain the continuous operation of the communication module 306 and thereby extend the battery life.

The communication device 501 may be configured to receive supply of power from the refrigerator 1 side by wire communication such as USB. As a result, unnecessary supply of power need not be provided in the absence of the communication device 501 and when the communication device 501 is provided it may for example be arranged to operate continuously.

When the camera device 300 is configured to be detachably attachable, it may be more convenient when a wireless communication is employed. However, when instructions are received by the communication device 501, such instructions need to be somehow transmitted to the camera device 300. Thus, the illumination sensor 313 is provided to the camera device 300 so that the image capturing instructions are transmitted indirectly to the camera device 300 by flickering the in-fridge lighting. It is thus, possible to notify image capturing timing to the camera device 300 employing wireless communication. Since such arrangement only requires the camera device 300 side to keep the illuminance sensor 313 in an operating state, it is possible to reduce power consumption compared to keeping the communication module 306 in an operating state.

The front surface of the right-side door **3*b* in which the camera device 300 is provided is formed of a nonmetallic material. It is thus, possible to facilitate propagation of electric waves to the fridge exterior even when the camera device 300 as well as the communication module 306 are disposed inside the refrigeration chamber 3 tightly closed by the right-side door 3*b*. The same is true when the camera device 300 is disposed at the vegetable chamber 4**.

For example, the refrigeration chamber 3 is generally elongated in the vertical direction and the vegetable chamber 4 is generally elongated in lateral direction. Thus, when there are multiple storage chambers, the view of the camera device 300 is preferably switched depending upon the storage chamber. The user may feel uncomfortable when the image is oriented sideways. Thus, it is preferable to provide images with uniform vertical orientations looking like the view available when the user checks the refrigerator 1 in person. Thus, the magnet 206 and the magnet 405 are provided the sides of the magnet 206 and magnet 405 confronting the camera device 300 are opposite of one another. As a result, it is possible to learn where the camera device 300 is installed (the mounting positions predetermined by the manufacturer, etc. which correspond to the holding portion 202 or the holding portion 401) and thereby allowing the orientation of the camera device 300 to be judged in such locations of installation. The holding portion 202 and the holding portion 401 are formed so that the camera device 300 is oriented vertically when installed in the refrigeration chamber 3 and oriented in the landscape direction when installed in the vegetable chamber in the present embodiment so that camera device 300 is installed in different orientations depending upon the storage chamber. As a result, appropriate view can be obtained depending upon the storage chamber and proper judgments can be made as to the direction in which the images need to be rotated in the image processing.

It is possible to: determine the orientation of the camera device 300 based on the orientation of the acceleration detected by the acceleration sensor 312, and determine where the camera device 300 is installed depending upon the temperature detected by the temperature sensor 310.

The camera device 300 may malfunction, etc. when inadvertently installed in the freezer. However, the possibility of malfunctioning, etc. can be reduced by detecting the temperature through the temperature sensor 310 or by allowing an alert to be issued as is the case in the present embodiment.

Capturing an image of the fridge interior using the camera device 300 requires the camera device 300 to face the front side of the fridge interior with some amount of distance in order to establish a view. However, the mounting position in the front side in the refrigerator 1 is limited by the door. Thus, in order to secure as much distance as possible, the camera device 300 may be mounted on the inner plate 14 of the door. However, the door pocket may block the view in such case. The door pocket 200 of the present embodiment is formed so that the wall 203 avoids the holding portion 202 (receiving portion) and thus, will not block the view of the camera device 300.

Further, because there are suitable places for capturing images of the fridge interior, it is desirable to notify such places to the user. By providing the holding portion 202 (the receiving portion for mounting the camera device 300) for holding the camera device 300 such as the door pocket 200, it is possible to noticeably indicate such places to the user. The holding portion 202 is formed so that when the camera device 300 is held by the holding portion 202, the view of the camera device 300 is located at the center of the refrigeration chamber. It is thus, possible to capture the image of substantially the entirety of the fridge interior. The center of the refrigeration chamber is established when the camera device 300 is installed in the holding portion 202. Thus, when correcting image distortion in the image processing, the center position of the subject of correction coincides with the center position of the image. As a result, equal amount of correction can be applied centering on such center position in correcting the distortion, thereby reducing the computation load in the image processing.

The door pocket 200 is provided with the magnet 206 serving as the target of detection of the magnetic sensor 311. It is thus, possible to allow the camera device 300 to identify the place of its installation.

The refrigerator 1 is provided with the vegetable chamber 4, etc. However, the vegetable chamber 4 is not provided with a door pocket and is formed in the shape of a box. Thus, the camera device 300 may become covered by vegetables, etc. stored therein when simply installed in the vegetable chamber 4. Thus, the camera device 300 may be installed in the vegetable chamber 4 by using a refrigerator holder 400 provided with a holding portion 401 for holding the camera device 300. The holding portion 401 is provided with an engagement portion 402 for engaging the holding portion 401 on the edge, etc. of the vegetable chamber box 4*c*. It is thus, possible to install the camera device 300 in the upper side of the vegetable chamber 4 and in the door 4*a* side to allow an image of the vegetable chamber to be captured without being covered by vegetables, etc. Because the holding portion 401 is engaged by the engagement portion 402, the holding portion 401 can be readily removed when not needed.

Because the magnet 405 is also provided on the refrigerator holder 400, the camera device 300 is allowed to judge where it has been installed as described above. The effects of the home appliance network system 500 and the in-fridge image displaying program are the same as those of the first embodiment.

Third Embodiment

Next, a description will be given on a third embodiment. The present embodiment is based upon a recess being provided in the fridge interior for disposing an image capturing camera serving as one example of an image capturing unit therein. That is, the present embodiment is discusses a recess exemplified as cavity 600 later described in detail. In the embodiments described above, an example was discussed in which an image capturing unit was provided on the inner surface of the door serving as one example of a side surface of the fridge interior. In the present embodiment, an example will be discussed in which an image capturing unit is provided on an inner side surface of a storage chamber serving as one example of a side surface of the fridge interior.

As illustrated in FIGS. 26 and 27 for example, a storage chamber 701 of a refrigerator 700 is provided with a vertically elongate recess 702 caving toward the fridge exterior and extending in the up and down direction. The recess 702 is provided on both of the left and right side surfaces of the storage chamber 701 interior. Further, as illustrated in FIG. 28 for example, the recess 702 is provided in a location of the storage chamber 701 interior which does not interfere with door 703 when the door 703 is closed. Thus, the recess 702 is not covered by a thermal insulation wall 704, a door pocket 705, etc provided on the door 703 when the door 703 is closed.

The recess 702 stores an image capturing camera 706 serving as one example of the image capturing unit and a lighting LED 707 serving as one example of a lighting unit. The lighting LED 707 is provided for lighting the storage chamber 701 interior When capturing an image of the storage chamber 701 interior using the image capturing camera 706. The lighting LED 707 is provided as a separate element from an in-fridge light 708 configured to light the storage chamber 701 interior.

As illustrated in FIG. 29 for example, a substrate 709 is provided inside the recess 702. The lighting LED 707 is implemented on the substrate 709. The substrate 709 basically is a substrate used for lighting purposes. In the present embodiment, the image capturing camera 706 is mounted on the lighting substrate 709. That is, the lighting substrate 709 also serves as a substrate for image capturing purposes. Thus, the image capturing camera 706 and the lighting LED 707 are implemented on the same substrate 709. As illustrated in FIG. 30 for example, the image capturing camera 706 may be disposed further inward toward the chamber interior within the recess 702 as compared to the lighting LED 707. Though not illustrated, the image capturing camera 706 may be disposed further outward toward the chamber exterior within the recess 702 as compared to the lighting LED 707.

Multiple image capturing cameras 706 and multiple lighting LEDs 707 are provided in the recess 702. Each of the image capturing cameras 706 in the recess 702 is disposed between two lighting LEDs 707 located thereabove and therebelow. Each of the lighting LEDs 707 are disposed between two image capturing cameras 706 disposed thereabove and therebelow.

A protection cover 710 made of resin for example is detachably attached to the recess 702 serving as a "lid" to cover the recess 702. Protrusions and retractions are formed on portions of the protection cover 710 confronting the lighting LEDs 707. The projection and retractions cause the light radiated by the lighting LEDs 707 to be scattered into the fridge interior. Projections and retractions are not formed on the portions of the protection cover 710 confronting the image capturing cameras 706. Thus, the image capturing cameras 706 are allowed to capture clear images of the fridge interior without being interrupted by the projections and retractions of the protection cover 710.

As illustrated in FIG. 26 for example, the image capturing cameras 706 are preferably provided at a different height from the shelves 711 provided in the storage chamber 701 interior. The lighting LEDs 707 are also preferably provided at a different height from the shelves 711. As illustrated in FIG. 31 for example, a gloss T is provided on the front portion (front end portion) of the shelf 711. FIG. 31 represents the gloss T in hatching. The gloss T is provided for example, by attaching a glossy member or by applying a gloss coating. Irradiation direction D1 of the lighting LED 707 is not directed to the front portion of the shelf 711. Thus, it is difficult for the light irradiated from the lighting LED 707 to reflect by the gloss T.

As illustrated in FIG. 26 for example, the image capturing camera 706 is provided between a door pocket 705 provided on the door and the shelf 711. Further, the image capturing camera 706 is located forward relative to the shelf 711 provided in the fridge interior. As illustrated in FIG. 32, the image capturing camera 706 may be disposed so as to be oriented toward the shelf 711.

Further, as illustrated in FIG. 33 for example, the image capturing camera 706 is preferably located so that the sidewall of the recess 702, especially the front sidewall and the rear sidewall are outside view R of the image capturing camera 706. Further, as illustrated in FIG. 34, the image capturing camera 706 is preferably installed at an angle that does not direct itself toward the sidewalls of the recess 702, especially the front sidewall and the rear sidewall. Still further, the recess 702 is preferably shaped so as to be narrow in the bottom portion located toward the fridge exterior and wide in the opened portion located toward the fridge interior. In this example, the sidewalls of the recess 702 become gradually wider toward the fridge interior. As a result, it is possible to achieve a configuration in which the sidewalls of the recess 702 are not easily visible within view R of the image capturing camera 706.

As illustrated in FIG. 35 for example, the image capturing camera 706 is preferably oriented in the direction of irradiation direction D1 of the lighting LED 707. Further, as illustrated in FIG. 36 for example, view angle $\alpha$ of the image capturing camera 706 and may be configured to be different from irradiation angle $\beta$ of lighting LED 707. The view angle $\alpha$ of the image capturing camera 706 is preferably smaller than the irradiation angle $\beta$ of lighting LED 707. As a result, it is possible to irradiate the entirety of view R of the image capturing camera 706 by the lighting LED 707.

Further, when the lighting LED 707 located in the recess 702 serving as the storing portion is oriented obliquely with respect to the bottom surface (or the surface in the fridge exterior side) of the recess 702 or with respect to the surface of the sidewall of an inner box shaping the storage chamber, such oblique direction is preferably adjusted so as not to cross the front sidewall or the rear sidewall of the recess 702. As a result, it is possible to prevent light reflecting off of the sidewall to enter the image capturing camera 706 so as not be become a back light.

Further, the orientation angles of the image capturing camera 706 and the lighting LED 707 are preferably different. As a result, the reflected light if any does not easily enter the image capturing camera 706. It is further effective when the image capturing camera 706 is tilted by an angle smaller than the angle in which the lighting LED 707 is tilted. For example, lighting LED 707 is preferably oriented relatively toward the fridge interior and the image capturing camera 706 is oriented relatively away from the fridge interior (toward the door).

Further, when positioning the image capturing camera 706 and lighting LED 707 at different orientation angles, the image capturing camera 706 and lighting LED 707 need not be disposed on the same substrate but may be disposed on different substrates.

Further, as illustrated in FIG. 37 for example, when the refrigerator 700 captures an image of the storage chamber 701 interior using the image capturing camera 706 provided on one of the side surfaces (the left side surface in FIG. 37 for example) of the storage chamber 701 interior, the lighting LED 707 provided on the surface confronting the image capturing camera 706 (the right side surface in FIG. 37) may be turned off. In such case, the orientation direction D2 (image capturing axis serving as the center of image capturing) of the image capturing camera 706 provided on one of the side surfaces and the orientation direction D1 (light axis serving as the center of irradiation, irradiation axis) of the lighting LED 707 provided on the other of the side surfaces so as not to confront one another. As a result, it is possible to realize a configuration in which the light emitted from the lighting LED 707 of the other of the side surfaces does not easily enter the lens of the image capturing camera 706 of the one of the side surfaces, that is, a configuration in which back light is not easily created.

Further, when the refrigerator 700 captures an image of the storage chamber 701 interior using the image capturing camera 706 provided on one of the side surfaces (the left side surface in FIG. 37 for example) of the storage chamber 701 interior, the lighting LED 707 provided on the same surface as the image capturing camera 706 may be turned on. As a result, when capturing an image of the storage chamber 701 interior using the image capturing camera 706 provided on one of the side surfaces, it is possible to irradiate the chamber interior using the lighting LED 707 provided on the same surface as the image capturing camera 706 without creating a back light.

Further, the image capturing camera 706 is preferably provided in a location capable of capturing an image of the door pocket 705 provided on the inner surface of the door 703. For example, the image capturing camera 706 is preferably provided higher above the door pocket 705 at a different height from the door pocket 705 and so as to be angled to allow capturing of an image looking obliquely downward on the door pocket 705. Further, as illustrated in FIG. 38 for example, a notch 704*a* is preferably provided on a thermal insulation wall 704 extending toward the fridge interior from the door 703. According to such configuration, an image of the door pocket 705 can be captured through the notch 704*a* without the image capturing camera 706 being covered by the thermal insulation wall 704.

Further, as illustrated in FIG. 39 for example, the image capturing camera 706 is preferably provided at a location capable of capturing an image of the door pocket 705 provided on the door 703 provided on the opposite side of the image capturing camera 706 when the door 703 is in an opened state.

Further, as illustrated in FIG. 40 for example, the image capturing camera 706 and the lighting LED 707 may be installed in the recess 702 so as to be aligned in a row extending along the up and down direction. The image capturing camera 706 and the lighting LED 707 may alternatively be installed in the recess 702 so as to be laterally displaced from one another.

Further, as illustrated in FIG. 42 for example, a drawable container 720 may be provided in the fridge interior. The image capturing camera 706 may be provided so as to confront the side surface of the container 720 when the container 720 is drawn out (as indicated by broken line in the figure). A dedicated image capturing camera 706 and lighting LED 707 may be provided so as to capture an image of the container 720. As illustrated in FIG. 43, multiple drawable containers 721 and 722 may be provided in the fridge interior and the image capturing camera 706 may be provided at a location capable of capturing images of these containers 721 and 722. Dedicated image capturing cameras 706 and lighting LEDs 707 may be provided for capturing images of each container 721 and 722. The number of containers is not limited to two. Three or more containers may be provided in the fridge interior. In such case, the image capturing cameras 706 are preferably provided at locations capable of capturing images of all the containers.

Further, as illustrated in FIG. 44 for example, the image capturing camera 706 may be provided rearward relative to the front end portion of the shelves 711 in which case the image capturing camera 706 is provided further rearward of the door pocket 706 provided on the door. The image capturing cameras 706 in such case are preferably provided between the shelves 11 disposed one over the other. The image capturing camera 706 located in the upper side of the shelf 711 serves as a dedicated upper image capturing camera (one example of a dedicated upper image capturing camera) capable of capturing an image of the upper side of the shelf 11. The image capturing camera 706 located in the lower side of the shelf 711 serves as a dedicated lower image capturing camera (one example of a dedicated lower image capturing camera) capable of capturing an image of the lower side of the shelf 11.

At least one of the shelves 711 provided in the upper side of the container 720 may be formed of a transparent resin for example to be configured as a transparent shelf. According to such configuration, at least one of the image capturing cameras 706 located in the upper side of the transparent shelf will be allowed to capture an image inside the container 720 through the transparent shelf.

Further, a light intensity detecting substrate, having a light intensity sensor for detecting the light intensity of the fridge interior implemented thereon, may be provided inside the recess 702. The image capturing camera 706 may be implemented on the light intensity detecting substrate. The light intensity detecting sensor may be used as an illuminance sensor for detecting the illuminance of the fridge interior in which case the light intensity detection substrate may serve as an illuminance substrate. The image capturing camera 706 may be implemented on the illuminance detection substrate. These types of substrates are shaped like a card or plate and are mounted in the recess so that both ends thereof are inserted into a receiving portion shaped like a slit provided inside the recess 702.

An image capturing aperture and a light receiving aperture may be provided independently for the image capturing camera 706 and a light receiving portion not illustrated on the protection cover 710 covering the storage chamber side of the recess 702. The wall of the image capturing aperture may be formed obliquely so as not to block the view of the image capturing camera 706.

The light receiving aperture may be provided with a collecting lens, a transparent cover, a camera lens, etc. The image capturing aperture may be provided with a transparent cover for covering the camera device. These lenses, covers, etc. are preferably disposed further toward the recess 702 from the surface of the protection cover 710 so as not to be exposed on the surface of the protection cover 710 and on the surface of the inner box configuring the storage chamber to prevent contamination by finger grease, vegetable crumbs etc. Further, in order to remove the dew condensate developed on the lens and the cover by humidity, the above described apertures may be downwardly sloped to facilitate discharge of the dew condensate (water drops) into the storage chamber or thin trenches may be provided to discharge the dew condensate by capillary action.

Further, the image capturing camera 706 is provided in a location different from the light receiving portion such as the door and the side surface in which the amount of light irradiated from the irradiating unit is restrained. Intrusion of light irradiated from the irradiation unit into the image capturing camera 706 is restrained in such location and thus, it is possible to reduce the possibility of a back light being created.

Further, an image capturing lighting unit for providing lighting during image capturing and irradiation unit for providing irradiation during image capturing may be provided and the intensity and color of light irradiated by the irradiating unit may be configured to differ from those of the image capturing lighting unit. It is thus, possible to prevent detection errors from occurring at the light receiving portion when the image capturing lighting unit has been illuminated.

In such case, the irradiating unit that differs in color is preferably not irradiated when capturing images with the image capturing camera 706. As a result, it is possible to prevent images to be captured in unnatural instances where the image is colored in blue for example. Examples of a first light emitting unit (irradiating unit) such as a blue LED which produces light that is not colored in white include: a visible light catalyzer device configured to provide deodorization.sterilization by exciting a catalyst applied on a filter or a wall by irradiating blue light having a wavelength of substantially 400 nm; a corona discharge device configured to produce ions, radicals (active species), and ozone by emitting bluish white light through air dielectric breakdown; an air dielectric breakdown device such as electrostatic atomizer device configured to produce charged fine particle water containing OH radicals by applying high voltage to a discharge electrode comprising a counter electrode and a liquid, in which the electrode illuminates in bluish white; and an indicator unit being provided in the storage chamber and being configured by green, red, and orange LED, etc. to indicate an operating portion such as an depressing-type operating portion configured to allow the user to control the refrigerator when operated. The first light emitting unit is configured to emit light under predetermined conditions prestored in a program. Thus, it is possible to capture clean (clear) images by invalidating the control to emit light under preset conditions when image capturing (that is, image capturing by the camera is prioritized so that light is not emitted even if the preset conditions are met when capturing images with the camera) and prevent unnecessary light from being captured into the image. The pressing-type operating portion (in-fridge control portion) is preferably provided with a tact switch disposed inside the recess 702 and an operating button on the protection cover 710.

The visible light catalyst device, the corona discharge device, and the electrostatic atomizer device, etc. may be controlled to be driven at predetermined time intervals or in conjunction with the opening/closing of the damper. The indicating unit configured to emit light based on operation of the in-fridge operating portion may be controlled based on whether the in-fridge operating portion has been turned ON/OFF. The second light emitting unit is provided to light a drawer-type chiller chamber, etc. provided in the bottom surface of the refrigeration chamber. The second light emitting unit is configured by an LED producing light in white or other colors. The second light emitting unit is not provided on the lateral and vertical walls and the doors of the refrigerator but in the central portion of the space enclosed by the walls and the doors. Thus, the second light emitting unit is prone to be captured in the image captured by the cameras disposed in the left, right, upper, and lower sides to possibly create a back light. Thus, a control is preferably executed to similarly invalidate or turn OFF the second light emitting unit at the timing of image capturing by the camera or temporarily stop the illumination of the second light emitting unit during image capturing and resume the illumination after image capturing has been completed, etc.

Further, the visible light catalyst may be coated on the surface of a transparent cover covering the image capturing camera 706 and the lens of the camera device which are provided in the image capturing aperture, and on the surface of the protection cover 710 covering the recess 702 to serve as a hydrophilization unit. The lens of the camera or the transparent cover may become fogged by dew condensate when exposed to the storage chamber and cause the captured image to be blurred. A visible light generating unit, serving as the first light emitting unit such as a blue LED and being capable of exciting a catalyst, may be provided inside the recess 702 or outside the recess 702. The visible light generating unit may be configured to irradiate the photocatalyst to activate the surface of the lens, cover, etc. by moisture in the air and be hydrophilicized by OH radical (hydrophilicizer). As a result, dew condensate produced on the surfaces lens and the cover become susceptible to bond into a thin film of water. This makes it difficult for water droplets, producing undulations, to form and thereby allow diffused reflection of light to be inhibited and render the surfaces of the lens, cover, etc. difficult to fog. It is thus, possible to capture fogless clear images with the camera by producing a hydrophilicizer on or exposing the hydrophilicizer to the lens or the transparent cover located in the direction of image capturing of the camera device. The photocatalyst, when being irradiated by light having certain wavelengths, is capable of sterilizing microbes existing in the air and deodorizing odor components (such as organic material) existing in the air by oxidation, degradation. The photocatalyst is also capable of achieving sterilization and deodorization by activating (ionization and radicalization) of components existing in the air. Silver oxide and titanium oxide may be used as a photocatalyst. The blue region of a visible light having a wavelength of approximately 400 nm to 580 nm are used when employing silver oxide (including silver zirconium phosphate). A light emitting diode capable of irradiating light having a wavelength of 380 nm may be used as a light source when employing titanium oxide.

Approximately −6 kV of voltage may be applied between the pointed tip of the charge electrode and the counter electrode of the electrostatic atomizer device. The charge electrode, being made of a metal material, is cooled to obtain a dew condensate of moisture from the air. The dew condensate is electrostatically atomized to obtain charged fine particle water having a particle diameter on the order of nanometers (the distribution of the particle diameter ranging from 3 to 50 nm). As a result, bluish white light is emitted at the tip of the charge electrode. The emission of bluish white light is turned ON/OFF repeatedly at a predetermined interval (5 second interval for example) while voltage is continuously applied. The driving of the electrostatic atomizer device is preferably controlled to be turned ON/OFF repeatedly at predetermined time interval as well. The electrostatic atomizer device may be installed in a cover provided with an outlet so that discharge light is not captured in the image as much as possible. The electrostatic atomizer device may be disposed inside a cover shaped like a duct provided on the ceiling so that discharge light is not captured in the image as much as possible by providing the image capturing camera 706 on a location other than the ceiling such as a door or the left and right side walls that do not face the ceiling. Similar effect may be achieved by disposing the image capturing camera 706 in a storage chamber different from the storage chamber in which the electrostatic atomizer device is provided. Generation of mist may fog the storage chamber interior and render image capturing by the camera difficult. However, it is possible to capture clear images by generating mist formed of fine particle water having a particle diameter on the order of nanometers which will not appear as a fog. Charged fine particle water (including OH radicals) on the order of nanometers will not easily produce dew condensate on the lens of the camera device and the cover and thus, will not easily fog the same.

As illustrated in FIG. 45 for example, the image capturing camera 706 may be unitized with a battery 730, etc. to form an image capturing unit 731. The image capturing unit 731 may be configured to be detachably attached to a receiving portion provided in the recess 702 for example. The image capturing unit 731 is connected to a power supply system of the refrigerator 700 through a power supply connector 732 provided in the recess 702. Though not illustrated, a power supply connector may be provided in the door pocket 705, etc. to allow the image capturing unit 731 to be detachably attached to the door pocket 705. Receiving portions such as the holding portion 202 exemplified in FIGS. 13 and 14 or the holding portion 401 of the refrigerator holder 400 exemplified in FIG. 19 for example may be provided to facilitate the installation of the image capturing unit 731. The power supply connector is preferably provided in the form of a cord such as a USB cord that can be moved freely. Alternatively, the receiving portion may be configured by the so-called male terminal which may be removably inserted into the so-called female terminal provided at the camera. The so-called male terminal may be inserted into the so-called female terminal provided at the camera instead. The power supplying portion may be configured as a movable cord or as a fixed structure which is unmovable.

Further, air supply ports 740 may be provided on both the left and right sides of the back surface disposed in the far side of the fridge interior as illustrated in FIG. 46. The air supplied from the air supply ports 740 may be arranged to flow along the surface (the fridge interior side) of the protection cover 710. As a result, it is possible to prevent development of dew condensate on the surface of the protection cover by the air flowing along the surface of the protection cover 710.

A cool air duct may be provided at the center of the back surface having outlets opening toward the left and right so that cool air flows toward the protection cover 710 from the outlets.

As illustrated in FIG. 47 for example, at least one of the shelves provided in the fridge interior may be configured as a movable shelf 750 capable of being moved in the up and down direction of the fridge interior. A transfer mechanisms 751 for moving the movable shelf 750 in the up and down direction are provided in the lower portions of the left and right ends of the movable shelf 750. The transfer mechanism 751 is configured to move the movable shelf 750 in the up and down direction by for example moving an internal wire by operating a handle no shown. Non-transparent portions 750*a* applied from the upper side of the transfer mechanisms 751 are provided at least at the left and right ends of the movable shelf 750. The non-transparent portions 750*a* may be realized by attaching a non-transparent member or by applying a non-transparent coating.

The image capturing camera 706 is preferably provided at a location capable of capturing an image of the upper side of the movable shelf 750 at any height between the topmost elevation and the lowermost elevation. That is, the image capturing camera 706 is preferably provided so as to be at least higher than the topmost elevation of the movable member 750 and positioned so that the direction of image capturing is oriented obliquely downward.

As illustrated in FIG. 48 for example, the image capturing camera 706 may be provided on the fridge interior surface of the ceiling located above the movable shelf 750. As a result, it is possible to capture an image of the upper side of the movable shelf 750 at any height between the topmost elevation and the lowermost elevation using the image capturing camera 706 located thereabove. Further, images of the storage items located on the shelves below the movable shelf 750 may be captured through the transparent portion of the movable shelf 750 exclusive of the non-transparent portions 750*a*.

The configurations exemplified above may be applied to any storage chamber provided in the refrigerator such as the refrigeration chamber, the freezer chamber, the vegetable chamber, and the chiller chamber.

Fourth Embodiment

A description will be given hereinafter on a fourth embodiment with reference to FIGS. 53 to 64. Elements that are identical to those of the first embodiment are identified with identical reference symbols and are not described in detail. Appropriate image capturing timing may be employed from those exemplified in the foregoing embodiments.

A refrigerator 1 of the present embodiment is provided with a camera unit 1000 serving as an image capturing unit as illustrated in FIG. 53. The refrigerator 1 is connected to a home appliance network system 100 (see FIG. 1) as was the case in the first embodiment. The refrigerator 1 may be connected to the home appliance network system 100 by wireless communication method or by wire communication method as was the case in the first embodiment. PLC (Power Line Communication) is employed in the present embodiment. PLC is a wire communication method in which communication is performed through a power line configured to supply power to the refrigerator 1. A description will be given hereinafter on the places where the camera unit 1000 may be mounted with some examples.

Example 1

Camera unit 1000 of EXAMPLE 1 is provided on the door of the refrigerator 1. The camera unit 1000 is provided at a location capable of capturing an image of the central portion of the refrigeration chamber 3 interior for example. More specifically, the camera unit 1000 is provided on the right-side door 3*b* configured to open/close the refrigeration chamber 3 (storage chamber) which is the target of image capturing so as to be disposed at a location substantially at the vertical and lateral a center of the refrigeration chamber 3. As illustrated in FIGS. 54A and 54B, the camera unit 1000 is shaped substantially like a cuboid containing a camera module 1003 (one example of an image capturing module) in a space surrounded by a camera case 1001 (one example of a protection case) and a bottom plate 1002.

The camera unit 1000 is further provided with a connection cable 1004 configured to establish connection with the refrigerator 1 side and a flange portion 1005 for securing the camera unit 1000. The connection cable 1004 is used for receiving supply of power from the refrigerator 1 side, for transmission of image capturing instructions to the camera unit 1000, and for acquiring the captured image data. The camera unit 1000 is mounted on the fridge interior side of the door 3*b* through the flange portion 1005. Thus, in EXAMPLE 1 and later described EXAMPLES 2 to 4, the connection cable 1004 is wired inside the door 3*b* and is connected to the main control portion 30 (see FIG. 4) of the refrigerator 1 through the door hinge.

As illustrated in FIG. 55, the camera module 1003 is provided with a substrate 1012 and a lens unit 1013 mounted on the substrate 1012. The substrate 1012 is provided with an image capturing element 1010 such as a CCD sensor and CMOS sensor and circuit components 1011, etc. serving as a peripheral circuit of the image capturing element 1010. The image capturing element 1010 of the present embodiment is shaped like a rectangle. The lengthwise direction of the image capturing element 1010 is oriented in the same direction as the lengthwise direction (up and down direction of FIGS. 54A-54B) of the camera unit 1000. The substrate 1012 is provided with a lens holder 1014 at a location where the image capturing element 1010 is provided. A female thread is provided on the inner peripheral surface of the lens holder 1014. A male thread is provided on one end of the lens unit 1013 in the substrate 1012 side. The distance between the lens unit 1013 and the image capturing element 1010 is adjusted by screwing the lens unit 1013 into the lens holder 1014.

Lens unit 1013 is provided with multiple lenses 1015, three lenses in the present embodiment, and each of the lenses 1015 is held inside a body made of a resin material for example. The camera unit 1000 establishes a view angle of approximately 120 degrees by the three lenses 1015 to enable a wide angle image capturing of the fridge interior. Lens unit 1013 is provided with an infrared filter 1016 substantially limiting the light detected by the image capturing element 1010 to the range of visible light. Thus, the camera unit 1000 is capable of capturing images of the fridge interior in vivid colors when image is captured in color. The number of lenses 1015, etc. described herein is merely an example and may be changed depending upon the required view angle.

As illustrated in FIG. 53 B, the camera case 1001 of the camera unit 1000 is potted with a potting material such as urethane resin or epoxy resin, etc. so that the entire camera module 1003 is potted. Further, as illustrated in FIG. 55, an O ring 1018 is provided in the outer peripheral side of the lens unit 1013. The space between the lens unit 1013 and the camera case 1001 is sealed by the O ring 1018. The potting material 1017 is not illustrated in FIG. 55.

Thus, the intrusion of water and moisture into the camera case 1001 from the front surface side of the lens unit 1013 is inhibited. The bottom plate 1002 side of the camera case 1001 is also sealed including the portion where the connection cable extends through. Thus, the camera unit 1000 is entirely water proofed or drip proofed while the camera module 1003 provided therein is also protected from dew condensate, etc.

As illustrated in FIG. 56A, the camera unit 1000 is mounted on the inner plate 14 of the right-side door 3*b* as illustrated in FIG. 56A. The camera unit 1000 is mounted so that the view is directed toward the fridge interior when the door 3*b* is closed. Thus, the camera unit 1000 is capable of capturing the image of the refrigeration chamber 3 from the front side at a location substantially centered in the vertical direction and in the lateral direction of the refrigeration chamber 3 when the right-side door 3*b* is closed. That is, it is possible to capture an image of the fridge interior providing a view which is close to the view available to the user when the user normally uses the refrigerator 1 when the camera unit 1000 is used. The door pocket 9*b* located adjacent to the camera unit 1000 is provided with a notch 9*b*1 as was the case in the first embodiment so as not to significantly block the view of the camera unit 1000.

As illustrated in FIG. 56B, the camera unit 1000 is oriented vertically so that the lengthwise direction is taken along the up and down direction. Thus, lengthwise direction of the image capturing element 1010 inside the camera unit 1000 is also taken along the up and down direction. Thus, the camera unit 1000 and the image capturing element 1010 are formed substantially in a cuboid form that are sized differently in the vertical and lateral directions. It is thus, possible to capture a vertically elongate image of a vertically elongate space of the refrigeration chamber 3. That is, it is possible to capture an image of the fridge interior while utilizing the image capturing range of a vertically oriented image capturing element 1010.

Example 2

In EXAMPLE 2, the camera unit 1000 is mounted in a recess 1020 provided in the inner plate 14 side of the right-side door 3*b* as illustrated in FIG. 57. The camera unit 1000 is oriented in the vertical direction in EXAMPLE 2 as well. The recess 1020 is formed in a size capable of storing the entire camera unit 1000. The camera unit 1000 stored in the recess 1020 is disposed so as not to project in the fridge interior side relative to the inner plate 14. As a result, it is possible to prevent contact with the camera unit 1000 when taking a PET bottle, etc. in and out of the lowermost door pocket 10*b* (see FIG. 53) of the right-side door 3*b*.

Because the entire camera unit 1000 is stored in the recess 1020, the possibility of contacting the user's hands is reduced to consequently reduce the possibility of contaminating the lens 1015.

Further, the location of the camera unit 1000 is displaced toward the fridge exterior; that is, toward the front side of the refrigerator 1 as compared to EXAMPLE 1 described above. As a result, it is possible to capture an image of the interior of the refrigeration chamber 3 in a greater view.

A transparent cover member made of acryl for example may be provided for example in the opened side of the recess 1020 so as to be flush with the inner plate 14. It is thus, possible to prevent contamination of the lens 1050, etc. and accumulation of dust in the recess 1020.

In EXAMPLE 3, the camera unit 1000 is disposed inside the inner plate 14 of the right-side door 3*b* as illustrated in FIG. 58. The camera unit 1000 is mounted so as to be oriented in the vertical direction in EXAMPLE 3 as well. Only the lens surface of the camera unit 1000 is exposed to the refrigeration chamber 3 side. Thus, it is possible to prevent the camera unit 1000 from interfering with a PET bottle, etc. being taken in and out of the door pocket 10*b*.

In EXAMPLES 1 to 3, it is possible to capture an image of the fridge interior from the front side of the refrigerator 1 providing a view which is close to the view available to the user when the user normally uses the refrigerator 1 as illustrated in FIG. 59A by mounting the camera unit 1000. It is thus, possible to check the status of the fridge interior by displaying the captured image through the communication terminal 103 etc. via the home appliance network system 100.

Example 4

In EXAMPLE 4, the camera unit 1000 is provided on a vertical partition 17 (see FIG. 53) provided on the left-side door 3*a*. The vertical partition is provided on the end portion in the opposite side of the hinge portion 3*d* of the left-side door 3*a*. The vertical partition changes its orientation by the rotary mechanism 17*a* when the door 3*a* is opened as illustrated in FIG. 60A and when the door 3*a* is closed as illustrated in FIG. 60B. The vertical partition is located substantially in the lateral center of a double door (the so-called French door), that is, substantially at the central portion of the refrigeration chamber 3. When the left-side door 3*a* and the right-side door 3*b* are closed, the fridge interior and the fridge exterior are sealed by a gasket 1030 as illustrated in FIG. 61A.

As illustrated in FIGS. 61A and 61B, the camera unit 1000 is mounted on a mount plate 1032, disposed inside a vertical partition 17 filled with a heat insulating material 1031, so as to be oriented in the vertical direction. The camera unit 1000 is disposed substantially at the vertical center of the vertical partition 17. Thus, the camera unit 1000 is capable of capturing an image of the refrigeration chamber 3 from the front side from a location substantially centered in the vertical direction and in the lateral direction of the refrigeration chamber 3 in EXAMPLE 4 as well. The vertical partition 17 rotates as described above. Thus, when the left-side door 3*a* is opened, the camera unit 1000 faces away toward the opposite side of the opened side of the left-side door 3*a* as illustrated in FIG. 60A so that the camera unit 1000 is parallel with the left-side door 3*a*. As a result, it is possible to prevent the user from contacting the lens surface of the camera unit 1000 when the left-side door 3*a* is opened.

When the left-side door 3*a* is closed, the camera unit 1000 faces the fridge interior as illustrated in FIG. 60B. Thus, it is possible to capture an image of the fridge interior from the front side and substantially the central portion as illustrated in FIG. 62. If the door pocket 9*a* blocks the view of the camera unit 1000, a notch similar to the one provided on door pocket 9*b* may be provided on the door pocket 9*a*.

EXAMPLE 4 also allows an image of the fridge interior to be captured as illustrated in FIG. 59A as was the case in EXAMPLES 1 to 3.

Example 5

In EXAMPLE 5, the camera unit 1000 is mounted in a recess 1040 provided on a sidewall 3*c* of the refrigeration chamber 3 as illustrated in FIG. 63. In example 5, the camera unit 1000 is provided on each of the left and right sidewalls 3*c*. The camera unit 1000 may be provided only on one of the sidewalls 3*c*.

Recess 1040 is provided on the forward side of the sidewall 3*c* relatively closer to the door. A sloped mounting surface 1041 for mounting the camera unit 1000 is provided on the sidewall 3*c*. In EXAMPLE 5, the cross section of the recess 1040 is substantially triangular. As a result, the view of the camera unit 1000, when mounted in the recess 1040, is directed substantially to the center of the refrigeration chamber 3.

In EXAMPLE 5, image of the fridge interior is captured from both the left and right sides. As a result, an image of a portion which was blocked by food, etc. in one of the camera unit 1000 may be captured by the other camera unit 1000. As a result, it is possible to capture an image of the entire fridge interior without being interfered by food, etc. and thereby allowing the fridge interior to be checked in more detail. Further, it is possible to display the fridge interior three dimensionally by producing a three-dimensional image by combining the images captured from two directions.

The camera unit 1000, establishing a wired connection with other components, is mounted on the sidewall 3*c*. Thus, it is possible to wire the connection cable 1004 through the sidewall 3*c* to allow the connection cable 1004 to be routed easily to the main control portion 30 (see FIG. 4) provided in the rear surface side of the refrigerator 1.

Example 6

In EXAMPLE 6, an LED light 1050 serving as a lighting unit is provided at the camera unit 1000 as illustrated in FIG. 64A. The front side of the camera unit 1000 is covered by a protection cover 1051 in which at least the portion corresponding to the LED light 1050 is transparent. The interior of the camera case 1001 of the camera unit 1000 is potted by a potting material 1017 as was the case in the camera units 1000 in EXAMPLES 1 to 5.

The camera unit 1000 of the present embodiment is disposed so that the protection cover 1051 and a mounting surface 1060 provided on a front surface thereof are coplanar. In other words, the camera unit 1000 is stored in the storing portion. The mounting surface 1060 corresponds to the inner plate 14 of the door, the vertical partition 17, and the sidewall 3*c*, etc. The forwardmost surface of the lens unit 1013 is located forward relative to the mounting surface 1060.

The LED light 1050, disposed inside the camera case 1001, is displaced in the front and rear direction from the image capturing element 1010 (see FIG. 55) as illustrated in FIG. 64B. More specifically, the LED light 1050 is disposed forward relative to the image capturing element 1010. In the present embodiment, the displacement is achieved by implementing the image capturing element 1010 on the substrate 1012 and implementing the LED light 1050 on an LED substrate 1052 disposed forward relative to the substrate 1012.

The LED light 1050 is disposed close to the front surface of the camera unit 1000 to prevent the light irradiated from the LED light 1050 from directly entering the lens unit 1013 or the image capturing element 1010 inside the camera case 1001. The LED light 1050 is surrounded by an opened wall 1053 spreading toward the forward direction and is located rearward relative to the front surface of the lens unit 1013. The forwardmost surface of the lens unit 1013 is located forward relative to the mounting surface 1060. Thus, even when light is reflected off the protection cover 1051 protecting the front surface of the LED, the reflected light will not enter the lens unit 1013 directly.

When the camera unit 1000 configured in the above described manner is mounted at the locations exemplified in EXAMPLES 1 to 5, it is possible to capture an image of the fridge interior by illuminating the LED light 1050 without illuminating the in-fridge lighting 13, etc.

The protection cover 1051 of the camera unit 1000 may be disposed so as to be located inward (rearward) relative to the mounting surface 1060. In such case, the forwardmost surface of the lens unit 1013 may be coplanar with the mounting surface 1060 or inward relative to the mounting surface 1060. The location of the lens unit 1013 inside the camera unit 1000 may be adjusted so that the forwardmost surface of the lens unit 1013 is coplanar with the protection cover 1051. That is, the tip portion of the body of the lens unit 1013 may be coplanar with the protection cover 1051. As a result, the camera unit 1000 will not project into the fridge interior when mounted on the sidewall 3*c* of the refrigeration chamber 3 or the inner plate 14, etc. of the door and thus, will not become an impediment in taking food in and out of the fridge. In such case, an opening comparably sized with the camera case 1001 may be provided on the mounting surface 1060. Alternatively, a round openings corresponding to the lens unit 1013 and the LED light 1050 may be provided. The camera case 1001 may be arranged to project from the mounting surface 1060 so that droplets of dew condensate streaming along the mounting surface 1060 will not flow to the lens surface.

Other Embodiments

The present invention is not limited to the embodiments exemplified above but may be modified or expanded as follows. Some or all of the modified and expanded examples given below may be combined as required.

In the example discussed in the first embodiment, the image capturing camera is provided on the right-side door 3*b*. Alternatively, the image capturing camera 18 may be provided on the vertical partition 17 provided on the left-side door 3*a*. The vertical partition 17 rotates depending upon the opened/closed status of the left-side door 3*a*. When the left-side door 3*a* is closed as illustrated in FIG. 49A, the image capturing camera 18 faces the fridge interior and thus, is capable of capturing an image of the fridge interior. When the left-side door 3*a* is opened as illustrated in FIG. 49B, the image capturing camera 18 faces the inner plate side and thus, the lens surface will not be contaminated since the user will not come in contact with the image capturing camera 18.

A concaved storing portion may be provided on the vertical partition and the camera may be stored in the storing portion. In such case, the vertical partition is preferably configured in the shape of an elongated rectangle containing a heat insulating portion and a heater. A recess is preferably formed into the vertical partition toward the fridge exterior from the fridge interior for storing the camera therein in which case the camera is disposed so as to face the fridge interior.

A single image capturing camera 18 and a single image capturing light 19 was provided in the example given in the first embodiment. Alternatively, multiple image capturing units (an upper image capturing camera 60, a lower image capturing camera 62, a door image capturing camera 64) and multiple lighting units (an upper image capturing light 61, a lower image capturing light 63) may be provided as illustrated as illustrated in FIG. 50. In such case, an image of the upper side of the fridge interior may be captured by the upper image capturing camera 60 and an image of the lower side of the fridge interior may be captured by the lower image capturing camera 62. That is, multiple image capturing units may be provided for capturing images of a specific location in the fridge interior. In such case, a single image of the fridge interior such as the image illustrated in FIG. 7 for example may be obtained by combining each of the images.

It is possible to capture an image of the entire range of the fridge interior without using a wide-angle lens since only images of specific locations in the upper side or the lower side of the fridge interior, etc. need to be captured. It is possible to reduce the size of the views of the upper image capturing camera 60 and the lower image capturing camera 62 compared to the view required for wide-angle image capturing using a single image capturing camera 18. Stated differently, the possibility of the view being blocked will be smaller compared to the first embodiment even if the notch 9*b*1 is not provided in the door pocket 9*b*. It is thus, possible to capture an image of the fridge interior while maintaining the original storage capacity of the door pocket.

Further, the image capturing environment may be controlled by illuminating the appropriate lighting unit depending upon the targeted location of image capturing. For example, upper image capturing light 61 may be illuminated when images are captured using the upper image capturing camera 60 and lower image capturing light 63 may be illuminated when images are captured using the lower image capturing camera 62. An image capturing unit may be provided for each shelf 11 for example in addition to the upper side portion and lower side portion.

Further, a single image of the fridge interior may be produced by combining multiple images by, for example, reducing the illuminance of the ceiling light 13 when capturing an image of the upper side of the fridge interior and controlling the illuminance of the ceiling light 13 to a normal level when capturing an image of the lower side of the fridge interior. That is, it is not necessarily required to provide lighting dedicated for image capturing such as the image capturing light 19.

In the first embodiment, the image capturing environment is controlled by illuminating the image capturing light 19. Alternatively, the image capturing environment may be controlled for example to weaken the back light against the image capturing camera 18 by reducing the illuminance of the ceiling light 13, the side light 36, etc.

An image of the door pocket side may be captured using the door image capturing camera 64 which may be combined with and image of the fridge interior as illustrated in FIG. 51 to produce a synthetic image depicting the door of the refrigerator 1 being opened. The synthetic image may be displayed on the communication terminal 103. In such case, an image of the door pocket side may be captured by providing the door image capturing camera 64 in the fridge interior. Alternatively, the door image capturing camera 64 may be provided on each of the inner plates 14 of the doors. The door image capturing camera 64 may capture an image of the door pocket of the other door after the doors have been opened and an image may be captured after the doors have been closed. The images may be combined to obtain a single image of the fridge interior.

In the examples given in each of the embodiments, the captured images are stored in the server 104. However, the captured images may be transmitted directly to the communication terminal 103.

In each of the embodiments, the captured images are transmitted as they are. Alternatively, the images may be transmitted to the server 104 after correcting the image distortions caused by the use of the wide-angle lens. The image distortions may be corrected at the server 104.

In the examples given in each of the embodiments, an image of the fridge interior is captured at the timing when instructions to capture an image of the fridge interior from the communication terminal 103 has been received. However, an image of the fridge interior need not be captured upon receiving the instructions if an image has been captured after the elapse of the delayed image capturing time to serve as the latest image. That is, the image captured after the elapse of the delayed image capturing time is the latest image after the door of the refrigerator 1 has been closed. Thus, the state in which the image has been captured after the lapse of the delayed image capturing time may be deemed as the state in which the door has not been opened (the state in which the storage status has not changed) after the image has been captured. Hence, if the image captured after the elapse of the delayed image capturing time is the latest image, unnecessary power consumption can be prevented by refraining from further image capturing. When the communication terminal 103 acquires an image from the server 104, a notice may be issued indicating that the acquired image is the latest image.

In the first embodiment, the control portion 50 is provided independent of the main control portion 30. However, the main control portion 30 may be configured to control the image capturing camera 18, etc. It is thus, possible to reduce the number of components and cost. In such case, the captured images can be transmitted as they are to the server 104 as exemplified in the embodiment. This will eliminate the burdensome image processing and allow the control to be undertaken by the main control portion 30 alone.

In the first embodiment, a communication unit is provided in the image capturing camera 18 side. However, a communication unit may be provided in the refrigerator 1 side as was the case in the second embodiment so that the image capturing camera 18 side may communicate with the communication unit of the refrigerator 1 side. In such case, the communication unit provided in the refrigerator 1 side may be provided in the main control portion 30 of the refrigerator 1 or may be configured as a detachably attached component (an optional component) like the communication device 501 of the second embodiment illustrated in FIG. 25.

In the first embodiment, the refrigeration chamber 3 was given as an example of a storage chamber. Alternatively, images of other storage chambers such as the vegetable chamber 4 may be captured instead as was the case in the second embodiment.

In the first embodiment, the image capturing camera 18 is preinstalled in the refrigerator 1. Alternatively, the image capturing camera 18 may be configured to be detachably attached to the refrigerator 1. More specifically, the user may be allowed to attach the image capturing camera 18 after purchasing the refrigerator 1. That is, the image capturing camera 18 may be configured as detachably attached camera unit like the camera device 300 of the second embodiment.

The image capturing camera 18 and image capturing light 19 may be stored in one inside a unit case configured to be detachably attached to the refrigerator 1. The control portion 50 and the communication portion 52 may be provided integrally with the camera device. The lens heater 51 may also be provided integrally with the camera device along with the foregoing components. The control portion 50 and the communication portion 52 may be preinstalled to the refrigerator 1 and a separate communication unit for communicating with the control portion 50 and the communication portion 52, etc. may be provided in the camera device side. That is, any configuration may be employed to the camera device as long as it is at least provided with the image capturing camera 18.

The hydrophilicizer may be applied to the surface of the lens 301 or the cover protecting the lens.

The camera device and the refrigerator 1 may establish a wire communication or a wireless communication. Power may be supplied wirelessly to the camera device.

When the camera device is configured as detachably attachable device, a receiving portion may be provided on door pockets 8 to 10, the inner plate 14, the vertical partition 17, or the shelves, etc. of the refrigerator 1. A mounting portion to be mounted on the receiving portion may be provided on the camera device to allow the detachable attachment. More specifically, the mounting portion and the receiving portion may be engaged with one another. Alternatively, a clip may be provided on the camera device configured to clamp the door pockets which may come in different thicknesses (that is, a configuration in which the image capturing unit can be mounted on any location).

When employing a wireless method, a recess 600 may be provided on the inner plate 14 of the door of the refrigerator 1 for example as illustrated in FIGS. 52A-52B. The recess 600 serves as a marking indicating the location where the camera device 300 is to be mounted. A magnet 601 may be provided on the camera device 300 side for mounting purposes. This is because the doors such as the right-side door 3*b* contains an iron plate 602 made of metal and the camera device 300 may be attached to the doors by magnetic force. The recess 600 may be provided with a mounting structure other than the magnet (a holding structure or an engagement structure for example). Further, a detection magnet 603 like the magnet 206 of the second embodiment may be provided alternatively. A magnet may be provided on the door side and a metal portion may be provided on the camera device 300 side.

If it is possible to attach the camera device to any given location, markings may be provided to indicate locations where appropriate images of the fridge interior may be captured such as locations where the camera view is less likely to be blocked by shelves, door pockets, or the like. Markings may be provided even if the location where the camera device is to be mounted is predetermined to provide guidance to the user.

A dedicated spot for storing the camera device may be formed in the door pocket and the camera device may be stored in such spot.

A detecting unit such as an IC chip, etc. configured to detect the presence and absence of the camera device maybe provided in specific locations inside the refrigerator 1. The operation of the communication portion 52 for example may be permitted depending upon the presence/absence of the camera device. The specific locations include at least the interior of the refrigerator 1. An input may be made from the control panel 33 indicating that the camera device has been mounted.

An identifying unit may be provided in the refrigerator 1 for identifying the camera device. The operation of the camera device (including the operation of the communication device 52, etc.) may be permitted only when a specific camera device has been identified. As a result, it is possible to permit operation of only a reliable camera device (a camera device made by the manufacturer of the refrigerator or a compatible camera device). The preexisting in-fridge lighting may be used as a notifying unit for notifying the timing of image capturing to eliminate the need for additional components and thereby achieve cost reduction.

A detection unit may be provided in the camera device side for detecting whether or not the refrigerator 1 is eligible for operation of the camera device. A detection subject unit may be provided in the refrigerator 1 side which is configured to be detected by the detection unit. The detection unit and the detection subject unit may be implemented physically for example as connectors having mating shapes or for example as components exchanging identification information.

Alternatively, the refrigerator 1 may communicate with the camera device 300 for example to identify whether or not the camera device 300 is eligible for operation with the refrigerator 1. In such case, the communication device 501 of the refrigerator 1 serves as an identification unit and the communication module 306 serves as an identification subject unit which is identified by the refrigerator 1 for judging that the camera device 300 is eligible for operation with the refrigerator 1.

Further, the identification unit and the identification subject unit may also serve as the detection unit and the detection subject unit. That is, if the camera device 300 can be stored in the holding portion 202, the camera device 300 can be identified as to be eligible for use with the refrigerator 1. The polarity of the magnet 206 provided at the holding portion 202 may be detected by the camera device 300 and the result of detection may be notified to the refrigerator side 1 to judge whether the camera device 300 has been stored in the holding portion 202. Alternatively, the in-fridge lighting may be flickered by the refrigerator 1 side and the camera device 300 side may be configured to issue some kind of response, etc. to enable identification.

A pocket mounting portion for mounting a door pocket may be provided on the inner plate 14 of the refrigerator 1 so that door pocket 9*b* (the same is applicable to the door pocket 200 of the second embodiment) itself is detachably attached. That is, when the camera device is detachably attached, users who do not wish to use the camera device may increase storage capacity by attaching wide door pockets such as the door pocket 8, whereas users who wish to use the camera device may capture images of the fridge interior without the view of the camera device being blocked by attaching the door pocket 9*b* (or the door pocket 200) which is relatively narrower.

As illustrated in FIG. 3, a wide (i.e. substantially as wide as the width of the right-side door 3*b*) door pocket covering the spot where the image capturing camera 18 is mounted (or a door pocket shaped so as to make up for the notch 9*b*1 of the door pocket 9*b*) may be mounted on the pocket mounting portion. When the camera device is not in use, the mounting portion of the camera device may be covered by the door pocket so that the user is inhibited from inadvertently touching the mounting portion, etc.

The control of the timing of image capturing by the control portion 309 in the second embodiment may be carried out by judging image capturing conditions 1 to 4, etc. as was the case in the first embodiment by acquiring the opened/closed status of the door through communication with the refrigerator 1. In such case, both or either of the timing detection by the illuminance sensor 313 and image capturing conditions 1 to 4 may be employed. More specifically, image was not captured when the user has opened the door in the second embodiment. The moment when the in-fridge lighting has been continuously illuminated may be judged as the moment when the door has been opened and the moment when the in-fridge lighting has been thereafter turned off may be judged as the moment when the door has been closed. Image capturing condition 1 will be met by capturing the image of at the moment when the in-fridge lighting has been turned off. By using the communication module 306 to acquire the opened/closed status of the door through communication with the main-control portion 30 of the refrigerator 1, it is possible to employ image capturing conditions 1 to 4.

The removing unit for removing dew condensate may be provided to the camera device 300 of the second embodiment.

The predetermined time period mentioned in the second embodiment may be specified to a time period in which the dew condensate is removed based on temperature and humidity (or at least a time period equal to or greater than such time period). It goes without saying that a fixed time period such as 2 hours may be specified.

The camera device 300 of the second embodiment may be configured so as not to be provided with the image capturing lamp 302. For example, the refrigeration chamber 3 is provided with a ceiling light 13, etc. and thus, image capturing may be carried out using such in-fridge lighting. In such case, instructions to illuminate the in-fridge lighting may be transmitted to the refrigerator 1 side through the communication module, etc. Both the image capturing lamp 302 and the in-fridge lighting may be used during image capturing.

In the examples given in the above described embodiments, images of the fridge interior are captured. Images of closed spaces provided in the fridge interior (such as an egg container room which is closed or encapsulated by a cover or drawer configuration, a special purpose room 12 of the chiller chamber, and a low pressure preservation chamber placed in a sealed state) for example may be captured by forming a window in a portion of such closed space structure using a transparent material and capturing images of the interior of the closed space through the window.

Power may be supplied to the camera device 300 from the refrigerator 1 side by wired or wireless feed. As a result, it is possible to eliminate battery shortages and thereby improve usability. Because a continuous supply of power is given to the refrigerator 1, it will not affect the operation of the refrigerator 1 even if a power supplying circuit, etc. for supplying power to the camera device 300 is provided. By configuring the power supplying circuit to be detachably attached to the refrigerator 1 like the camera device 300, it is possible to inhibit unnecessary supply of power.

In the second embodiment, the magnets are disposed at holding portions provided in two different locations so that polarity of one side of the magnet facing the camera device 300 differs between the two magnets. However, the magnets may be disposed so that relative positioning with respect to the detecting portion 307 differ. In such case, the output of the detection sensor will increase if disposed closer to the magnet, whereas the output will decrease if disposed farther from the magnet (however, the positive and negative nature of the magnetic field will not change). It is thus, possible to provide three or more holding portions.

The temperature sensor 310, the magnetic sensor 311, the acceleration sensor 312, and the illuminance sensor 313 may be provided as required and thus, some may be absent. For example, if the orientation of the camera is detected by the magnetic sensor 311, the acceleration sensor 312 is not necessarily required.

The checking the status inside the refrigerator from remote locations such as outdoors includes, for example, detachably attaching the communication terminal, serving as an external device to which in-fridge image information is transmitted, on the body of the refrigerator and checking the status inside the refrigerator from the outside of the refrigerator through the image shown on the display portion of the communication terminal without opening the door of the refrigerator with the communication terminal staying attached to the refrigerator. A display portion may be fixed to the door, etc. of the refrigerator to allow the status inside the refrigerator to be checked through the display portion.

In some embodiments of the present invention the recess is provided on a side surface of the interior of the refrigerator.

In some embodiments of the present invention the image capturing unit in the recess is located further toward the interior of the refrigerator compared to the lighting unit.

In some embodiments of the present invention the image capturing unit and the lighting unit are displaced from one another in a lateral direction in the recess.

In some embodiments of the present invention the recess has a protection cover mounted thereto, the protection cover having projections and retractions formed in a portion confronting the lighting unit, the projections and retractions not being formed in a portion of the protection cover confronting the image capturing unit.

In some embodiments of the present invention the lighting unit is provided in plural and the image capturing unit is disposed between the lighting units in the recess.

In some embodiments of the present invention a notch is provided on a thermal insulation wall extending into the interior of the refrigerator from a door, and wherein the image capturing unit is capable of capturing an image of the door pocket through the notch.

In some embodiments of the present invention a front portion of the shelf is glossed.

In some embodiments of the present invention a lighting unit and a shelf provided in the interior of the refrigerator are located at different elevations.

In some embodiments of the present invention the container is provided in plural and the image capturing unit is provided in a location capable of capturing images of the plural containers.

In some embodiments of the present invention the image capturing unit is oriented downward from an upward direction.

In some embodiments of the present invention the image capturing unit is located rearward relative to a shelf provided in the interior of the refrigerator.

In some embodiments of the present invention plural shelves are provided in the interior of the refrigerator and the image capturing unit is located between the shelves.

In some embodiments of the present invention the image capturing unit is provided in plural, each of the image capturing units being located between the shelves.

In some embodiments of the present invention the image capturing unit includes a dedicated upper image capturing unit capable of capturing an image of an upper side of the shelves and a dedicated lower image capturing unit capable of capturing an image of an lower side of the shelves.

In some embodiments of the present invention the image capturing unit is located rearward relative to a door pocket provided on a door.

In some embodiments of the present invention the interior of the refrigerator contains a drawable container and a shelf provided above the container comprises a transparent shelf, and wherein the image capturing unit is capable of capturing an image of an interior of the container through the transparent shelf.

In some embodiments of the present invention a substrate is provided in the recess and a light intensity detecting unit is configured to detect light intensity of the interior of the refrigerator is implemented on the substrate, and wherein the image capturing unit is mounted on the substrate.

In some embodiments of the present invention the image capturing unit is unitized and is detachably attached into the recess.

In some embodiments of the present invention a detachable lid is provided at the recess.

In some embodiments of the present invention the interior of the refrigerator is configured to cause airflow to flow along the lid.

In some embodiments of the present invention a movable shelf capable of moving in an up and down direction is provided in the interior of the refrigerator, and wherein the image capturing unit is provided in a location capable of capturing an image of an upper side of the movable shelf located at any elevation between an upper movable limit and a lower movable limit.

In some embodiments of the present invention the image capturing unit is provided above the movable shelf.

In some embodiments of the present invention the movable shelf is provided with a transfer mechanism configured to move the movable shelf, the movable shelf being provided with a nontransparent portion for hiding the transfer mechanism on a portion thereof.

In some embodiments of the present invention a receiving portion is provided for mounting the image capturing unit, wherein communication portion is configured to transmit image information of the interior of the refrigerator captured by the image capturing unit mounted on the receiving portion to an external device.

In some embodiments of the present invention a marking indicating a location for installing the image capturing unit is provided.

In some embodiments of the present invention a control unit is configured to control a timing for capturing an image of the interior of the refrigerator by the image capturing unit.

In some embodiments of the present invention the control portion is configured to capture an image of the interior of the refrigerator by the image capturing unit at a timing after a door has been closed.

In some embodiments of the present invention the control portion is configured to capture an image of the interior of the refrigerator by the image capturing unit at a timing after a predetermined time period has elapsed after a door has been closed.

In some embodiments of the present invention a removing unit is configured to remove dew condensate from a lens surface of the image capturing unit, wherein the control portion is configured to capture an image of the interior of the refrigerator by the image capturing unit at a timing after the dew condensate has been removed from the lens surface.

In some embodiments of the present invention the communication unit is configured to be capable of receiving instructions for capturing an image of the interior of the refrigerator from an external device, and wherein the control unit is configured to capture an image of the interior of the refrigerator at a timing based on the instructions given from the external device.

In some embodiments of the present invention the image capturing unit is a camera device detachably attachable to the refrigerator, wherein the communication unit is provided at the refrigerator and is configured by a refrigerator-side communication unit is configured to receive instructions for capturing an image of the interior of the refrigerator from an external device, and wherein a camera-side communication unit provided at the camera device and being is configured to transmit image information to an external device, and the camera device is configured to capture an image of the interior of the refrigerator when image capturing instructions have been notified from the refrigerator having received instructions for capturing an image of the interior of the refrigerator and transmit the captured image information to an external device from the camera-side communication unit.

In some embodiments of the present invention the control unit is configured to prepare an image capturing environment by illuminating a lighting unit when capturing an image of the interior of the refrigerator by the image capturing unit.

In some embodiments of the present invention the receiving portion is provided on a door and the image capturing unit is mounted on the door.

In some embodiments of the present invention the image capturing unit is provided on a vertical partition provided on a door.

In some embodiments of the present invention the image capturing unit is provided on an inner plate of a door.

In some embodiments of the present invention a front surface of a door is formed of non-metallic material.

In some embodiments of the present invention a camera device is disposed in a recess provided in an interior of a refrigerator and is configured to capture an image of the interior of the refrigerator. The camera device comprises an image capturing unit is configured to capture an image of the interior of the refrigerator; and a camera-side communication unit is configured to communicate with an external device.

In some embodiments of the present invention a camera-side lighting unit is provided for lighting the interior of the refrigerator, wherein the camera-side lighting unit is turned on when capturing an image of the interior of the refrigerator by the image capturing unit.

In some embodiments of the present invention a mounting portion is configured for mounting the image capturing unit on a receiving portion provided for mounting the image capturing unit on the refrigerator.

In some embodiments of the present invention an illuminance sensor is configured to detect illuminance of an environment in which the image capturing unit is installed, wherein a timing of image capturing is controlled based on the illuminance detected by the illuminance sensor.

In some embodiments of the present invention the image capturing unit is provided in a location capable of capturing an image of a central portion of the interior of the refrigerator.

In some embodiments of the present invention the image capturing unit is provided on a door for opening and closing a storage chamber being a target of image capturing, the image capturing unit being located substantially at a central portion in an up and down direction and a left and right direction of the storage chamber.

In some embodiments of the present invention the image capturing unit is provided inside a vertical partition provided on a door for opening and closing a storage chamber being a target of image capturing, the image capturing unit being located substantially at a central portion in an up and down direction inside the vertical partition.

In some embodiments of the present invention the image capturing unit is provided in a storage chamber being a target of image capturing.

In some embodiments of the present invention the image capturing unit is provided at a sidewall of a storage chamber being a target of image capturing.

In some embodiments of the present invention the image capturing unit is provided at left and right sidewalls of the storage chamber being the target of image capturing.

In some embodiments of the present invention a storage chamber being a target of image capturing is formed substantially in a shape of a cuboid in which a vertical dimension and a lateral dimension differ, and wherein the image capturing unit is provided with a rectangular image capturing element and is disposed so that a lengthwise direction of the image capturing element and a lengthwise direction of a storage chamber are oriented in the same direction.

In some embodiments of the present invention the image capturing unit is drip proofed or water proofed.

In some embodiments of the present invention the image capturing unit comprises a protection case and an image capturing module stored in the protection case, the image capturing module being configured by a substrate provided with circuit components and a lens unit provided thereon, and wherein an O ring is provided to seal a space between the lens unit and the protection case.

In some embodiments of the present invention the image capturing unit comprises a protection case and an image capturing module stored in the protection case, the image capturing module being configured by a substrate provided with circuit components and a lens unit provided thereon, and wherein an interior of the protection case is potted by a potting material.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

EXPLANATION OF REFERENCE SYMBOLS

In the figures, reference symbol 1 represents a refrigerator; 3, a refrigerator (storage chamber); 3*a*, a left-side door (door); 3*b*, a right-side door (door); 4, a vegetable chamber (storage chamber); 4*a* to 7*a*, a door; 5, an ice maker chamber (storage chamber); 6, an upper freezer chamber (storage chamber); 7, a lower freezer chamber (storage chamber); 8 to 10, a door pocket; 9*b*1, a notch; 13, a ceiling light (lighting unit); 14, an inner plate (receiving portion); 17, a vertical partition; 18, an image capturing camera (image capturing unit); 19, an image capturing light (lighting unit); 30, a control portion (control unit); 33*b*, switches (go-out switch); 33*c*, an outside fridge sensor; 36, a side light (lighting unit); 50, a control portion (control unit); 51, a lens heater (removing unit); 52, a communication portion (communication unit); 60, an upper image capturing camera (image capturing unit); 61, an upper image capturing light (lighting unit); 62, a lower image capturing camera (image capturing unit); 63, a lower image capturing light (lighting unit); 64, a door image capturing camera (image capturing unit); 100, a home appliance network system; 102, a communication line; 103, a communication terminal (exterior device); 104, a server (external device); 200, a door pocket (refrigerator door pocket, refrigerator holder); 202, a holder (receiving portion); 206, a magnet (detection subject unit); 300, a camera device (image capturing unit); 302, an image capturing lamp (lighting unit, camera-side lighting unit); 306, a communication module (communication unit, camera-side communication unit, identification subject unit); 307, a detecting portion (detecting unit); 308, an image capturing portion (image capturing unit); 310, a temperature sensor; 311, a magnetic sensor; 312, an acceleration sensor; 313, an illuminance sensor; 311, a magnetic sensor; 312, an acceleration sensor; 313, an illuminance sensor; 400, a refrigerator holder; 401, a holding portion; 405, a magnet (detection subject unit); 500, a home appliance network system; 501, a communication device (communication unit, fridge-side communication unit, identifying unit); 700, a refrigerator; 702, recess; 704, a wall; 704*a*, a notch; 705, a door pocket; 706, an image capturing camera (image capturing unit); 707, a lighting LED (lighting unit); 709, a substrate; 710, a protection cover (lid); 711, a shelf; 720, a container; 750, a movable shelf; 750*a*, a non-transparent portion; 751, a transfer mechanism; 1000, a camera unit (image capturing unit); 1001, a camera case (protection case); 1003, a camera module (image capturing module); 1010, an image capturing element; 1011, a circuit component; 1012, a substrate; 1013, a lens unit; 1017, a potting material; 1018, an O ring; and 1050, an LED light (lighting unit).

The invention claimed is:

1. A refrigerator comprising:

a refrigerator body;

a storage chamber formed in the refrigerator body;

a pair of biparting double doors configured to open and close the refrigerator, wherein the first one of the double doors includes a storing portion and a revolving vertical partition configured to rotate to fill a clearance from the second one of the double doors;

a lighting unit configured to illuminate an interior of the refrigerator;

an image capturing unit configured to capture an image of the interior of the refrigerator, the image capturing unit being provided on the vertical partition on the lateral center of the refrigerator and being configured to change orientation by the rotation of the vertical partition; and a control portion configured to control the image capturing unit, wherein when the first one of the doors is closed, the image capturing unit faces the refrigerator so that it is capable of capturing an image of the refrigerator, and when the first one of the doors is opened the image capturing unit faces toward an opposite side of the opened side of the first one of the doors and faces the storing portion of the first one of the doors so that the image capturing unit is capable of capturing an image of the storing portion of the first one of the doors.

2. The refrigerator according to claim 1, wherein the plurality of image capturing units and a shelf provided in the interior of the refrigerator are located at different elevations.

3. The refrigerator according to claim 2, wherein a front portion of the shelf is glossed, and a lighting unit and a shelf provided in the interior of the refrigerator are located at different elevations.

4. The refrigerator according to claim 1, wherein a gloss is applied to a front portion of a shelf provided in the interior of the refrigerator and an irradiation direction of a lighting unit is not oriented towards the front portion of the shelf.

5. The refrigerator according to claim 1, wherein the plurality of image capturing units are oriented downward from an upward direction.

6. The refrigerator according to claim 1, wherein plural shelves are provided in the interior of the refrigerator and the plurality of image capturing units are located between the shelves.

7. The refrigerator according to claim 1, wherein the image capturing unit captures an image at a timing in which instructions have been received from an external device when the first one of the doors is closed, and without instructions from the external device when the first one of the doors is opened.

8. The refrigerator according to claim 1, wherein the lighting unit is provided at a position where it does not face the image capturing unit when the first one of the doors is closed.

* * * * *